US009642475B2

(12) United States Patent
Vogler et al.

(10) Patent No.: US 9,642,475 B2
(45) Date of Patent: May 9, 2017

(54) HANGING PRODUCT DIVIDER AND PUSHER SYSTEMS AND METHODS FOR DIVIDING, PUSHING AND/OR DISPENSING ONE OR MORE RETAIL PRODUCTS

(71) Applicant: Marketing Impact Limited, Concord (CA)

(72) Inventors: Michael Vogler, Concord (CA); Joel Pollock, Concord (CA)

(73) Assignee: Marketing Impact Limited, Concord, Ontario (CA)

( * ) Notice: Subject to any disclaimer, the term of this patent is extended or adjusted under 35 U.S.C. 154(b) by 106 days.

(21) Appl. No.: 14/248,957

(22) Filed: Apr. 9, 2014

(65) Prior Publication Data

US 2014/0305889 A1 Oct. 16, 2014

Related U.S. Application Data

(60) Provisional application No. 61/811,332, filed on Apr. 12, 2013.

(51) Int. Cl.
*A47F 1/12* (2006.01)
*A47F 5/00* (2006.01)
(Continued)

(52) U.S. Cl.
CPC ..... *A47F 1/125* (2013.01); *A47F 1/12* (2013.01); *A47F 5/005* (2013.01); *A47F 5/0093* (2013.01);
(Continued)

(58) Field of Classification Search
CPC .. A47F 1/12; A47F 1/123; A47F 1/125; A47F 1/126; A47F 1/128; A47F 5/0807;
(Continued)

(56) References Cited

U.S. PATENT DOCUMENTS 4,322,006 A * 3/1982 Marschak ..... A47F 5/0823 211/126.2
4,395,955 A * 8/1983 Pfeifer ..... A47F 5/005 108/61
(Continued)

FOREIGN PATENT DOCUMENTS

FR EP 0782831 A1 * 7/1997 ..... A47F 1/126
FR 2851441 A1 * 8/2004 ..... A47F 1/125

*Primary Examiner* — Stanton L Krycinski
(74) *Attorney, Agent, or Firm* — Norris McLaughlin & Marcus, P.A.

(57) ABSTRACT

A hanging merchandising product divider and pusher system and method dispense retail products. The system and method have a first divider having a length defined between a front end and a rear end and a height defined between a top end and a bottom end, at least one second divider having a length defined between a front end and a rear end and a height defined between a top end and a bottom end, and at least one connection plate connecting at least a portion of bottom end of the first divider to at least a portion of the bottom end of the second divider. The system and method also have at least one rear support connector connecting at least a portion of the rear end of the first divider to at least a portion of the rear end of the second divider and a first pocket defined by the first and second dividers, the connection plate, the rear support connector and the front ends of the first and second dividers, wherein the first pocket is sized or configured to receive one or more first retail products. Further, the system and method have a pusher paddle movably connected to the connection plate between the first and second dividers, wherein the pusher paddle is urged towards a front-side of the hanging system such that the pusher paddle moves the one or more products towards the front-side of the hanging system when the one or more first retail products are positioned within the first pocket of the hanging system, and
(Continued)

rear mounting hangers located at a back-side of the hanging system.

19 Claims, 62 Drawing Sheets

(51) Int. Cl.
*A47F 5/08* (2006.01)
*A47F 5/10* (2006.01)

(52) U.S. Cl.
CPC ..... *A47F 5/0846* (2013.01); *A47F 5/103* (2013.01); *Y10T 29/49826* (2015.01)

(58) Field of Classification Search
CPC ..... A47F 5/0815; A47F 5/0823; A47F 5/083; A47F 5/0838; A47F 5/0846; A47F 5/0853
See application file for complete search history.

(56) References Cited

U.S. PATENT DOCUMENTS 4,762,236 A * 8/1988 Jackle, III ..... A47F 1/126 211/59.3
4,768,661 A * 9/1988 Pfeifer ..... A47F 5/005 211/184
5,240,126 A * 8/1993 Foster ..... A47F 1/126 211/175
5,505,315 A * 4/1996 Carroll ..... A47F 1/125 211/51
5,582,305 A * 12/1996 Howell, Sr. ..... A47F 5/0006 211/126.1
5,746,328 A * 5/1998 Beeler ..... A47F 5/0823 211/59.3
5,855,281 A * 1/1999 Rabas ..... A47F 5/005 211/175
6,409,027 B1 * 6/2002 Chang ..... A47F 1/126 211/184
6,715,621 B2 * 4/2004 Boron ..... A47F 1/12 211/175
7,419,062 B2 * 9/2008 Mason ..... A47F 1/126 211/59.3
7,428,972 B2 * 9/2008 Warner ..... A47F 5/0823 211/59.1
7,641,072 B1 * 1/2010 Vlastakis ..... A47F 1/126 221/123
7,954,648 B2 * 6/2011 Takashima ..... A47F 5/0846 211/59.3
8,042,700 B1 * 10/2011 Smalley ..... A47F 5/0807 211/88.01
8,113,601 B2 * 2/2012 Hardy ..... A47F 1/12 211/4
8,127,943 B2 * 3/2012 Takashima ..... A47F 1/126 211/59.3
8,132,680 B2 * 3/2012 Takashima ..... A47F 5/0025 211/59.3
8,162,158 B2 * 4/2012 Northrup, Jr. ..... A47F 5/005 211/134
8,967,394 B2 * 3/2015 Hardy ..... A47F 1/126 211/175
9,016,484 B2 * 4/2015 Kologe ..... A47F 1/125 211/59.3
2003/0057167 A1 * 3/2003 Johnson ..... A47F 1/126 211/59.3
2003/0217980 A1 * 11/2003 Johnson ..... A47F 1/126 211/59.3
2005/0189369 A1 * 9/2005 Vlastakis ..... A47F 1/126 221/123
2007/0267365 A1 * 11/2007 Saito ..... A47F 1/126 211/59.3
2008/0257842 A1 * 10/2008 Mason ..... A47F 1/126 211/133.6
2010/0059469 A1 * 3/2010 Mason ..... A47F 1/126 211/162
2010/0065523 A1 * 3/2010 Northrup, Jr. ..... A47F 5/005 211/90.02
2010/0199696 A1 * 8/2010 Nagel ..... A47F 3/0482 62/255
2012/0103922 A1 * 5/2012 Bird ..... A47F 1/126 211/59.3
2012/0228242 A1 * 9/2012 Vogler ..... A47F 1/06 211/4
2012/0255924 A1 * 10/2012 Kologe ..... A47F 1/125 211/126.15

* cited by examiner

FIG 3A
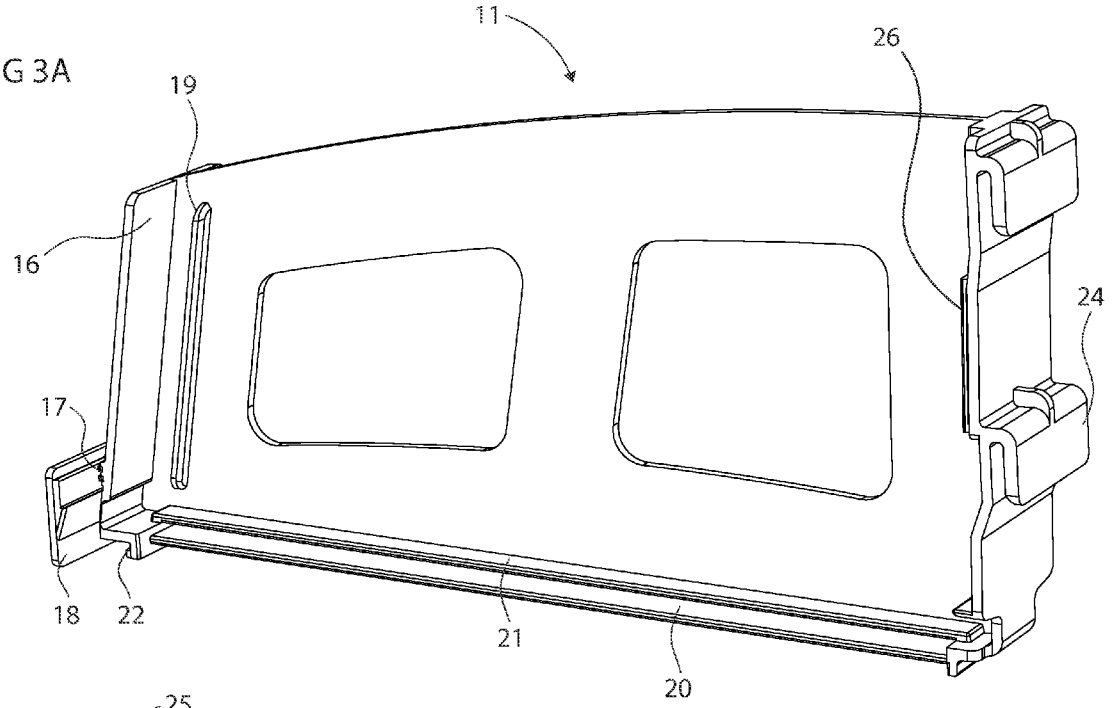
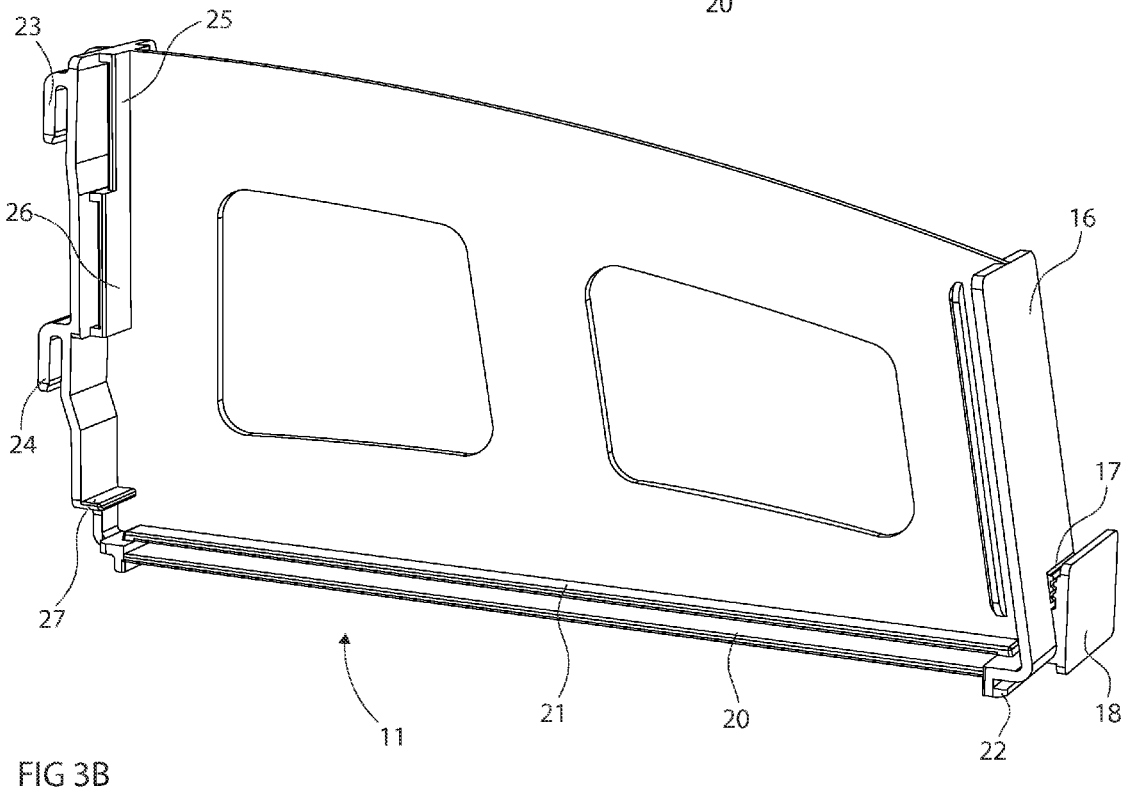
FIG 3B

HANGING PRODUCT DIVIDER AND PUSHER SYSTEMS AND METHODS FOR DIVIDING, PUSHING AND/OR DISPENSING ONE OR MORE RETAIL PRODUCTS

CROSS REFERENCE TO RELATED APPLICATION

This application claims the benefit of U.S. Provisional Patent Application No. 61/811,332, filed Apr. 12, 2013, the entirety of which is hereby incorporated by reference into this application.

FIELD OF THE DISCLOSURE

The present disclosure relates to hanging merchandising product divider and pusher systems, quick-load merchandising pusher systems, and methods for dividing, pushing and dispensing one or more retail products. The present merchandising systems and methods may be utilized in a retail environment to secure, store, display and/or dispense the one or more retail products.

SUMMARY OF THE DISCLOSURE

In embodiments, a hanging merchandising product divider and pusher system may dispense retail products. The hanging system may have a first divider having a length defined between a front end and a rear end and a height defined between a top end and a bottom end, at least one second divider having a length defined between a front end and a rear end and a height defined between a top end and a bottom end, and at least one connection plate connecting at least a portion of bottom end of the first divider to at least a portion of the bottom end of the second divider. Further, the hanging system may have at least one rear support connector connecting at least a portion of the rear end of the first divider to at least a portion of the rear end of the second divider, a first pocket defined by the first and second dividers, the connection plate, the rear support connector and the front ends of the first and second dividers, wherein the first pocket is sized or configured to receive one or more first retail products. Moreover, the hanging system may have a pusher paddle movably connected to the connection plate between the first and second dividers, wherein the pusher paddle is urged towards a front-side of the hanging system such that the pusher paddle moves the one or more products towards the front-side of the hanging system when the one or more first retail products are positioned within the first pocket of the hanging system, and rear mounting hangers located at a back-side of the hanging system, wherein the rear mounting hangers are sized or configured such that the hanging system is mountable to an upright mount cross bar, an upright, a rear mount track or a hanging mount bracket via the rear mounting hangers.

In an embodiment, the system may have a least one flip ticket component connecting the front ends of the first and second dividers, wherein flip ticket component maintains the dividers in a substantially horizontal alignment.

In an embodiment, the system may have a graphic mount positioned adjacent to the front end and the bottom end of one of the first and second dividers, wherein the flip ticket component is mountable to the graphic mount.

In an embodiment, the system may have a fence insert located between the front ends of the first and second dividers, wherein the fence insert extends upward from the bottom sides of the first and second dividers and is configured to retain the one or more first retail products within the first pocket of the hanging system.

In an embodiment, the system may have at least one second pocket sized or configured to receive one or more second retail products, wherein the first and second retail products have different shapes, sizes or configurations.

In an embodiment, the system may have a third divider connected to the first divider, wherein the second pocket is located between the first divider and the third divider.

In an embodiment, the system may have at least one third pocket sized or configured to receive one or more third retail products, wherein the first, second and third retail products have different shapes, sizes or configurations.

In an embodiment, the system may have a fourth divider connected to the third divider, wherein the third pocket is located between the third divider and the fourth divider.

In an embodiment, the system may have a product retaining fence formed along the front side of at least one of the first and second dividers, wherein the product retaining fence is sized or configured to prevent the one or more first retail products from being pushed outwardly from the front-side of the hanging system by the pusher paddle when the one or more first retail products are positioned within the first pocket of the hanging system.

In an embodiment, the product retaining fence may be is positioned at an angle with respect to the lengths of the first and second dividers.

In an embodiment, the system may have a product alignment rib provided within the first pocket sized or configured to align a first product of the one or more first retail products, located adjacent to the front-side of the hanging system, such that the first product is substantially parallel to the product retaining fence when the one or more first retail products are positioned within the first pocket of the hanging system.

In embodiments, a method may dispense retail products and may secure the hanging system to a shelf, a pegboard, a slatwall or uprights by mounting the hanging system to the shelf, the pegboard, the slatwall or the upright via the rear mounting hangers located at the rear-side of the hanging system.

In an embodiment, the method may mount the hanging system to the pegboard or slatwall via a hanging mount bracket, at least one peg clip and the rear mounting hangers.

In an embodiment, the method may mount the hanging system to the uprights via an upright mount cross bar and the rear mounting hangers.

In an embodiment, the method may mount the hanging system to the uprights via an adjustable depth crossbar and the rear mounting hangers, wherein the hanging system is movable inwardly or outwardly with respect to the uprights via the adjustable depth crossbar.

In an embodiment, the method may mount the hanging system to the shelf via a front shelf mount track, a rear mount track, a toe clip of the hanging system and a bottom rear mounting hanger of the rear mounting hangers.

In an embodiment, the method may position a first retail product in the first pocket of the hanging system.

In embodiments, a system may dispense retail products and may have a hanging system comprising a first divider having a length defined between a front end and a rear end and a height defined between a top end and a bottom end, at least one second divider having a length defined between a front end and a rear end and a height defined between a top end and a bottom end, at least one rear support connector connecting at least a portion of the rear end of the first divider to at least a portion of the rear end of the second divider, wherein the at least one rear support connector comprises a lower rear mounting hanger and an upper rear mounting hanger, wherein the lower and upper rear mounting hangers extend outwardly with respect to a back-side of the hanging system and downwardly with respect to the top ends of the dividers. The hanging system may also have a first pocket located between the first and second dividers, wherein the first pocket is sized or configured to receive one or more first retail products, and a movable pusher paddle located between the first and second dividers, wherein the pusher paddle is configured to move the one or more retail products towards a front-side of the hanging system when the one or more retail products are positioned in the first pocket of the hanging system.

In an embodiment, the system may have (i) a hanging mount bracket attached to the hanging system via the lower and upper rear mounting hangers and at least one peg clip connected to the hanging mount bracket, (ii) an upright mount crossbar attached to the hanging system via the lower and upper rear mounting hangers, (iii) a moveable adjustable depth crossbar attached to the hanging system via the lower and upper rear mounting hangers or (iv) front and rear shelf mount tracks attached to the hanging system via a toe clip and the lower rear mounting hanger.

In an embodiment, the system may have a third divider connected to the second divider such that a second pocket is formed between the second and third dividers, wherein the second pocket is sized or configured to receive at least one second retail product, wherein the one or more first retail products and the at least one second retail product have different shapes, sizes or configurations.

BACKGROUND OF THE DISCLOSURE

Pegboard hooks are a common display and/or organizational merchandising tool utilized in retail environments. The pegboard hooks are utilized to organize one or more retail products that are light weight, oddly shaped and/or small in size. These retail products are otherwise difficult to neatly merchandise on traditional shelves. The hooks suspend the retail products from cut-outs in the packaging of the retail products, and limit their (i.e., the hooks) uses to specially designed packages. There are many other disadvantages and limitations to merchandising with the pegboard hooks. For example, one disadvantage with respect to pegboard hooks is their adjustability. Typically, pegboard hole spacing is about one inch between centres and a typical hook requires two holes for mounting. As a result, the minimum distance between hook centres is about two inches. However, some slim retail products, such as, for example, tooth brushes have an average width of, for example, about one inch. Therefore, in some cases, there is a gap or distance of unusable space between adjacent retail products which, thus, limits the number of product facings which may be provide when utilizing pegboard hooks.

Peg hooks often make it difficult for a customer of the retail products to select a specific retail product hanging near the back of the hook, without disturbing, dislodging or removing other retail products which are positioned in-front of the specific retail product desired by the customer. This often results in one or more of the other retails products being removed from and/or unattached from the peg hooks by movements of the customer. As a result, one or more of the other retail products may fall from the peg hooks and/or be damaged by such fall. Often, a mounting point on the packaging of the fallen retail product(s) becomes damaged from such fall or in the process of, which makes it very difficult or completely impossible to re-merchandise the fallen and damaged retail product(s) on the peg hook(s).

Without continuous aisle facing and upkeep by the merchandiser or employees of the merchandiser, aisle sections merchandised with the peg hooks quickly become very disorganized and/or visually unappealing to the customer.

In the retail industry, it has long been know that appearance is key and very important in selling retail products. If a retail product is displayed in a clean and organize manner, it is easier for the customer to find and select the items the customer wishes to purchase. A retail store often spends a large amount of time and effort organizing, aligning and facing the retail products in order to maintain a clean visual presence and/or appearance. One merchandising solution that retailers have employed to cleanly display the retail products are pusher systems. The pusher system are spring loaded merchandising components, often affixed to store shelves, used to push products forward as customers removes the products at the front of the pusher system. One drawback to these pusher systems is that they require added vertical space between shelves in order to incorporate the on-shelf components as well as space needed to lift a product up and over a retaining fence. This need for extra vertical space can sometimes limit the number of shelves capable to fit into a specific store section which, in turn, reduces retail product holding power of the retailers. For store employees, loading the pusher tracks can often been time consuming and cumbersome as one hand is required to hold back the product already in the pusher system while the other hand is required to load new retail products into the pusher system.

The merchandising systems and methods set forth in the present disclosure divide, push, secure, store, display and dispense retail products in such a manner that effectively prevents the retail products from falling and being damaged while also maintaining organization of the retail products and keeping the aisle sections visually appealing to customers. Moreover, the systems and methods set forth in the present disclosure provide a quick-load pusher system which maintains the retail products in clean and organized manner and/or appearance and allows quick and easier loading of the retail products into the pusher system.

SUMMARY OF THE DISCLOSURE

In embodiments, a quick-load merchandising product pusher system for dispensing retail products is provided. The pusher system may have a fixed portion having a front end, a rear end located opposite with respect to the front end of the fixed portion, a top side and a bottom side located opposite with respect to the top side of the fixed portion, wherein ramps are provided on the top side of the fixed portion, extend outwardly with respect to the top side of the fixed portion, and are located adjacent to the front end of the fixed portion and a movable track movably connected to the top side of the fixed portion, wherein the movable track has a front end, a rear end located opposite with respect to the front end of the movable track, a top side and a bottom side located opposite with respect to the top side of the movable track, wherein one or more track stoppers are provided on the bottom side of the movable track, extend outward with respect to the bottom side of the movable track and are located adjacent to the rear end of the pusher system. The pusher system may have a pusher paddle connected to the top side of the movable track, wherein the pusher paddle, the front end of the movable track and the top side of the movable track define a first area that is sized or configured to receive one or more retail products, wherein the pusher paddle is configured to move one or more retail product forward away from the rear side of the movable track and front retainer teeth connecting the fixed portion and the movable track, wherein the front retainer teeth are provided on the top side and at the front end of the fixed portion and extend outwardly with respect to the top side of the fixed portion. The movable track may be movable to a closed position or to an extended position, wherein, when the movable track is located in the closed position, the rear end and the one or more track stoppers of the movable track are located adjacent to the rear end of the fixed portion and, when the movable track is located in the extended portion, the rear end and the one or more track stoppers of the movable track are located adjacent to the ramps of the fixed portion and the front retainer teeth abuts a portion of the pusher paddle and restricts forward movement of the pusher paddle as the movable track is moved to the extended position.

In an embodiment, when the movable track is located in the extended position, the one or more track stoppers of the movable track may abut the ramps of the fixed portion and forward movement of the movable track is restricted via the one or more track stoppers of the movable track and the ramps of the fixed portion.

In an embodiment, when the movable track is located in the extended position, the pusher paddle, the front side of the movable track and the top side of the movable track may define a second area that is sized or configured to receive one or more retail products, wherein the second area is larger than the first area.

In an embodiment, the pusher system may have a first mount provided at the rear end of the fixed portion and configured to mount the fixed portion to retail merchandising aisle uprights.

In an embodiment, the first mount may have one or more hooks, one or more pegs, a horizontal flange or a vertical flange.

In an embodiment, the pusher system may have a front plate connected to the front end of the movable track, wherein, when one or more retail products are positioned within the pusher system, the one or more retail products are located between the front plate and the pusher paddle.

In an embodiment, the pusher system may have loading lock tabs connected to the ramps of the fixed portion, wherein the loading lock tabs extend outwardly away from the top side of the fixed portion, and loading lock ramps provided on the bottom side of the movable track and located between the one or more track stoppers and the front side of the movable track, wherein the loading locks tabs abut the loading lock ramps when the movable track is positioned in the extended position.

In an embodiment, the pusher system may have dividers connected to both right and left sides of the movable track, wherein the dividers extend outwardly away from the right and left sides of the movable track and away from the top side of the movable track.

In an embodiment, the dividers may be wire dividers or molded dividers.

In an embodiment, one or more holes may be formed through the molded dividers along a length of the molded dividers.

In an embodiment, the pusher system may have a modular baffle connected to a bottom side of the fixed portion, wherein the modular extends outwardly away from right and left sides of the fixed portion.

In an embodiment, the pusher system may have a retail product position in the first area defined between the pusher paddle and the front and top sides of the movable track.

In embodiments, a method for producing a quick-load retail merchandising product pusher system may dispense retail products. The method may movable connect a movable track to a fixed portion via front retaining teeth of the fixed portion, wherein the fixed portion has a front end, a rear end located opposite with respect to the front end of the fixed portion, a top side and a bottom side located opposite with respect to the top side of the fixed portion, wherein the movable track has a front end, a rear end located opposite with respect to the front end of the movable track, a top side and a bottom side located opposite with respect to the top side of the movable track, wherein the front retainer teeth are provided on the top side and at the front end of the fixed portion and extend outwardly with respect to the top side of the fixed portion. Further, the method may connect a pusher paddle to the top side of the movable track, wherein the pusher paddle, the front end of the movable track and the top side of the movable track define a first area that is sized or configured to receive one or more retail products, wherein the pusher paddle is configured to move one or more retail product forward away from the rear side of the movable track. The movable track may be movable to a closed position or to an extended position, wherein, when the movable track is located in the closed position, the rear end of the movable track is located adjacent to the rear end of the fixed portion and, when the movable track is located in the extended portion, the rear end of the movable track is located adjacent to the front side of the fixed portion and forward movement of the pusher paddle is restricted by the front retainer teeth of the fixed portion as the movable track moves to the extended position.

In an embodiment, the method may form ramps on the top side of the fixed portion that extend outwardly with respect to the top side of the fixed portion and are located adjacent to the front end of the fixed portion, and form one or more track stoppers on the bottom side of the movable track that extend outward with respect to the bottom side of the movable track and are located adjacent to the rear end of the pusher system, wherein, when the movable track is located in the extended position, the one or more track stoppers of the movable track abut the ramps of the fixed portion and forward movement of the movable track is restricted via the one or more track stoppers of the movable track and the ramps of the fixed portion.

In an embodiment, the method may connect at least one divider to a right or left side of the fixed portion, wherein the at least one divider extends outwardly away from the fixed portion and away from the top side of the fixed portion.

In an embodiment, the method may move the movable track to the closed position or the opened position.

In embodiments, a retail merchandising gondola section may dispense retail products. The gondola section may have retail merchandising aisle uprights and the pusher system mounted to the aisle uprights via the first mount of the pusher system.

In an embodiment, the gondola section may have a second mount connected to the retail merchandising aisle uprights for connecting the first mount of the pusher system to the retail merchandising aisle uprights, wherein the second mount comprises a retail merchandizing shelf, a retail merchandizing crossbar or a retail merchandising peg board.

In an embodiment, the gondola section may have a fastener for connecting the first mount of the pusher system to the second mount of the gondola section, wherein the fastener is a horizontal lip shelf extrusion or a vertical lip shelf extrusion.

In an embodiment, the gondola section may have at least one retail product position within pusher system.

BRIEF DESCRIPTION OF THE DRAWINGS

So that the features and advantages of the present disclosure can be understood in detail, a more particular description of the merchandising systems and methods may be had by reference to the embodiments thereof that are illustrated in the appended drawings. It is to be noted, however, that the appended drawings illustrate only some embodiments of the present systems and methods and are therefore not to be considered limiting of its scope, for the merchandising systems and methods may admit to other equally effective embodiments.

FIG. 3A illustrates a first side perspective view of a first divider component in an embodiment; and FIG. 3B illustrates a second side perspective view of the first divider component shown in FIG. 3A in an embodiment.

DETAILED DESCRIPTION OF THE DISCLOSURE

Figure 1:
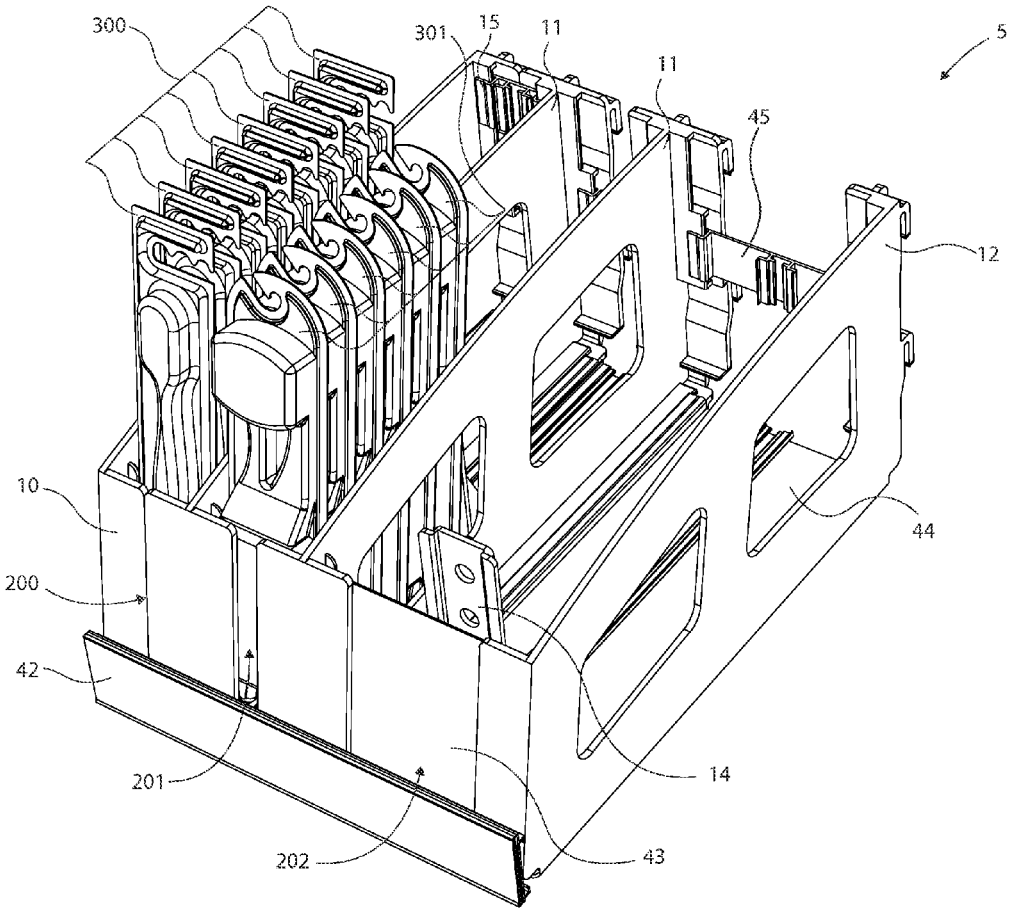
FIG. 1 illustrates a perspective view of a divider and pusher system for more than one retail product in an embodiment.

The present disclosure sets forth product divider and pusher systems, quick-load pusher systems and methods for dividing, pushing, securing, storing, displaying and/or dispensing one or more retail products. Referring now to the drawings wherein like numerals refer to like parts, the present divider and pusher systems and methods may provide at least divider and pusher system 5 (hereinafter "divider system 5") as shown in FIG. 1, configured to divide, push, secure store, display and dispense at least one or more first retail products 300 (hereinafter "first products 300") and/or one or more second retail products 301 (hereinafter "second products 301"). The first products 300 and/or the second products 301 (collectively known hereinafter as "first and second products 300, 301") may comprise or include, for example, consumer products, food products, hard goods, durable goods, soft goods, consumables, consumer-grade goods, professional-grade goods and/or the like. In an embodiment, the first and second products 300, 301 may be at least one or more over-the-counter retail products (hereinafter "OTC products"). The OTC products may be analgesics, medications, pharmaceuticals, razors, razor blades, camera film, batteries, videos, DVDs, smoking cessation products, infant formula, vitamins, personal care products, home care products, toothbrushes, foodstuffs, packaged foods, kitchen supplies, bags, boxes, containers and/or the like. In an embodiment, the first products 300 may be, for example, one or more single tooth brush packages, and the second products 301 may be, for example, one or more double tooth brush packages. Moreover, the first and second products 300, 301 that may be utilized with the present systems and methods may be any retail products known to one of ordinary skill in the art that are configured, adapted and/or sized to be located, stored and/or positioned within the divider system 5.

Figure 10A:
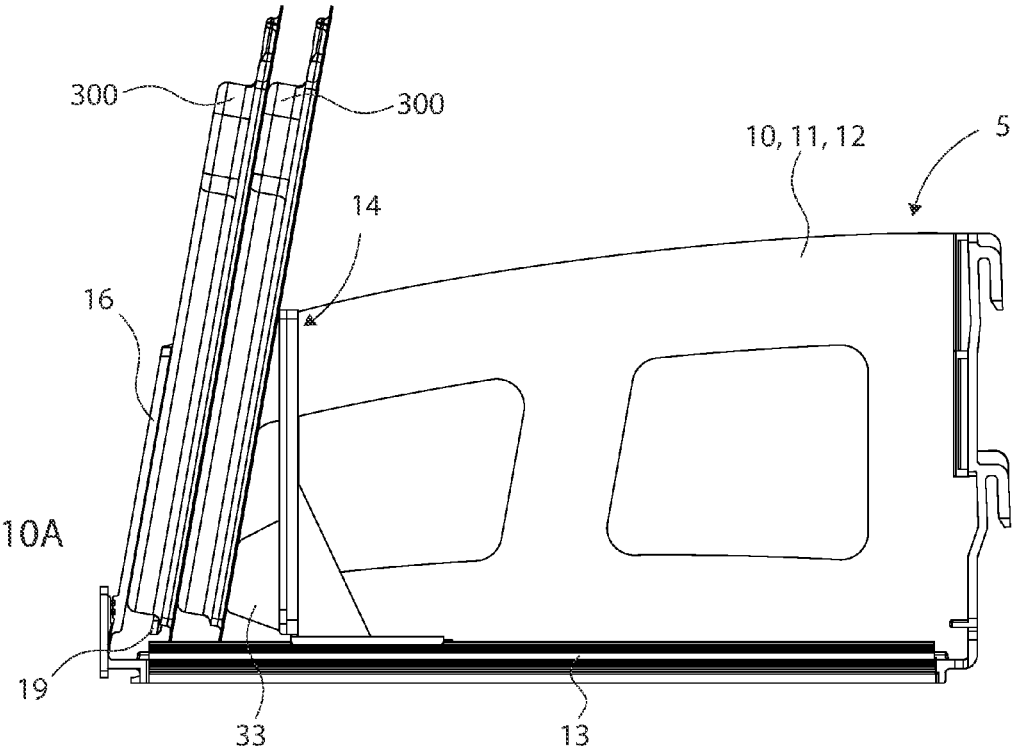
FIG. 10A illustrates a side view of a divider and pusher system having more than one retail product in an embodiment.
Figure 10B:
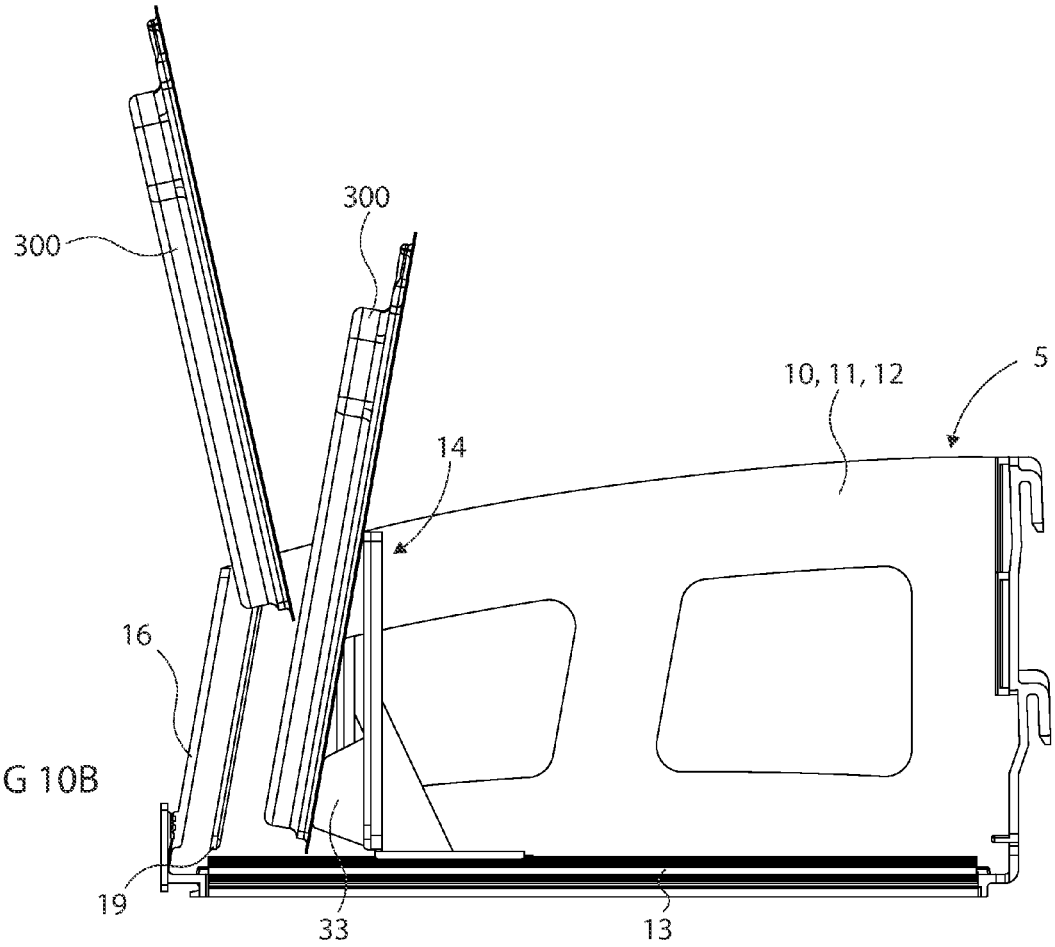
FIG. 10B illustrates a side view of a divider and pusher system having more than one retail product with at least one retail product being dispensed from the system in an embodiment.

The first and second products 300, 301 may be located or stored within and/or positioned inside the divider system 5 (as shown in FIGS. 1, 10A, 10B, 13A and 13B) which may be located inside, for example, a marketplace and/or a retail establishment. The marketplace and/or the retail establishment may be, for example, a chain store, a department store, a discount store, a grocery store, a hardware store, a health food store, a liquor store, a warehouse store, a variety store, a specialty store, a general store, a convenience store, a toy store, a pet store, an outlet store, a supermarket, a mall and/or the like. In embodiments, the divider system 5 may be associated with and/or incorporated into, for example, a vending machine, a portable sales device, a point of sale terminal and/or an automated retail store. The first and second products 300, 301 may be accessible singly or one at a time through a front-side of the divider system 5 (as shown in FIG. 10B). In embodiments, the first and second products 300, 301 may be accessible in combination or more than one at a time through the front-side of the divider system 5. The first and second products 300, 301 which may be utilized with the divider system 5 may be a same type of retail products, different types of retail products and/or a combination of same and different types of retail products. In embodiments, the first and second products 300, 301 may have different sizes of packaging and/or different shapes of packaging. The present disclosure should not be deemed as limited to a specific embodiment of the marketplace and/or the retail establishment wherein the divider system 5 may be located, included and/or incorporated.

Figure 2:
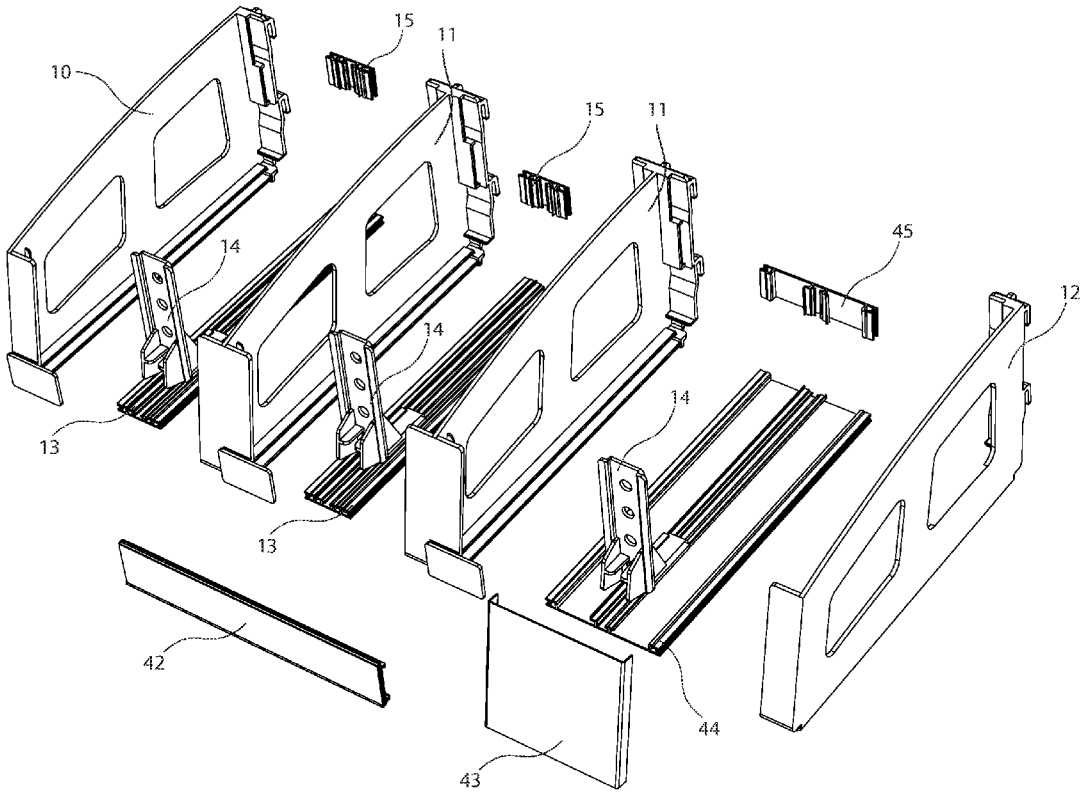
FIG. 2 illustrates an exploded perspective view of a divider and pusher system in an embodiment.
Figure 4A:
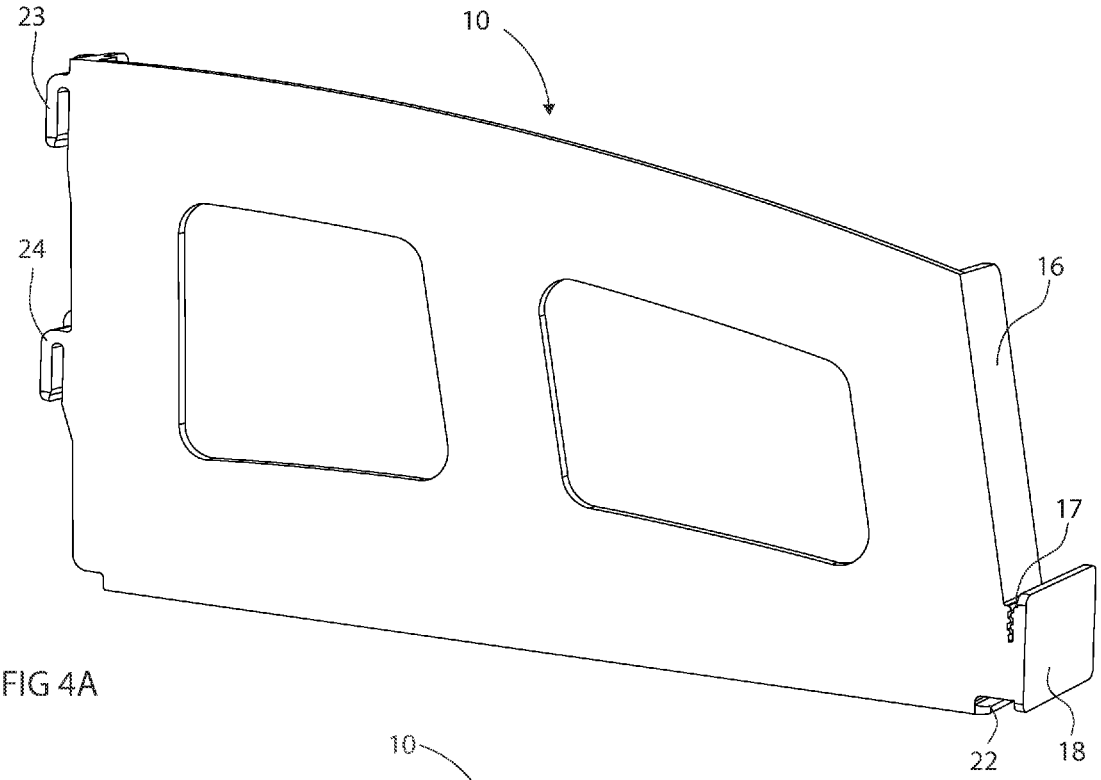
FIG. 4A illustrates a first side perspective view of a second divider component in an embodiment.
Figure 5A:
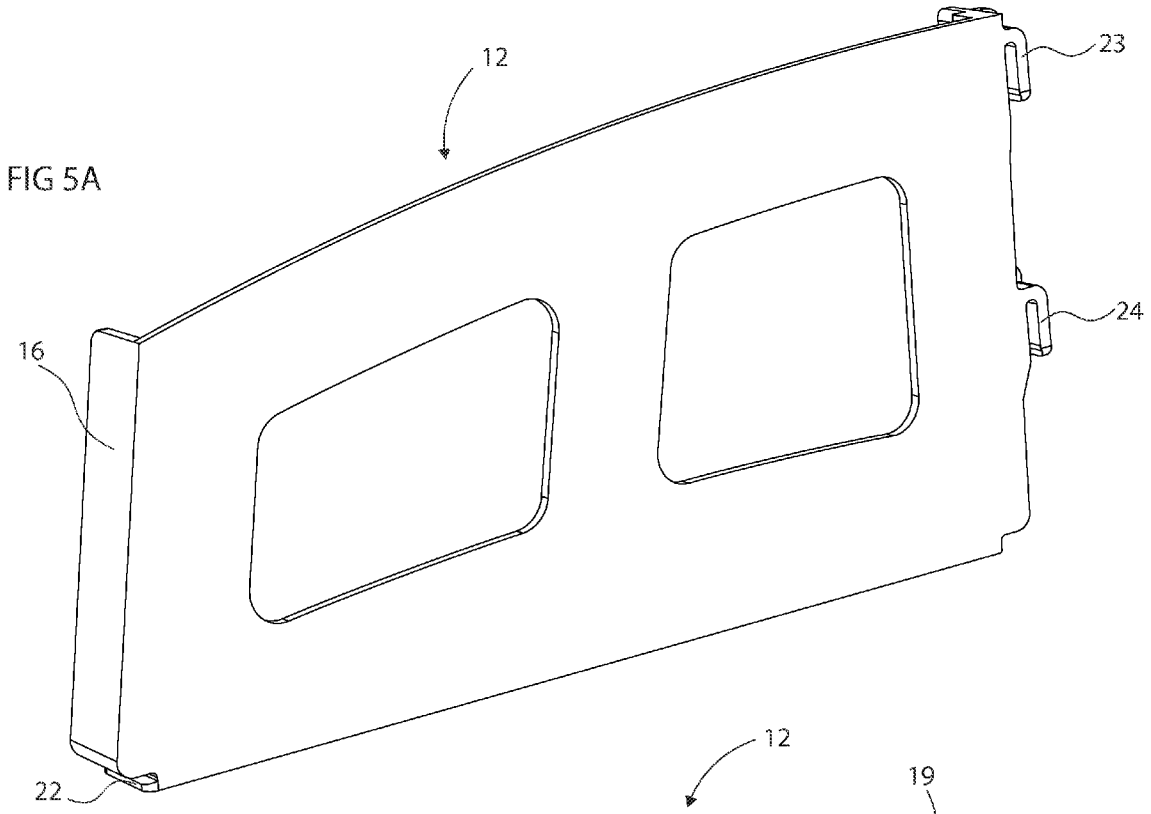
FIG. 5A illustrates a first side perspective view of a third divider component in an embodiment.

FIGS. 1 and 2 show the divider system 5, in an embodiment, which may have one or more centre or first divider 11 (hereinafter "first divider"), at least one left or second divider 10 (hereinafter "second divider 10") and at least one right or third divider 12 (hereinafter "third divider 12"). The divider system 5 may also have one or more first connection plates 13 (hereinafter "first connection plates 13"), one or more second connection plates 44 (hereinafter "second connection plates 44"), one or more pusher paddles 14 (hereinafter "pusher paddles 14"), one or more first rear support connectors 15 (hereinafter "first connectors 15"), one or more second rear support connectors 45 (hereinafter "second connectors 45"), one or more flip ticket components 42 (hereinafter "flip components 42") and/or one or more fence inserts 43 (hereinafter "fence inserts 43"). The flip ticket component 42 may mount to a graphic mount 18 on adjacent dividers 10, 11, 12 and may be configured to maintain or substantial maintain the dividers 10, 11, 12 in horizontal or substantially horizontal alignment, as shown in FIGS. 3A, 4A and 5A. The fence insert 43 may be sized and/or configured to retain the first and second products 300, 301, when the first and second products 300, 301 may be larger packages, and utilized with the second connection plate 44 and the rear support connector 45. The second connector 45 of the second connection plate 44 may be sized and/or configured to connect, attach, secure and/or fasten an upper section or portion of the dividers 10, 11, 12 to one another.

Figure 12:
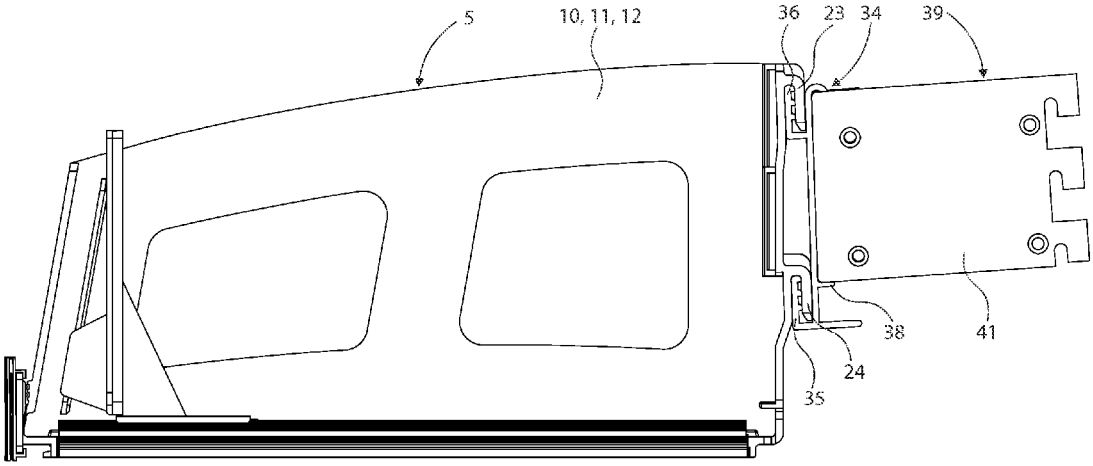
FIG. 12 illustrates a side plan view of a divider component mounted to an upright mount cross bar in an embodiment.
Figure 13A:
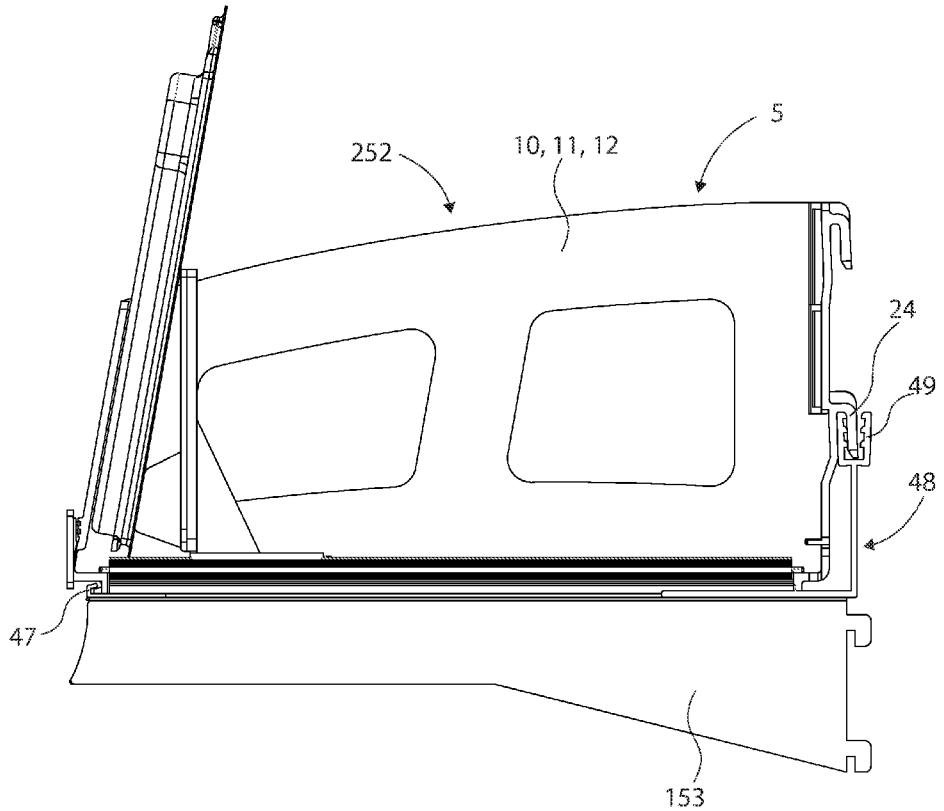
FIG. 13A illustrates a side view of a divider and pusher system, having at least one retail product, mounted to a base in an embodiment.
Figure 13B:
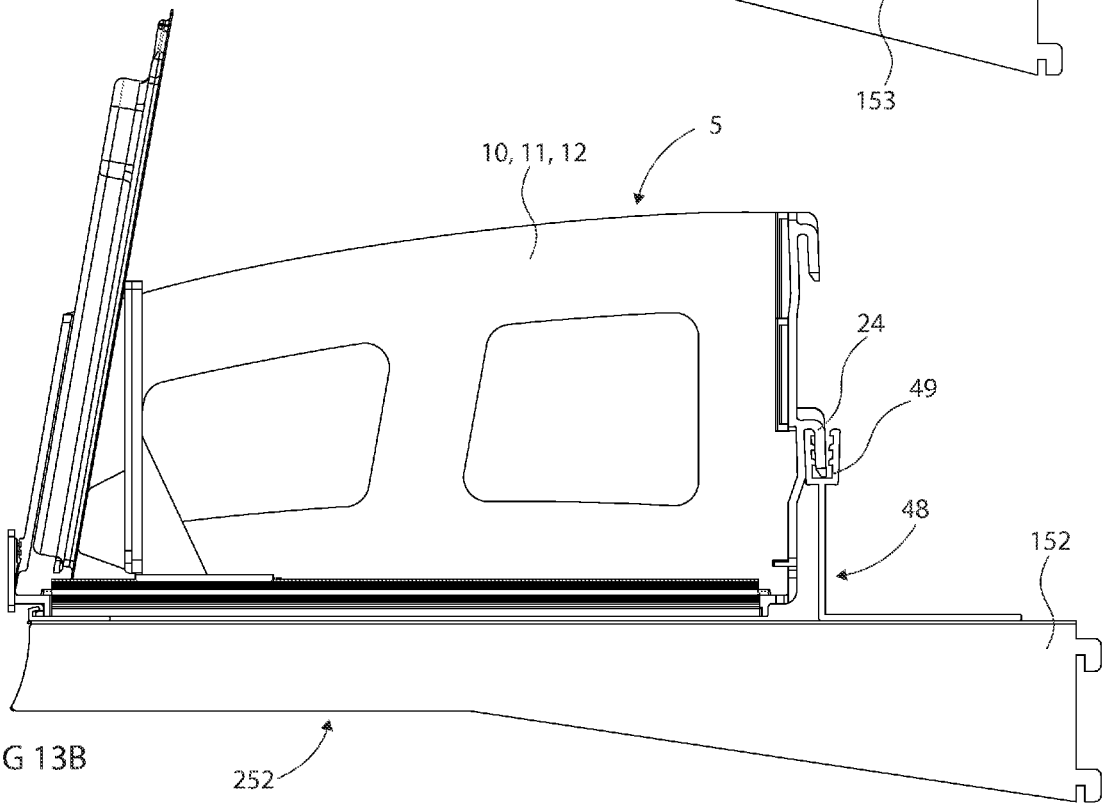
FIG. 13B illustrates a side view of a divider and pusher system, having at least one retail product, mounted to an extended base in an embodiment.
Figure 14:
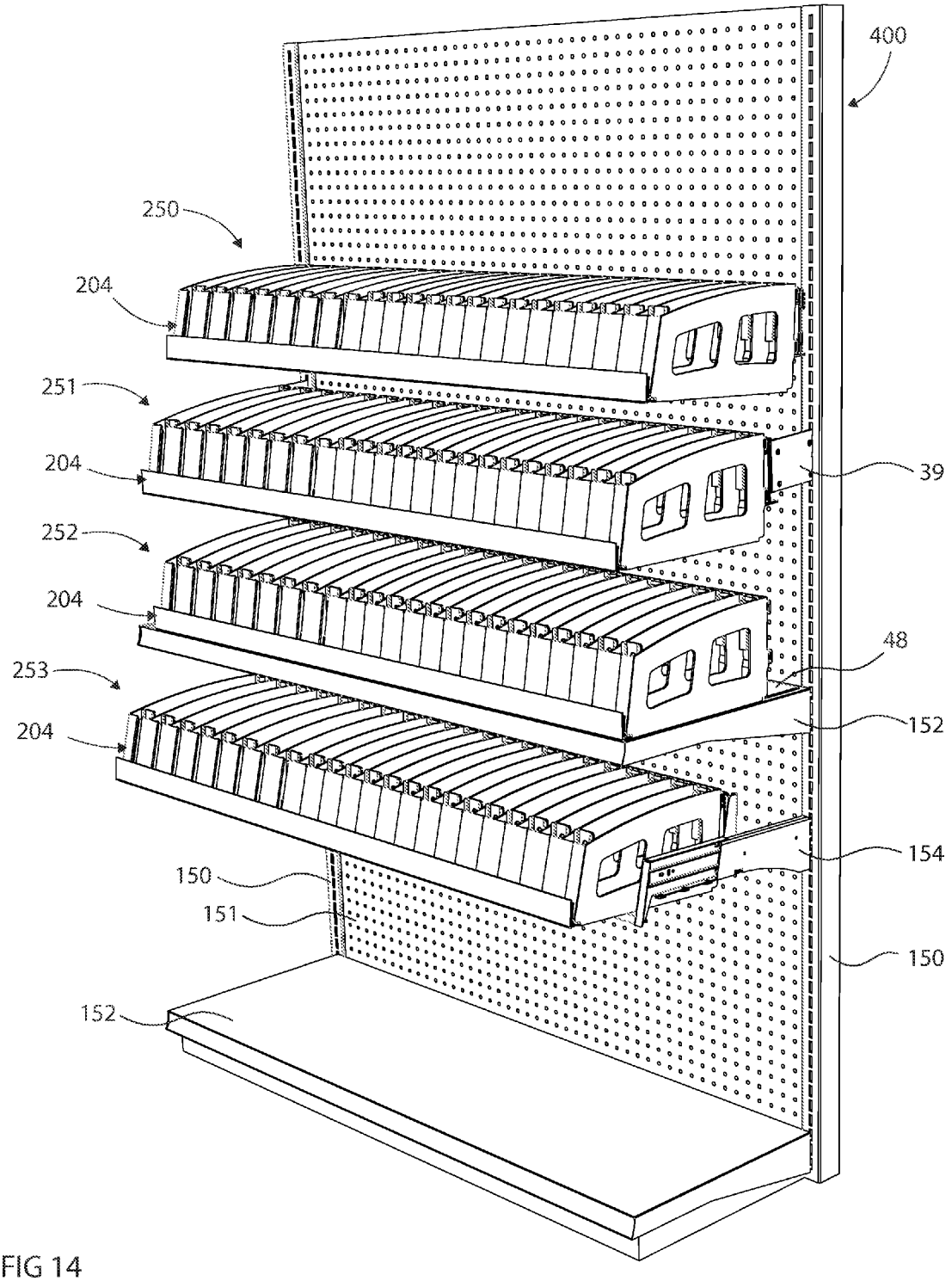
FIG. 14 illustrates a perspective view of divider and pusher systems mounted to uprights in an embodiment.
Figure 15:
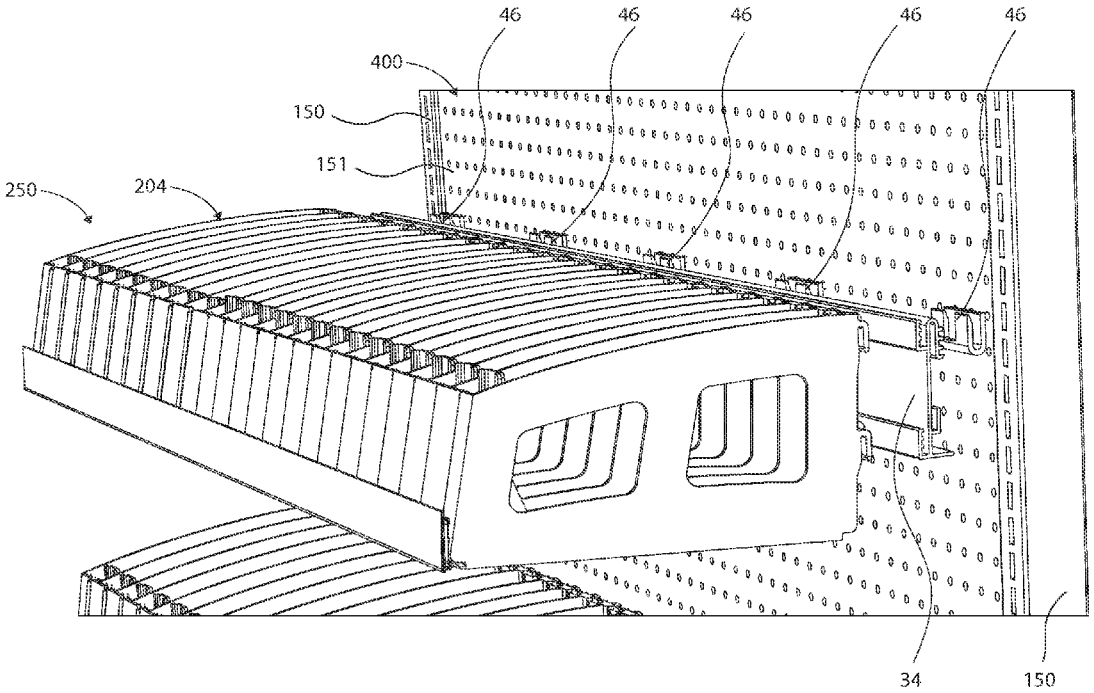
FIG. 15 illustrates a perspective view of at least one divider and pusher system mountable to a peg board in an embodiment.
Figure 16:
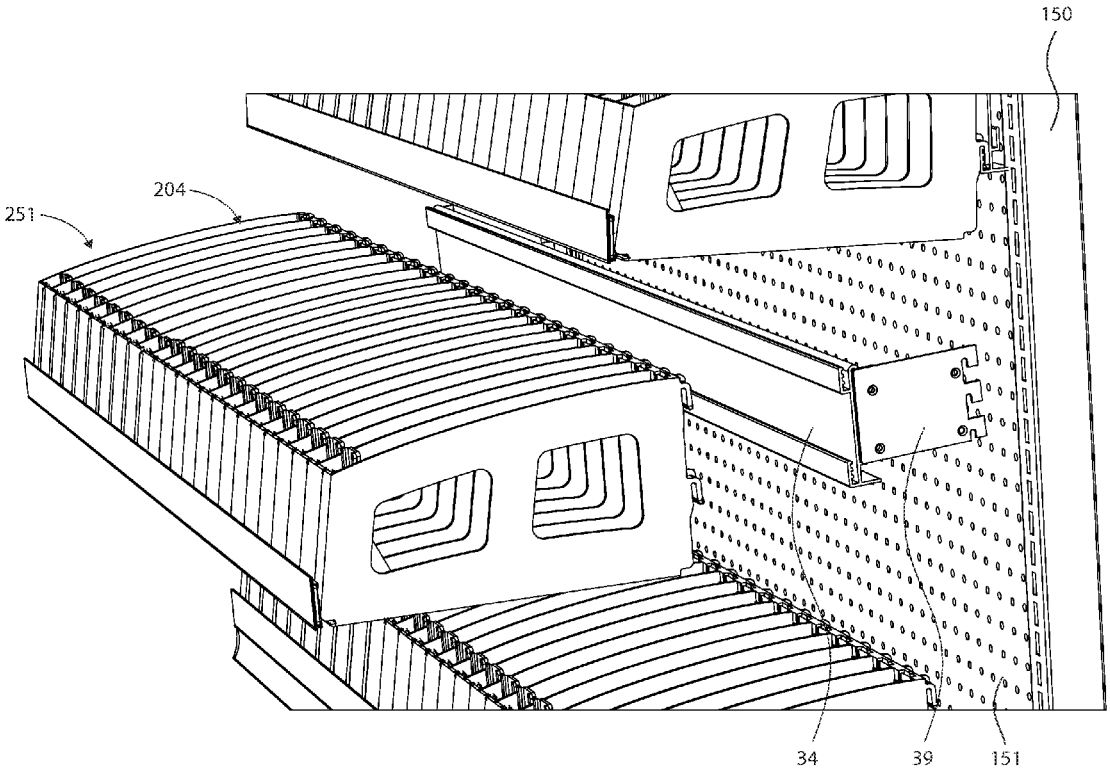
FIG. 16 illustrates a perspective view of more than one divider and pusher system mountable to uprights via an upright mount crossbar in an embodiment.
Figure 17:
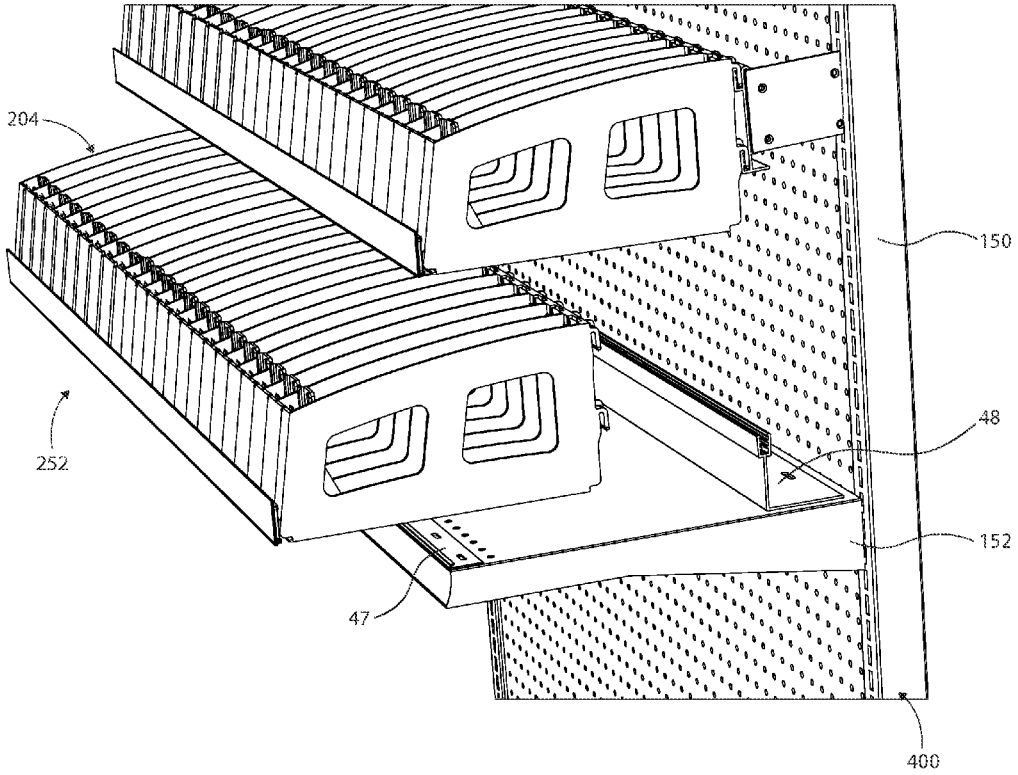
FIG. 17 illustrates a perspective view of more than one divider and pusher system mountable to a base or shelf in an embodiment.

The first divider 11, the second divider 10 and/or the third divider 12 (collectively known hereinafter as "dividers 10, 11, 12") may be connected, attached and/or fastened to each other via one or more of the first connection plates 13, the second connection plates 44, the push paddles 14, the first connectors 15, the second connectors 45, the flip components 42 and/or the fence inserts 43. The dividers 10, 11, 12, the first connection plates 13, the second connection plates 44, the push paddles 14, the first connectors 15, the second connectors 45, the flip components 42 and/or the fence inserts 43 may be assembled to form and/or produce the divider system 5 as shown in FIG. 1. In an embodiment, one or more divider systems 5 may be connected, attached, fastened and/or mounted to at least one or more cross bars 39 (as shown in FIG. 12), one or more uprights 150 (as shown in FIG. 14), one or more boards 151 (as shown in FIG. 15), one or more brackets 34 (as shown in FIG. 16), one or more first tracks 47, one or more second tracks 48, one or more first shelves 152 and/or one or more second shelves 153 (as shown in FIGS. 13A, 13B and 17).

In embodiments, the upright 150 may be an aisle upright commonly found in retail environments and used for mounting merchandising fixtures and retail shelving. The board 151 may be a pegboard or slat-wall paneling commonly found in retail environments and used for mounting merchandising fixtures. In embodiments, the first shelf 152 may be a sixteen inch shelf as a base for mounting merchandising components, and the second shelf 153 may be a twelve inch shelf as a base for mounting merchandising components. It should be understood that the present disclosure should not be deemed as limited to a specific embodiment of upright 150, the board 151, the first shelf 152 and/or the second shelf 153.

In an embodiment, the first connectors 15 and/or the second connectors 45 may be located and/or positioned between the dividers 10, 11, 12 at a rear-side of the divider system 5. As a result, each of the dividers 10, 11, 12 may be connected, attached and/or fastened to each other via the first connectors 15 and/or the second connectors 45 to form the divider system 5. The first connection plates 13 and/or the second connection plates 44 may be located and/or positioned between the dividers 10, 11, 12 along, for example, a length of the dividers 10, 11, 12. As a result, the dividers 10, 11, 12 may be connected, attached and/or fastened to each other via the first connection plates 13 and/or the second connection plates 44. The flip components 42 and/or the fence inserts 43 may be located and/or positioned between the dividers 10, 11, 12 at the front-side of the divider system 5. As a result, the dividers 10, 11, 12 may be connected, attached and/or fastened to each other via the flip components 42 and/or the fence inserts 43.

The divider system 5 may be sized and/or configured to receive, store, house, protect, enclose and/or secure the first and second products 300, 301. The divider system 5 may be sized and/or configured to divide, push and/or dispense the first and second products 300, 301 from the front-side of the divider system 5. As a result, a customer and/or consumer of the first and second products 300, 301 may remove at least one of the first and second products 300, 301 from the divider system 5 via the front-side of the divider system 5.

As shown in FIG. 1, the divider system 5 provides one or more pockets for receiving, storing, housing and securing the first and second products 300, 301. In an embodiment, the divider system 5 provides or forms and/or is configured to have a first pocket 200, a second pocket 201 and/or a third pocket 202 (collectively known hereinafter as "pockets 200, 201, 202"). The pockets 200, 201, 202 may be sized and/or configured such that each pocket has a different length, width and/or height. In an embodiment, the pockets 200, 201, 202 may have similar, same or substantially same lengths, widths and/or heights. In an embodiment, the first pocket 200 may be sized and/or configured to receive, store, house, enclose and/or secure the first products 300, and the second pocket 201 may be sized and/or configured to receive, store, house, enclose and/or secure the second products 301. The pockets 200, 201, 202 may be sized and/or configured to receive, store, house, enclosure and/or secure one or more of the first and second products 300, 301. In a minimum configuration, the divider system 5 may have the second divider 10 and the third divider 12 with the first connection plate 13 and/or the connection plate 44, and the first connector 15 and/or the second connectors 45 to create, form and/or provide a single pocket divider which may be combined with and/or utilized in conjunction with one or more additional single pocket units (not shown in drawings). FIG. 2 shows an exploded perspective view of the components of the divider system 5 which may be modular and/or adjustable to form the divider system 5.

FIGS. 3A and 3B show left and right views of the centre or first divider 11 along with features and connection points of the first divider 11. In embodiments, the first divider 11 may have a product retaining fence 16, a graphic holder 17, a graphic mount 18, a product alignment rib 19, a first track connection mount 20, a second track connection mount 21, a toe clip 22, an upper rear mounting hanger 23, a lower rear mounting hanger 24, a first rear support track connection mount 25, a second rear support track connection mount 26 and/or a paddle retainer 27. In an embodiment, the first divider 11 may be made of a plastic and/or may be moulded and/or extruded. In embodiments, the plastic may or may not be a clear plastic and/or may be polycarbonate, crystal styrene and/or polyethylene.

The product retaining fence 16 may be sized and/or configured to hold the first and second products 300, 301 inside of the divider system 5 and/or to prevent the first and second products 300, 301 from being pushed outward from the front-side of the divider system 5 via the pusher paddle. In an embodiment, the product retaining fence 16 may be made from a clear plastic such that the first and second products 300, 301 may be viewed and/or visible at and/or from the front-side of the divider system 5. In an embodiment, the product retaining fence 16 may be angled by one or more degrees, such as, for example, about 5 degrees, about 10 degrees or about 15 degrees. When the product retaining fence 16 may be angled and used in conjunction with a product angler 33 on the pusher paddle 14 (as shown in FIG. 7C), the product retaining fence 16 may hold the first and second products 300, 301 at an angle of one or more degrees to improve product dispensing and tracking of the first and second products 300, 301 as the first and second products 300, 301 may slide within the divider system 5 and/or may be pushed towards the front-side of the divider system 5 via the pusher paddles 14. As a result, the product retaining fence 16 may angle the first and second products 300, 301 at an angle that is the same as or substantially similar to the angle of the product retaining fence 16. By holding the first and second products 300, 301 at an angle, the first and second products may be easily accessed and/or removed from the divider system 5 by one or more customers and/or consumers of the first and second products 300, 301.

The graphic holder 17 may be sized and/or configured to hold, display and/or retain a ticket or card which may have, for example, indicia printed thereon. The indicia of the ticket or card may, for example, be indicative of the at least one of the first and second products 300, 301 which may be dispensed from the divider system 5. The product alignment rib 19 may be sized and/or configured to align a first product of the first and second products 300, 301, located adjacent to the front-side of the divider system 5, such that the first product may be parallel or substantially parallel to the product retaining fence 16.

The first track connection mount 20 may be sized larger than the second track connection mount 21. The first connection plate 13 and/or the second connection plate 44 may be connected, attached, fastened and/or mounted between the first track connection mount 20 and the second track connection mount 21. A top surface of the first connection plate 13 and/or the second connection plate 44 may be sized and/or configured hold, support and/or receive the first and second products 300, 301. The top surface may be sized large enough to hold support and/or receive small width products and/or medium width products.

The toe clip 22 may be sized and/or configured for shelf connect, attaching, fastening and/or mounting the divider system 5 to, for example the first shelf 152 or the second shelf 153. In an embodiment, the toe clip 22 may be sized and/or configured to fit or be inserted into the front shelf mount track 47 which may be located and/or positioned on the first shelf 152 and/or the second shelf 153. The upper rear mounting hanger 23 and/or the lower rear mounting hanger 24 may be sized and/or configured to connect, attach, fasten and/or mount the divider system 5 to, for example, the upright mount cross bar 39, the upright 150, the rear mount track 48 and/or the hanging mount bracket 34.

The first rear support track connection mount 25 may be sized smaller than the second rear support track connection mount 26. In an embodiment, the first rear support track connector mount 25 and/or the second rear support track connection mount 26 may be sized and/or configured to provide an even spacing and support for the first and second products 300, 301 when the first connector plate 13 and/or the second connector plate 44 may be connected to the first rear support track connection mount 25 and/or the second rear support track connection mount 26. The paddle retainer 27 may be sized and/or configured to stop and/or prevent the pusher paddle 14 from ejecting and/or moving outward with respect to the backside of the first connector plate 13.

Figure 4B:
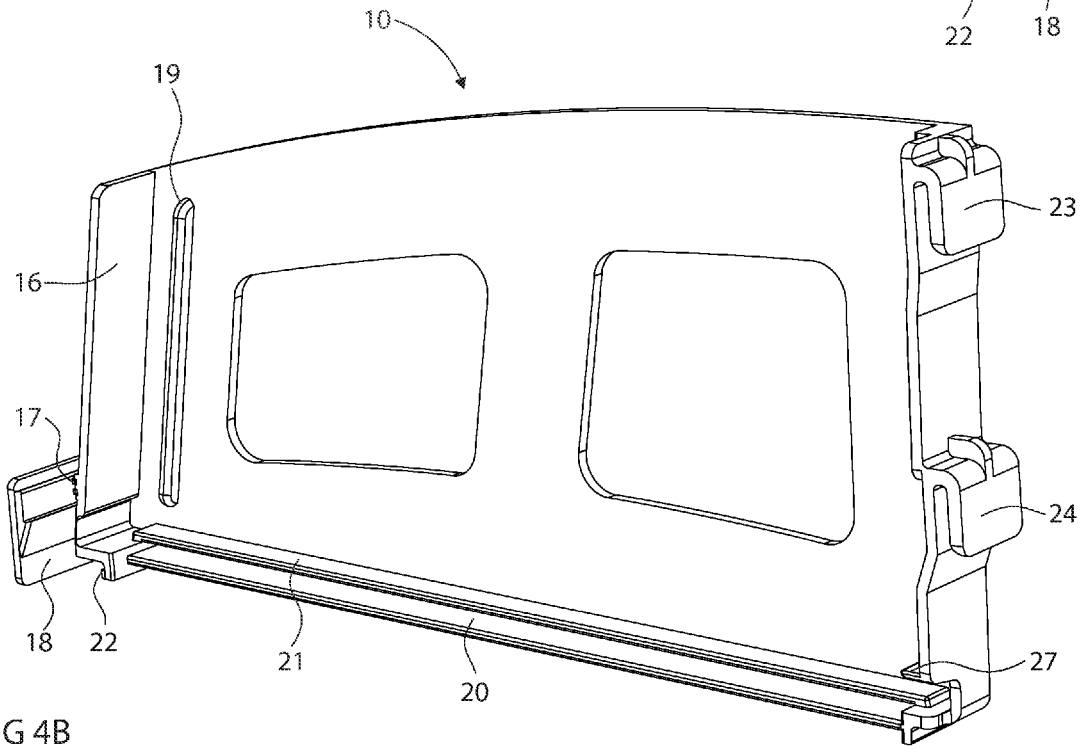
FIG. 4B illustrates a second side perspective view of the second divider component as shown in FIG. 4A in an embodiment.

FIGS. 4A and 4B show left and right views of the second divider 10 along with features and connection points of the second divider 10. One or more of the features and/or connection points of the second divider 10 may be same as, substantially same as or similar to the features and connection points of the first divider 11, except the second divider 10 may have a flat surface on a left side of the second divider 10. The features and connection points of the second divider 10 may provide a same or similar functionality as provided by the features and connection points of the first divider 11. In an embodiment, the second divider 10 may also have the product retaining fence 16, the graphic holder 17, the graphic mount 18, the product alignment rib 19, the first track connection mount 20, the second track connection mount 21, the toe clip 22, the upper rear mounting hanger 23, the lower rear mounting hanger 24, the first rear support track connection mount 25, the second rear support track connection mount 26 and/or the paddle retainer 27. In an embodiment, the second divider 10 may be made of a plastic and/or may be moulded and/or extruded. In embodiments, the plastic of the second divider 10 may or may not be a clear plastic and/or may be polycarbonate, crystal styrene and/or polyethylene.

Figure 5B:
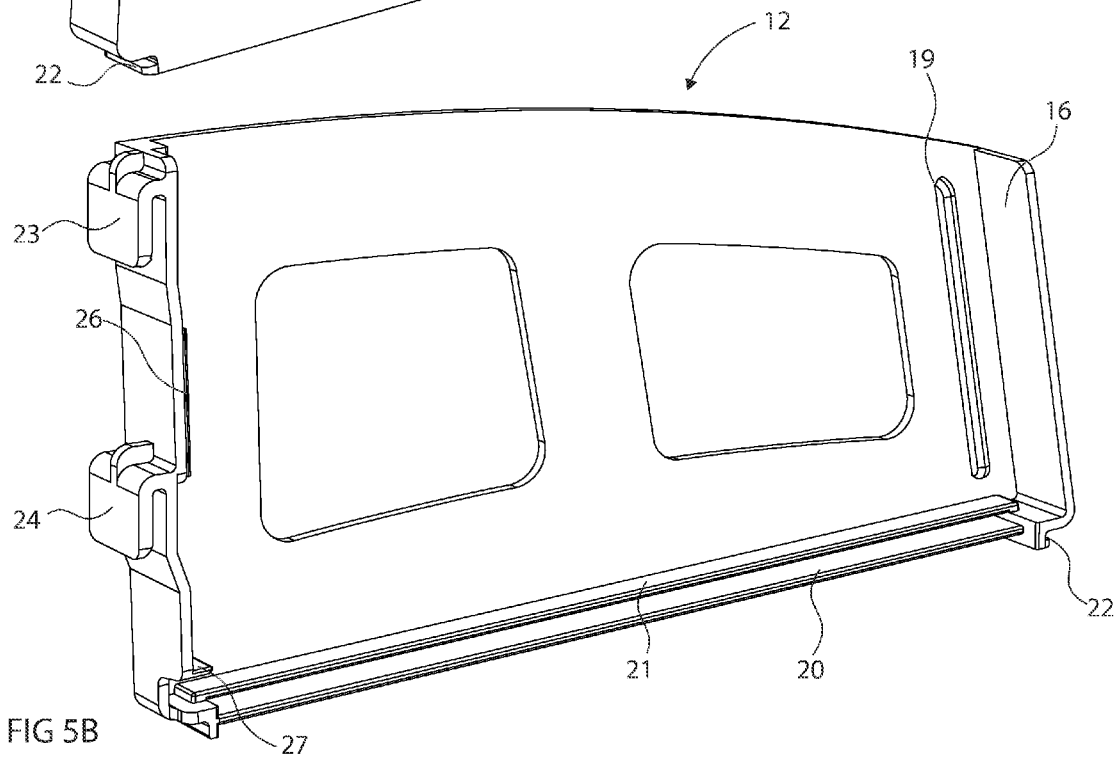
FIG. 5B illustrates a second side perspective view of the third divider component as shown in FIG. 5A in an embodiment.

FIGS. 5A and 5B show left and right views of the third divider 12 and along with features and connection points of the third divider 12. One or more of the features and/or connection points of the third divider 12 may be same as, substantially same as or similar to the features and connection points of the first divider 11, except the third divider 12 may have a flat surface on a right side of the third divider 12 and/or may exclude the ticket plate 18. The features and connection points of the third divider 12 may provide a same or similar functionality as provided by the features and connection points of the first divider 11. In an embodiment, the third divider 12 may also have the product retaining fence 16, the graphic holder 17, the graphic mount 18, the product alignment rib 19, the first track connection mount 20, the second track connection mount 21, the toe clip 22, the upper rear mounting hanger 23, the lower rear mounting hanger 24, the first rear support track connection mount 25, the second rear support track connection mount 26 and/or the paddle retainer 27. In an embodiment, the third divider 12 may be made of a plastic and/or may be moulded and/or extruded. In embodiments, the plastic of the third divider 12 may or may not be a clear plastic and/or may be polycarbonate, crystal styrene and/or polyethylene. It should be understood that the dividers 10, 11, 12 may be made of the same material, different materials or a combination thereof.

Figure 6:
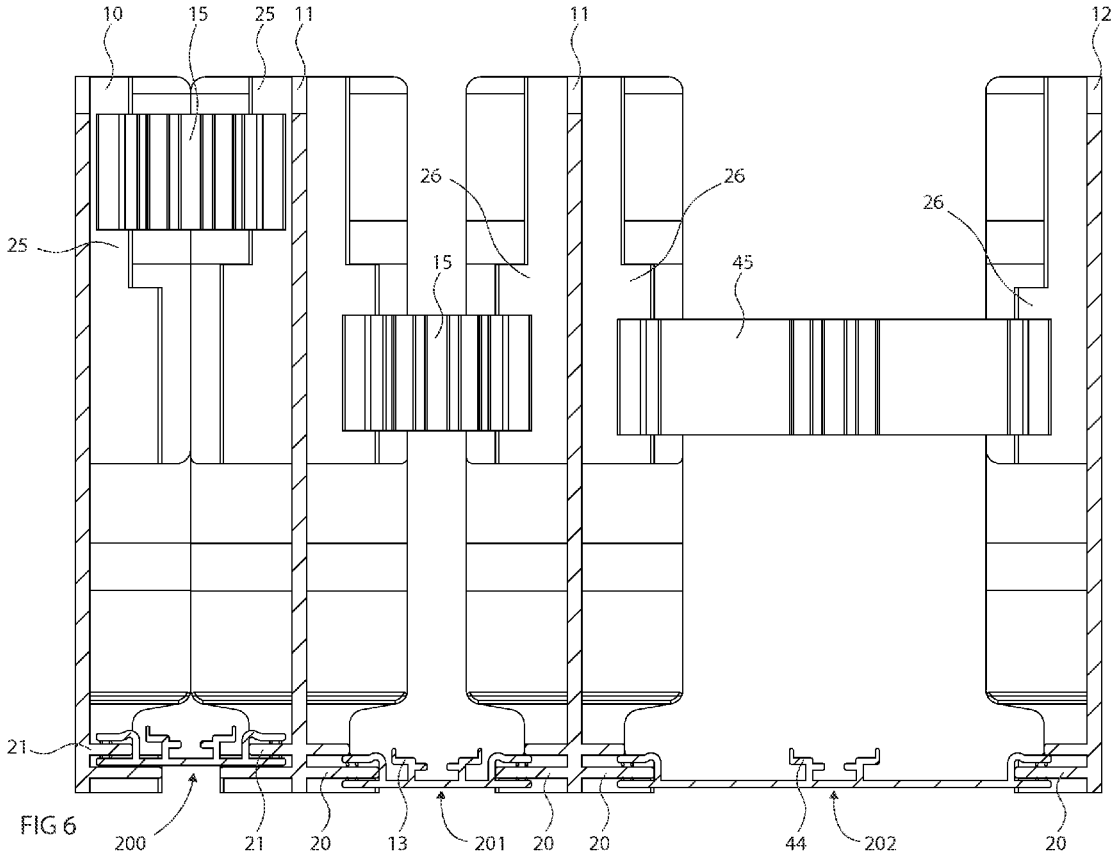
FIG. 6 illustrates a cross-sectional view of a divider and pusher system in an embodiment.

FIG. 6 shows a cross-sectional view of the divider system 5 and highlights the connectivity and configuration of the divider system 5 which, when assembled, may form, create and/or provide the pockets 200, 201, 202 for receiving, storing, housing, enclosing, securing and/or dispensing the first and second products 300, 301. The second divider 10 and a first first divider 11 may be connected by a first rear support connector 15 to form, create and/or provide the first pocket 200. A second first divider 11 and the first first divider 11 may be connected by a second rear support connector 15 to form, create and/or provide the second pocket 201. The second first divider 11 and the third divider 12 may be connected by the rear support connector 45 to form, create and/or provide the third pocket 202. It should be understood that the present disclosure is not limited to a specific number of pockets that may be formed, created and/or provided by the divider system 5. Any number of the dividers and any number of rear support connectors may be utilized in the divider system 5 to form, create and/or provide any number of pockets for dividing, pushing, storing, housing and/or displaying retail products as known to one of ordinary skill in the art.

In an embodiment, rubber grippers, snap points or other mechanical fastening means (not shown in the drawings) on the first and/or second connection plates 13, 44 and first and/or second rear support tracks 15, 45 may connect, secure, attach and/or fasten the first and/or second connection plates 13, 44 to the first and/or second track connection mounts 20, 21 and/or the first and/or second rear support track connection mounts 25, 26 on the dividers 10, 11, 12. To change size configurations of the pockets 200, 201, 202, the dividers 10, 11, 12 may be pulled apart and the first and/or second connection plates 13, 44 may shifted to another mounting position (not shown in the drawings) on the dividers 10, 11, 13 or may be replaced with differently-sized connection plates.

Figure 7A:
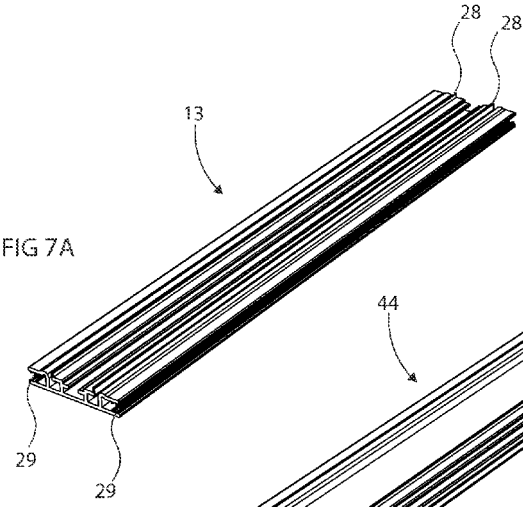
FIG. 7A illustrates a perspective view of a first connection plate in an embodiment.
Figure 7B:
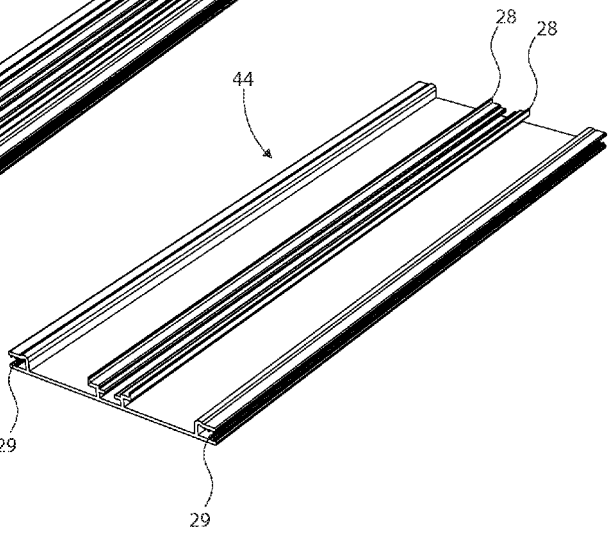
FIG. 7B illustrates a perspective view of a second connection plate in an embodiment.
Figure 7C:
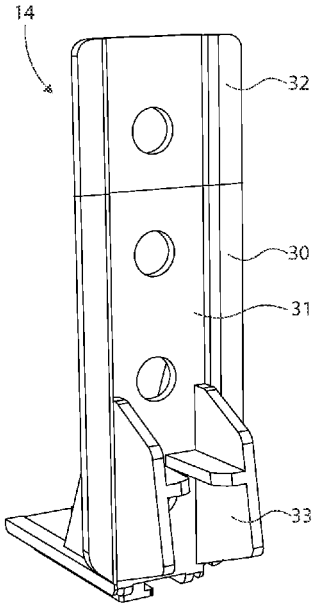
FIG. 7C illustrates a perspective view of a pusher paddle in an embodiment.

FIGS. 7A and 7B show the first and second connector plates 13, 44, respectively. A width of the first and/or second connector plates 13, 44 may be any size for holding, supporting and/or pushing the first and second products as known to one of ordinary skill in the art. Each of the first and second connector plates 13, 44 may have pusher rails 28 which are sized and configured such that the pusher paddle 14 and/or the first and second products 300, 301 may slide towards the front-side of the divider system 5 for dispensing and/or removal from the divider system 5. The first and/or second connector plates 13, 44 may have divider connectors 29 which may be connection points for connecting, attaching, fastening and/or securing the first and/or second connector plates 13, 44 to one or more of the dividers 10, 11, 12. A pusher spring or pusher mechanism (not shown in the drawings) may be connected, attached, secured, fastened and/or mounted in a middle of the pusher rails 28. The pusher spring or pusher mechanism may be configured to urge the pusher paddle 14 and/or the first and second products 300, 301 towards the front-side of the divider system 5.

FIG. 7C shows the pusher paddle 14 which may have an outer paddle face 30, an inner paddle face 31, an upper paddle section 22 and/or the product angler 33. In an embodiment, the pusher paddle 14 may be sized and/or configured to be utilized with tall retail products, such as, for example, tooth brushes or other oral hygiene products. A height of the pusher paddle 14 may be customizable by removing the upper paddle section 32 from the pusher paddle 14. In an embodiment, the pusher paddle 14 may be made from a hard plastic material. The hard plastic material may be high impact styrene, another hard plastic material or a combination thereof. It should be understood that the present disclosure is not limited to a specific embodiment of the hard plastic material of the pusher paddle 14.

The outer paddle face 30 may be configured to face, contact and/or pusher the first and second products 300, 301. The inner paddle face 31 may be configured to allow first and second products 300, 301, which may be oddly-shaped products, to recess or sink into the inner paddle face 31. As a result, the first and second products 300, 301 may be configured and/or aligned parallel or substantially parallel to the product retaining fence 16 and/or the fence inserts 43. In an embodiment, the upper paddle section 32 may be removably attached to the pusher paddle 14 or may be excluded from the pusher paddle 14. As a result, the pusher paddle 14 may be sized and configured to be utilized with smaller and/or shorter products. In an embodiment, the product angler 33 may be sized and/or configured to place, hold and/or support the first and second products 300, 301 at angle of one or more degrees. For example, the product angler 33 may hold the first and second products at an angle of about five degrees, about ten degrees, about twenty degrees and/or about thirty degrees. As a result, the first and second products 300, 301, which may or may not have irregular package shapes, may track parallel or substantially parallel to the pusher paddle 14, the product retaining fence 16 and/or the fence inserts 43 while being moved and/or pushed along the first and/or second connection plates 13, 44. Moreover, the product angler 33 may prevent or substantially prevent irregular shaped packages from becoming jammed, logged and/or stuck between adjacent packages and the walls of the dividers 10, 11, 12.

Figures 8A, 8B, 8C:
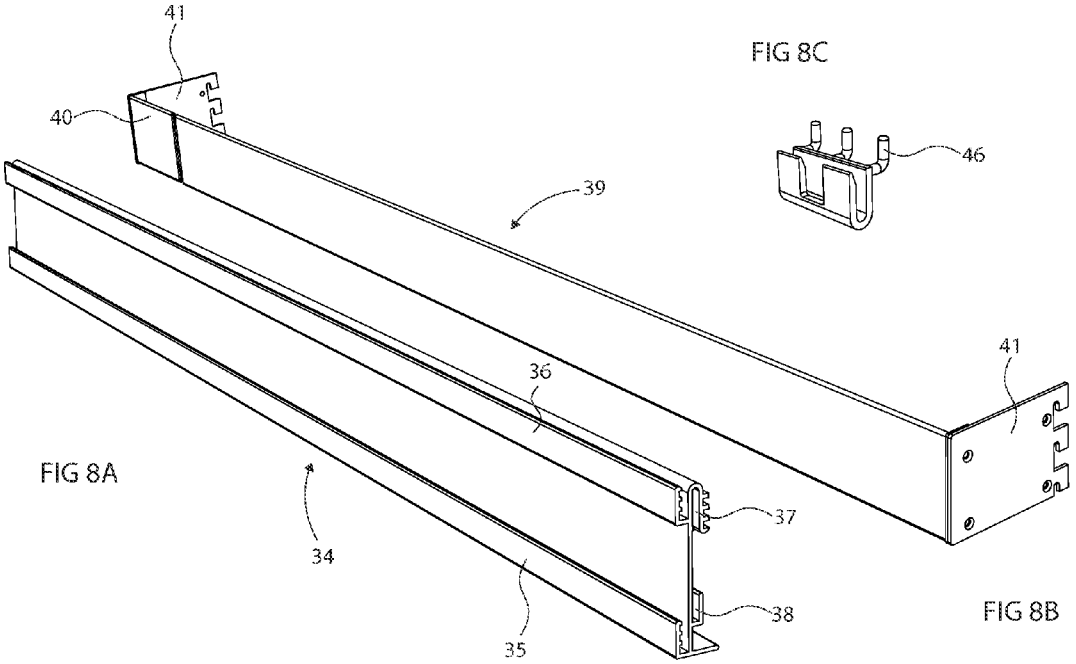
FIG. 8A illustrates a perspective view of a hanging mount bracket in an embodiment.
FIG. 8B illustrates a perspective view of an upright mount cross bar in an embodiment.
FIG. 8C illustrates a perspective view of a clip in an embodiment.

FIG. 8A shows the hanging mount bracket 34 may have a lower track 35 and an upper track 36 which may be sized and/or configured to connect, secure, attach and/or fasten to the upper rear mounting hanger 23 and the lower rear mounting hanger 24 on the dividers 10, 11, 12. As a result, the dividers 10, 11, 12 may be secured when mounting to the board 151, the upright 150 and/or the like. The dividers 10, 11, 12 may be configured to slide or move horizontally or substantially horizontally along the lower and/or upper tracks 35, 36 to facilitate disconnection and reconnection of the dividers 10, 11, 12 and the first and/or second connection plates 13, 44 when reconfiguring sizing and/or spacing of the pockets 200, 201, 202. The hanging mount bracket 34 may have an inner clip rail 37 and a crossbar track 38 which may be utilized to connect, secure, attach and/or fasten to the upright mount cross bar 39 for mounting to, for example, the upright 150.

FIG. 8B shows the upright mount cross bar 39 may have a width adjustment bracket 40 and a depth selector plate 41. The width adjustment bracket 40 may be sized and/or configured to allow the upright mount cross bar 39 to be connected, attached, fastened, secured, mounted to uprights with varying widths. The depth selector plate 41 may be configured for setting a distance of the dividers 10, 11, 12 from a section of, for example, the upright 150 so that fronts of the dividers 10, 11, 12 are in-line with adjacent aisle shelves and/or fixtures. As a result, the fronts of the dividers 10, 11, 12 may be set to be in-line with an adjacent shelf, such as, for example, a twelve inch, a fourteen inch or a sixteen inch shelf.

In an embodiment, the upright cross bar 39 may be made of a hard material, such as, for example, hard plastic, steel or a combination thereof. In an embodiment, the upright cross bar 39 may have a centre bar, which may mount to the hanging bracket 34, configured to slide forward and backward along two side rails. As a result, the divider system 5 may be pulled forward, out from underneath, for example, the first shelf 152 above to facilitate quicker and easier loading of the first and second products 300, 301 into the pockets 200, 201, 202 of the divider system 5. The movable and/or slidable centre bar of the upright cross bar 39 allows a depth associated with the front-side of the divider system 5 to be adjustable such that the front-side of the divider system 5 may be aligned with the adjacent aisle shelves and/or fixtures. The movable and/or slidable centre bar of the upright cross bar 39 is further depicted as adjustable depth merchandising cross bar 2100 as shown in FIGS. 51A, 52, 53A-53C, 54A, 54B and 55. The present disclosure should not be deemed as limited to a specific embodiment of the hard material of the upright cross bar 39.

FIG. 8C shows a peg clip 46 which may be configured to be used to connect, attach, secure, fasten and/or mount the hanging mount bracket 34 of the divider system 5 to, for example, the board 151. In an embodiment, the peg clip 46 may be, for example, a moulded polycarbonate clip. In an embodiment, the board 151 may be, for example, a pegboard or a slatwall. The present disclosure should not be deemed as limited to a specific embodiment of the peg clip 46 and/or the board 151.

Figure 9:
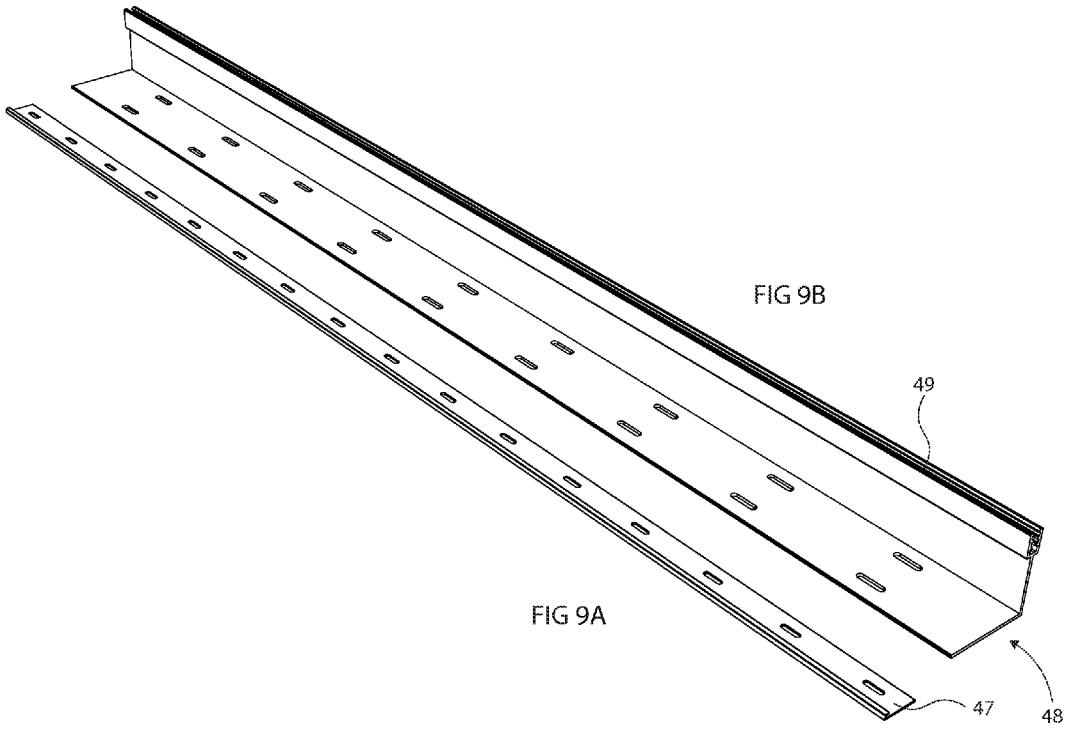
FIG. 9 includes FIG. 9A, illustrating a perspective view of front shelf mount track in an embodiment, and FIG. 9B, illustrating a perspective view of rear shelf mount track in an embodiment.

FIGS. 9A and 9B shows the front shelf mount track 47 and the rear mount track 48 which may have mounting clips 49 formed and/or provided thereon. The dividing system 5 may be mounted to, for example, the first shelf 152 or the second shelf 153 via the front shelf mount track 47, the rear mount track 48 and/or one or more fasteners (not shown in the drawings). The one or more fasteners may be screws, bolts, pushpins, adhesive tapes and/or the like. In an embodiment, the front shelf mount track 47 and/or the rear mount track 48 may be made of plastic material, such as, for example, extruded plastic material. It should be understood that the present description should not be deemed as limited to a specific embodiment of the one or more fasteners and/or the plastic material of the front and rear mount tracks 47, 48.

In embodiments, the front shelf mount track 47 may be sized and/or configured to connect, attach, secure, fasten and/or mount to a conventional retail shelf (not shown in the drawings) via the toe clip 22 on dividers 10, 11, 12 such that the toe clip 22 may lock, secure and/or fasten into the front shelf mount track 47. As a result, the dividers 10, 11, 12 may be connected, attached, secured, fastened and/or mounted to the shelf. The rear mount track 48, when mounting to the first shelf 152 or the second shelf 153, may be mounted with a horizontal flange facing forward for the second shelf 153 or facing backwards for the first shelf 152. The mounting clips 49 on rear mount track 48 may be sized and/or configured to engage the lower rear mounting hanger 24 on the dividers 10, 11, 12. As a result, the dividers 10, 11, 12 may be connected, attached, mounted, fastened and/or secured to the rear mount track 48 via the mounting clips 49.

FIG. 10A shows more than one of the first products 300 which may be held forward against the product alignment ribs 19 and/or the front fence 16 at, for example, more than one degree angle back, under tension and/or force delivered from the pusher paddle 14, the product angler 33 and/or the pusher spring or pusher mechanism. FIG. 10B shows a front most first product 300 which may be removed, upwards and/or at a forward angle, from the divider system 5. In an embodiment, the back angle, which may be about ten degrees, may facilitate forward movement or sliding of the next first product 300 behind the front most first product 300. The back angle may also facilitate the removal of the front most first product 300 from the divider system 5 without catching or grabbing the first product 300 behind the front most first product 300. As a result, the back angle may prevent or substantially prevent additional first products 300 from being accidently removed from the divider system 5. Once the front most first product 300 may clear a top of the front fence 16, remaining first products 300 behind the front most first product 300 may be moved and/or pushed forward by the pusher paddle 14. The first products 300 may be aligned parallel or substantially parallel to the front fence 16 as the first products may move forward via the product alignment ribs 19.

Figure 11:
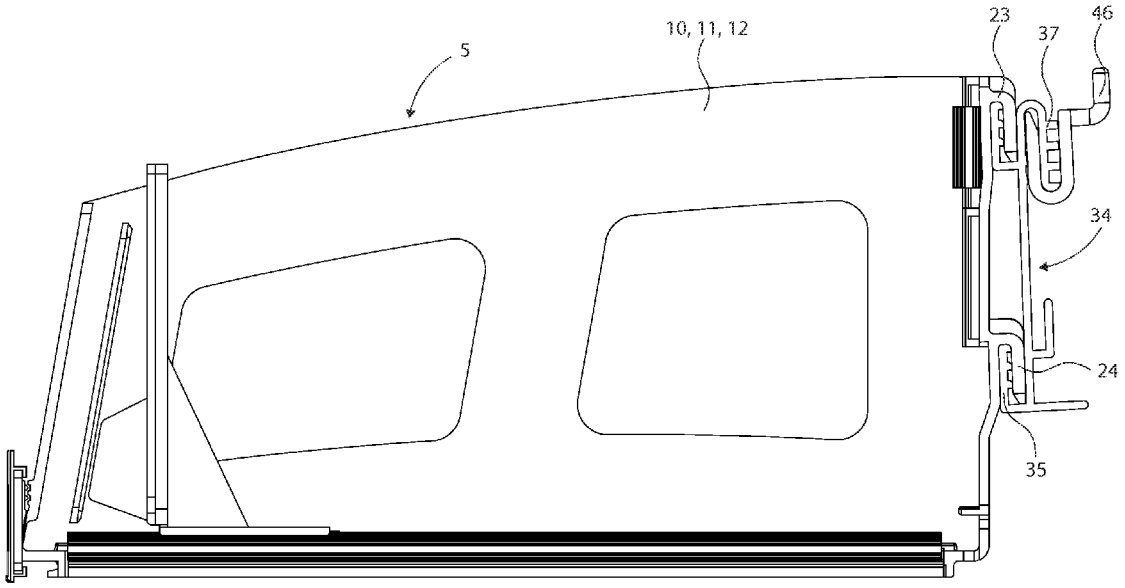
FIG. 11 illustrates a side plan view of a divider component having a clip in an embodiment.

In FIG. 11, the divider system 5 may be connected, attached, secured and/or fastened to the hanging mount bracket 34 and/or the clip 46 for mounting the divider system 5 to, for example, the board 151. The divider system 5 may be connected, attached, secured and/or fastened to the hanging mount bracket 34 via the upper rear mounting hanger 23, the lower rear mounting hanger 24, the track 35 and/or track 36. The hanging mount bracket 34 may be connected, attached, secured and/or fastened to the clip 46 via the clip attachment rail 37.

In FIG. 12, the divider system 5 may be connected, attached, secured and/or fastened to the hanging mount bracket 34, the upright mount cross bar 39 and/or the depth selector plate for mounting the divider system 5 to, for example, the upright 150. The divider system 5 may be connected, attached, secured and/or fastened to the hanging mount bracket 34 via the upper rear mounting hanger 23, the lower rear mounting hanger 24, the track 35 and/or track 36. The hanging mount bracket 34 may be connected, attached, secured and/or fastened to the upright mount cross bar 39 and/or the depth selector plate via the track 38.

In FIG. 13A, the divider system 5 may be connected, attached, secured, fastened and/or mounted to the second shelf 153 via the lower rear mounting hanger 24, the front shelf mount track 47, the rear mount track 48 and/or mounting clips 49. When mounting the divider system 5 onto the second shelf 153, one or more toe clips 22 of the dividers 10, 11, 12 may be inserted at a forward angle into the front shelf mount track 47. A back of the divider system 5 may be subsequently lowered onto the rear shelf mount track 48 and the lower rear mounting hanger 24 may connect with and/or engage the mounting track 49 to provide a secure fit.

In FIG. 13B, the divider system 5 may be connected attached, secured, fastened and/or mounted to the first shelf 152 via the lower rear mounting hanger 24, the rear mount track 48 and/or mounting clips 49. When mounting the divider system 5 onto the first shelf 153, positioning of the rear shelf mount track 48 may be flipped, moved, rotated to situate and/or align front edges of the dividers 10, 11, 12 with a front edge of the first shelf 152.

FIG. 14 shows multiple divider system configurations for more than one divider system 204 which may be utilized for mounting divider systems 5 to different mounting components. The divider system 204 may have the same or similar features and/or components as the divider system 5 and the features and/or components of the divider system 204 may operate and/or function in the same or similar manner as the features and components of the divider system 5. A first divider system configuration 250 facilities mounting of the divider system 204 to the board 151, a second divider system configuration 251 facilitates mounting the divider system 204 to the uprights 150, a third divider system configuration 252 facilitates mounting the divider system 204 to the first shelf 152, and a forth divider system configuration 253 facilitates mounting the divider system 204 to the uprights 150 and an adjustable depth merchandising crossbar 154 (hereinafter "adjustable crossbar 154"). In embodiments, a typical retail gondola section 400 (hereinafter "gondola section 400") may comprise the board 151, the uprights 150 and/or the first shelf 152.

The adjustable crossbar 154 is configured such that the divider system 204, mounted thereon, may slide or move inwardly or outwardly with respect to the uprights 150, the board 151 and/or the gondola section 400. As a result, the divider system 204 may be pushed inward or pull outward with respect to the uprights 150, the board 151 and/or the gondola section 400 via the adjustable crossbar 154. The divider system 204 may be pulled outward to a partially expanded depth or a fully extended depth for loading, reloading or positioning the products 300, 301 in the pockets 200, 201, respectively. The depth of the divider system 204 may be adjusted, via the adjustable crossbar 154 such that the front-side the divider system 204, mounted on the adjustable crossbar 154, aligns flush with the front-sides of the other divider system 204 mounted to the uprights 150, the board 151 and/or the shelf 152 and/or with the front-sides of surrounding or adjacent shelving and/or displays. In embodiments, the adjustable crossbar 154 may be connected, attached, secured, fastened and/or mounted to divider system 204 via the upper rear mounting hanger 23 and/or the lower rear mounting hanger 24, In embodiments, the divider system 204 may have a width of, for example about twelve inches, about twenty-four inches, about forty-eight inches or about sixty inches. The divider system 204 may have any number of pockets 200, 201, 202 as known to one of ordinary skill in the art. For example, the divider system 204 may have nine of the pockets 202 and fourteen of the pockets 200. It should understood that the present disclosure should not be deemed as limited to a specific embodiment of the width of the divider system 204 and/or number of pockets 200, 201, 202.

The divider system configuration 250 is also shown in FIGS. 11, 14 and 15 and may be utilized to connect, attach, secure, fasten and/or mount the divider system 204 to a slatwall (not shown in the drawings). The divider system configuration 251 is also shown in FIGS. 12, 14 and 16. The divider system configuration 252 is also shown in FIGS. 13, 14 and 17.

FIG. 15 shows the divider system configuration 250 having the divider system 204 which may be connected, attached, secured, fastened and/or mounted to the board 151 via clips 46 and/or hanging mount bracket 34. Any width of the divider system 204 may be used when utilizing configuration 250. Hanging mount bracket 34 may be cut to the necessary and/or required width to hold the number of dividers 10, 11, 13 and/or pockets 200, 201, 202 as required. This is the same advantage realized when mounting divider system 204 to the upright 150, the first shelf 152 and/or the second shelf 153 and utilizing the configuration 250.

FIG. 16 shows the divider system configuration 251 having the divider system 204 which may be connected, attached, secured, fastened and/or mount to the upright 150 via the hanging mount bracket 34 and/or the upright mount cross bar 39. FIG. 17. Shows the divider system configuration 252 having the divider system 204 which may be connected, attached, secured, fastened and/or mount to the first or second shelves 152, 153 via the front shelf mount track 47 and/or the rear mount track 48.

The divider systems 5, 204 may combine the versatility and flexibility of peg hooks with benefits of automatic facing and clean, high-end look of on-shelf pusher systems.

The divider systems 5, 204 may provide retailers the ability to merchandise small, lightweight or oddly shaped products while preventing or substantially preventing fallen and/or broken packages along with constant upkeep.

The divider system 5, 204 may be utilized with, for example, oral hygiene, pharmacy and beauty products, as well as other such products which may be traditionally merchandised on hooks, but may also be adapted to fit any retail product.

Figure 18:
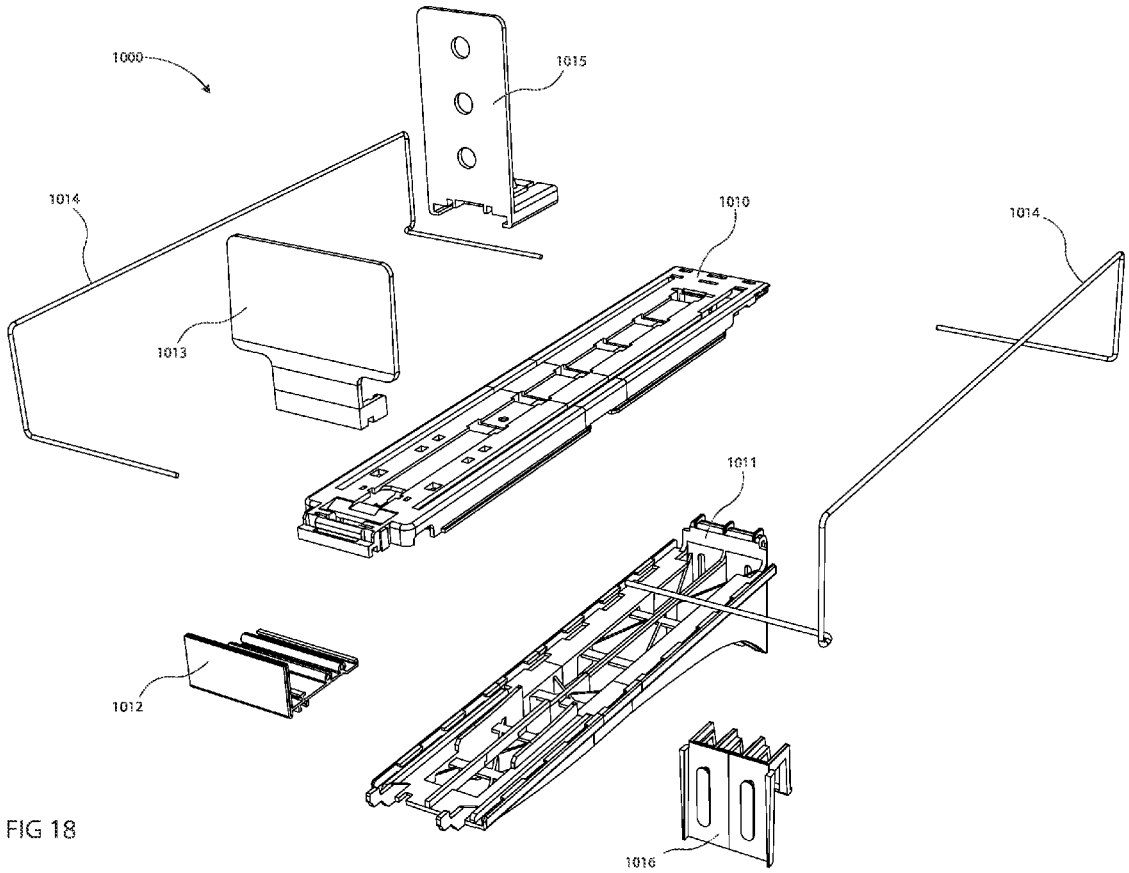
FIG. 18 illustrates an exploded perspective view of a quick-load pusher system in an embodiment.

FIG. 18 shows an exploded perspective view of a quick-load pusher system 1000 (hereinafter "pusher system 1000") in an embodiment. The pusher system 1000 may comprise one or more of a pusher track 1010, a hanging gusset 1011, a data track component 1012, a front plate 1013, wire dividers 1014, a pusher paddle 1015 and/or a bar mount bracket 1016. The pusher system 1000 may be sized and/or configured to store, house, secure, display, enclose and/or dispense one or more products 3300 (hereinafter "products 3300"). The pusher system 1000 may have one or more features and/or components that may be the same as or similar to the features and/or components of the divider systems 5, 204. Moreover, the features and/or components of the pusher system 1000 may operate and/or function in a same or similar manner as the features and/or components of the divider systems 5, 204.

In an embodiment, the products 3300 may be, for example, bagged products, such as, for example, bagged cheese, bagged salad, bagged deli meats and/or the like. In embodiments, the products 3300 may by, for example, consumer products, food products, hard goods, durable goods, soft goods, consumables, consumer-grade goods, professional-grade goods and/or the like. In embodiments, the products 3300 may be OTC products, such as, for example, analgesics, medications, pharmaceuticals, razors, razor blades, camera film, batteries, videos, DVDs, smoking cessation products, infant formula, vitamins, personal care products, home care products, toothbrushes, foodstuffs, packaged foods, kitchen supplies, bags, boxes, containers and/or the like. In an embodiment, the products 3300 may be the same or similar retail products as the first and second products 300, 301. It should be understood that the present disclosure is not deemed as limited to a specific embodiment of the bagged products, OTC products and/or the one or more products 3300.

Figure 19:
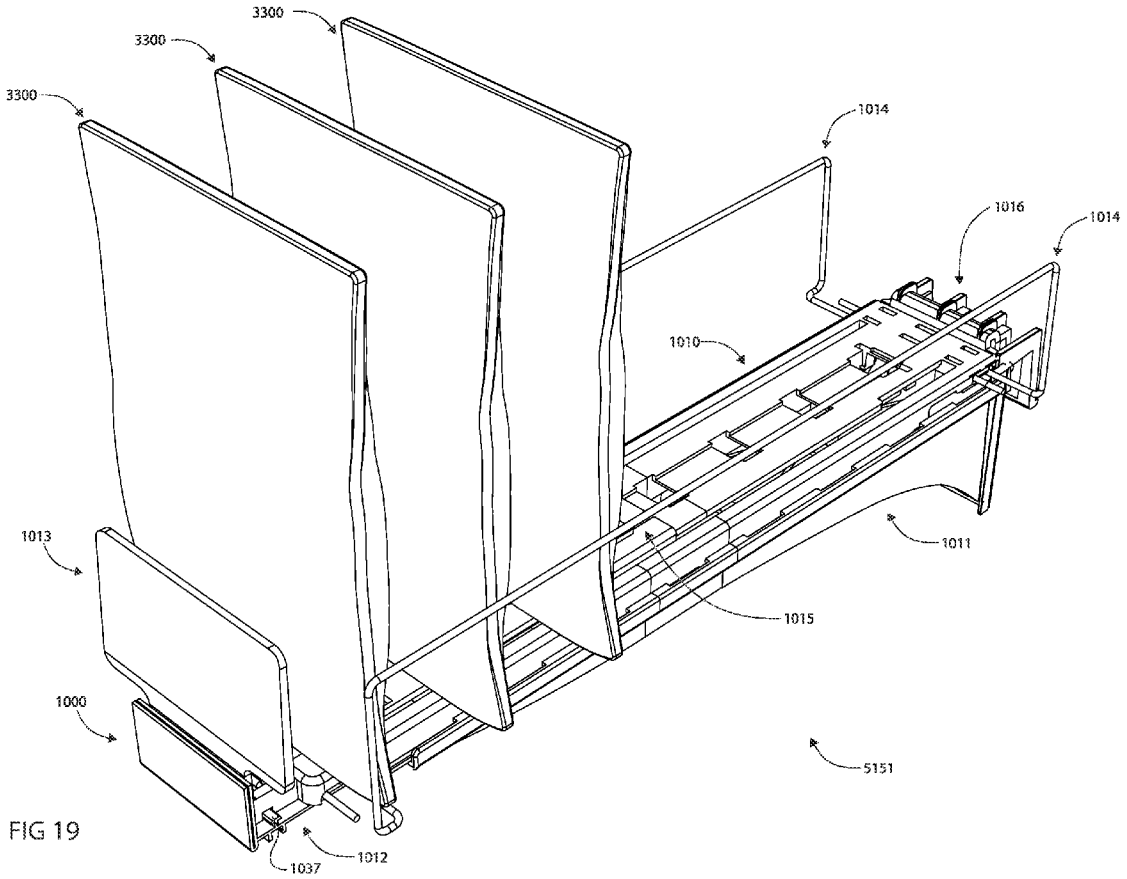
FIG. 19 illustrates a perspective view of a quick-load pusher system having more than one retail product in an embodiment.

The pusher track 1010 may be sized and/or configured to hold, support and/or display the product 3300 and/or may slide and/or pull out for product loading of the pusher system 1010. The pusher track 1010 may be connected, attached, fastened, secured and/or mounted to the hanging gusset 1011 and may move, glide and/or slide along the hanging gusset 1011 when the pusher track 1010 is being loaded. The pusher track 1010 may be connected, attached, secured, fastened and/or mounted to one or more of the data track component 1012, the front plate 1013, the wire dividers 1014, the pusher paddle 1015 and/or the bar mount bracket 1016 (as shown in FIG. 19).

Figure 22:
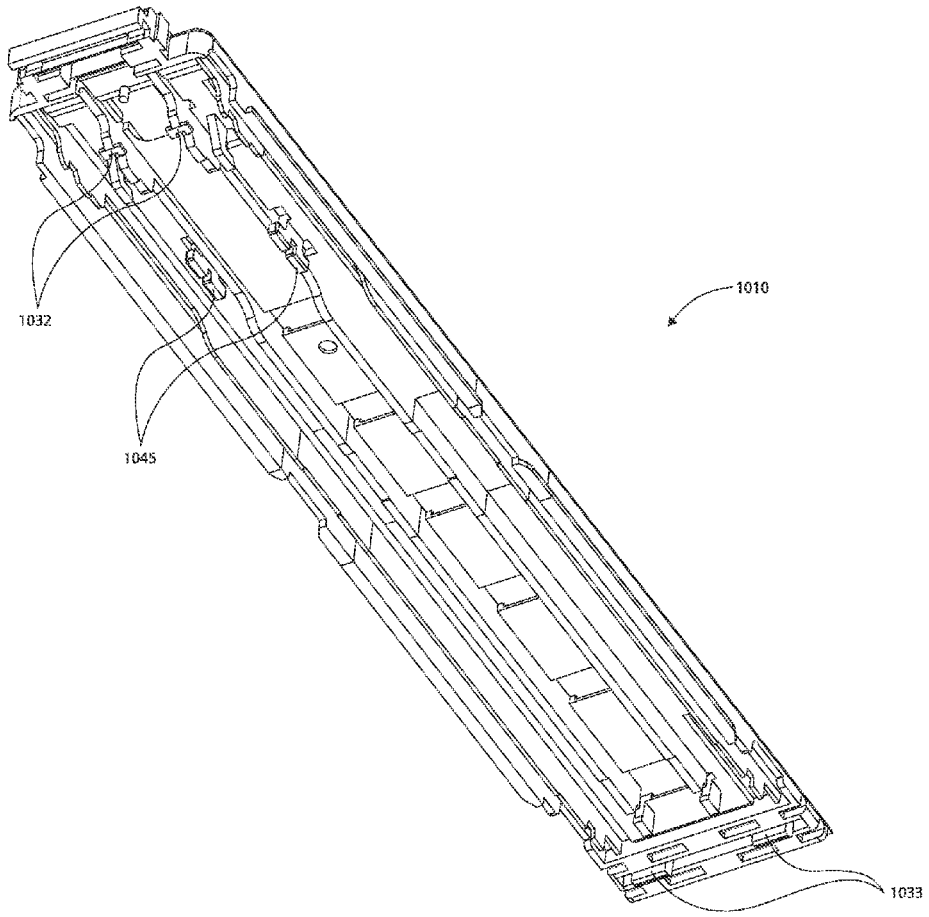
FIG. 22 illustrates a bottom perspective view of a pusher track in an embodiment.
Figure 31:
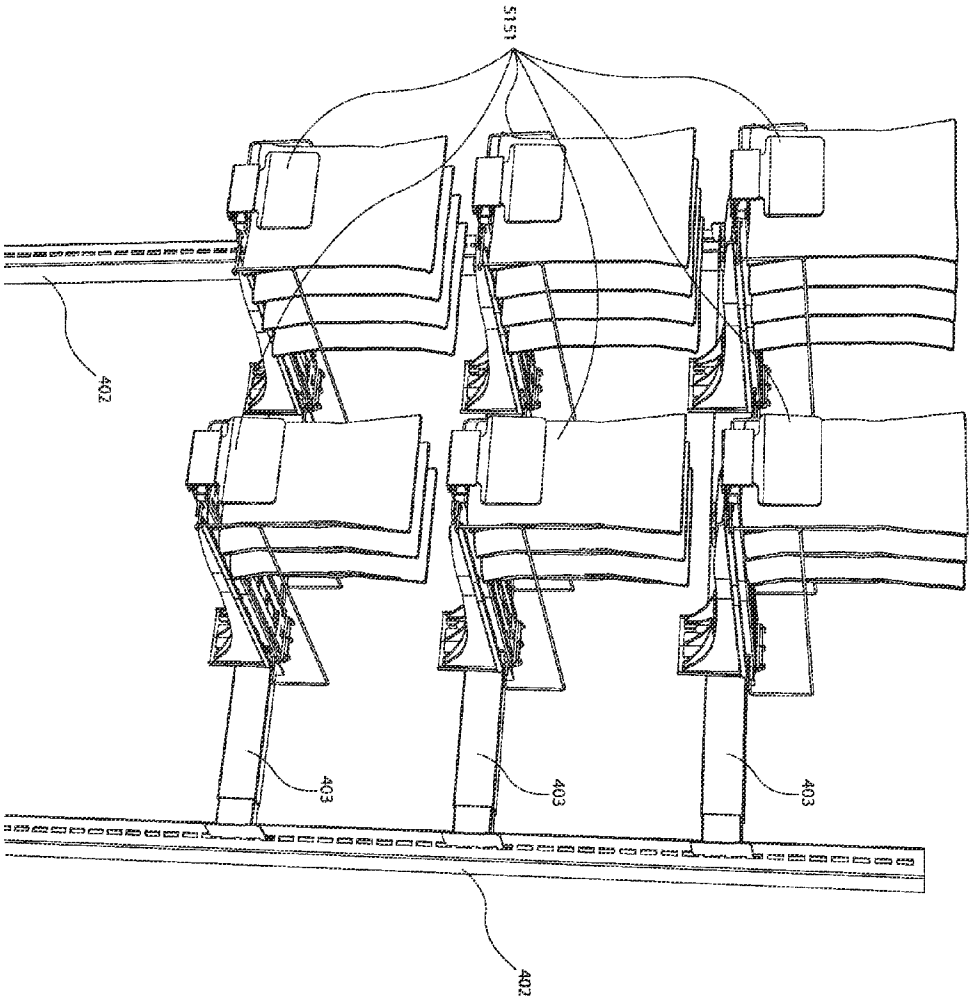
FIG. 31 illustrates a perspective view of a quick-load pusher system having more than one quick-load pusher assemblies in an embodiment.
Figure 32:
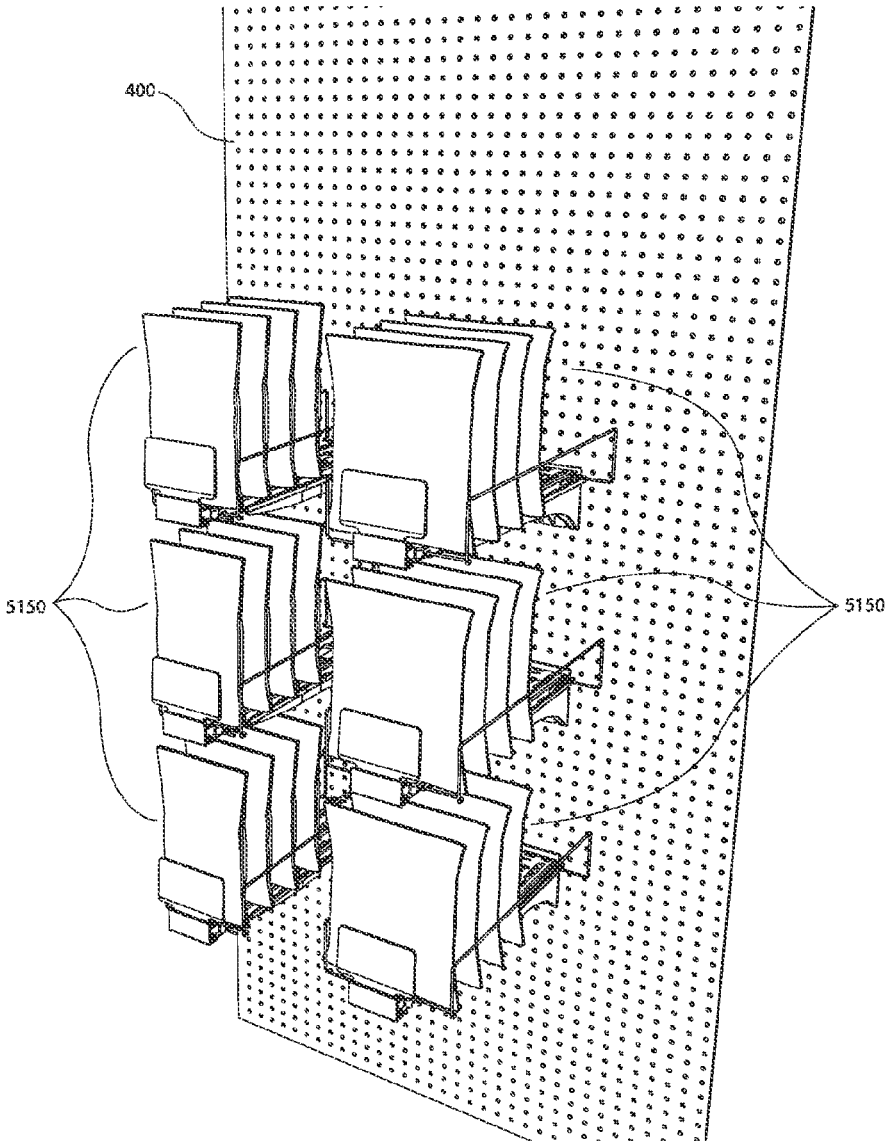
FIG. 32 illustrates a perspective view of a quick-load pusher system having more than one quick-load pusher assemblies in an embodiment.
Figure 33A:
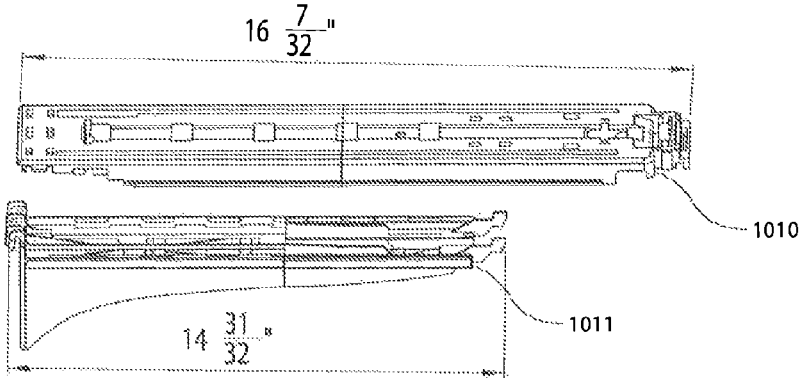
FIGS. 33A-33D illustrate elevated side perspective views of pusher tracks and hanging gussets in embodiments.
Figure 33B:
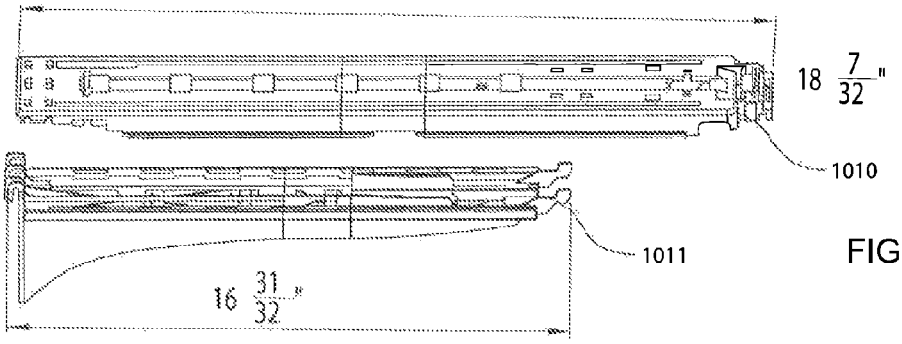
Figure 33C:
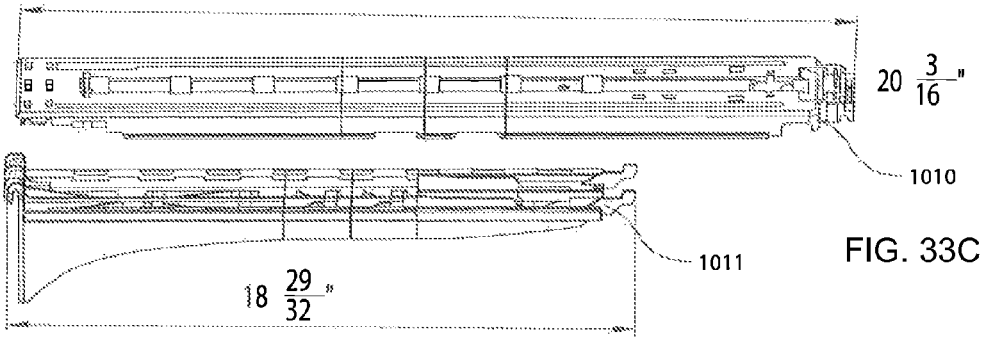
Figure 33D:
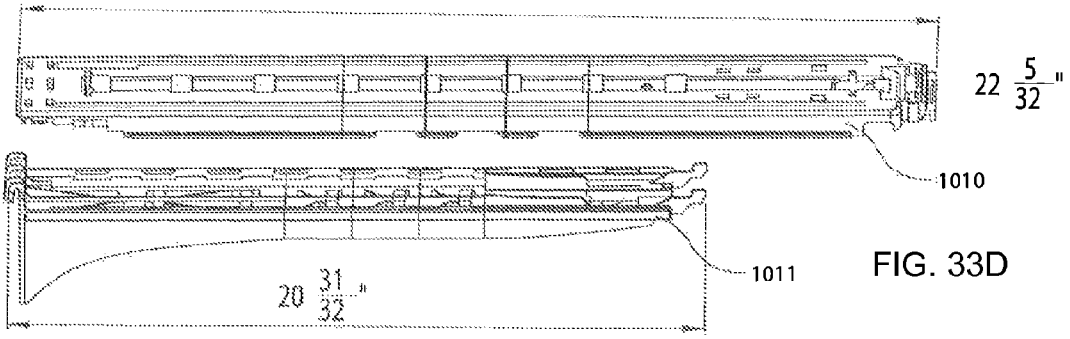

The hanging gusset 1011 may support the pusher track 1010 and may allow the pusher track 1010 to slide inward and outward for product loading and displaying the first and second products 300, 301 or the products 3300. The hanging gusset 1011 may be connected, attached, secured, fastened and/or mounted to the bar mount bracket 1016 to allow the hanging gusset 1011 to connect, attach, hang, secure and/or fasten to a crossbar 403 (as shown in FIG. 31). In an embodiment, the hanging gusset 1011 may connect, attached, fasten, secure and/or mount to a peg mount 1030 to allow the hanging gusset 1011 to connect, attach, fasten and/or hang to the peg board 400 (as shown in FIG. 32). The hanging gusset 1011 may prevent, substantially prevent and/or restrict forward movement of the pusher paddle 1015 via one or more pusher track stoppers 1033 (as shown in FIG. 22). The hanging gusset 1011 may prevent, substantially prevent and/or restrict forward movement of the pusher track 1010 via one or more middle stoppers (not shown in the drawings) and/or one or more rear plates (not shown in the drawings).

The data track component 1012 may hold, support and/or display product information indicative of one or more of the products 3300. The data track component 1012 may attach, connect, snap, fasten, secure and/or mount to the pusher track 1010 and/or the wire dividers 1014. In an embodiment, the data track component may be sized and/or configured to allow an alternate installation arrangement for the pusher track 1010 via compatibility with a snap track.

The front plate 1013 may be, for example, a customer facing front barrier for products 302 and/or may restrict movement of the products 3300 forward toward a front-side of the pusher system 1000. The front plate 1013 may connect, attach, secure and/or fasten to a front side of the pusher track 1010. In an embodiment, the front plate 1013 may be transparent and/or interchangeable with additional front plates (not shown in the drawings).

Figure 21:
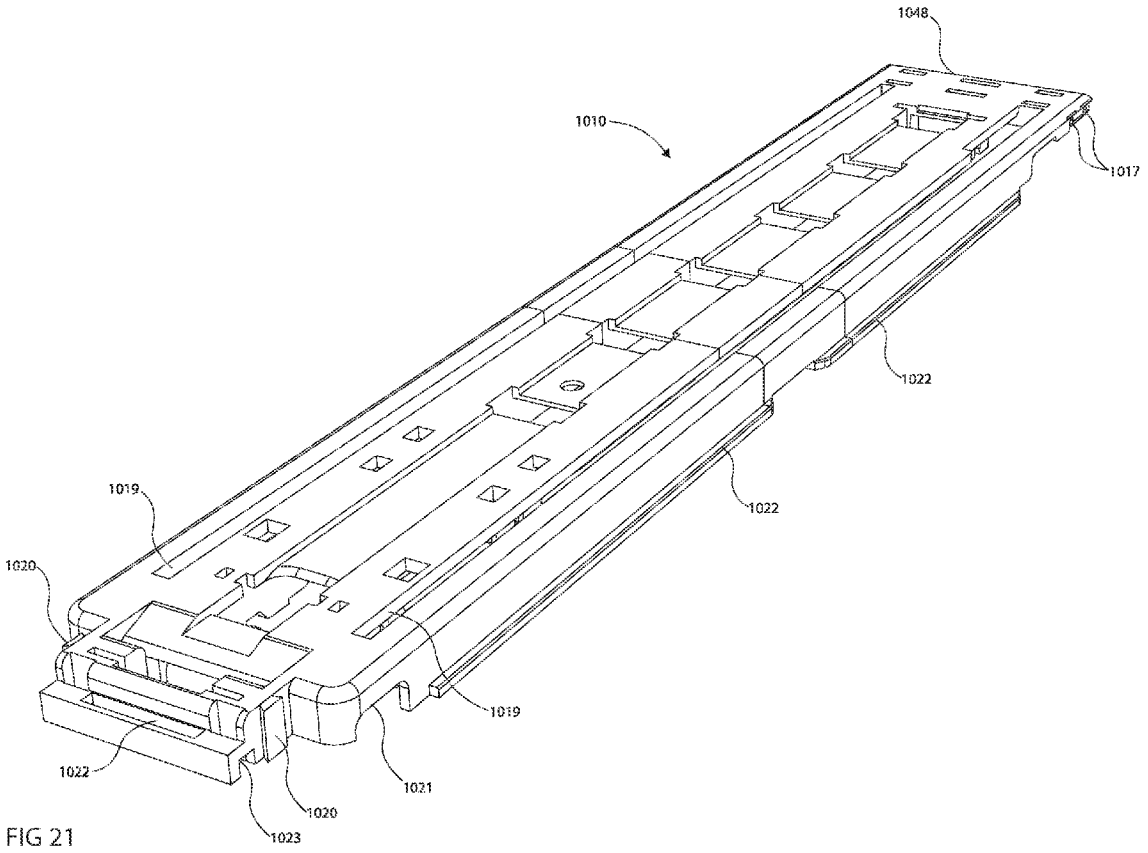
FIG. 21 illustrates a top perspective view of a pusher track in an embodiment.
Figure 28A:
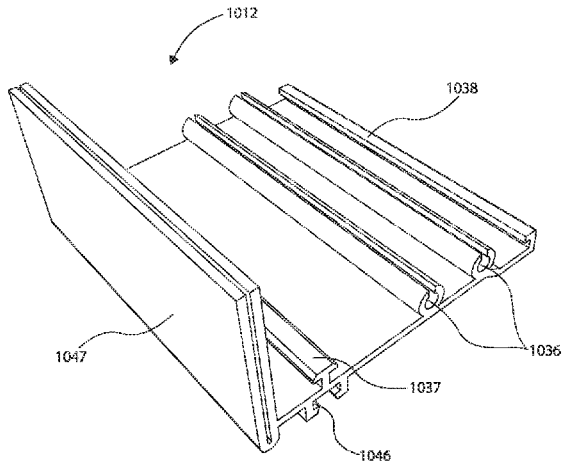
FIG. 28A illustrates a perspective view of a track component in an embodiment.

The wire dividers 1014 may be, for example, an adjustable horizontal barrier for holding retail products, such as, for example, the products 3300. The wire dividers 1014 may be connected, attached, fastened, secured and/or mounted to pusher track 1010 at one or more rear tube mounts 1017 of the pusher track 1010 (as shown in FIG. 21). As a result, the wire dividers 1014 may be aligned parallel or substantially parallel to each other. The wire dividers 1014 may move, extend, retract and/or slide horizontally or substantially horizontally through the rear tube mounts 1017 of the pusher track 1010 which may allow for telescoping adjustability of the wire dividers 1014. The wire dividers 1014 may connect, attach, secure, fasten and/or mount to the data track component 1012 via tube mounts 136 of the data track component 1012 (as shown in FIG. 28A). The wire dividers 1014 may move, extend, retract and/or slide horizontally or substantially horizontally through the tube mounts 136 which may allow for telescoping adjustability of the wire dividers 1012. In embodiments, the wire dividers 1012 may be, for example, painted and/or plated wire dividers.

The pusher paddle 1015 may be sized and/or configured to provide and/or apply a pressure, a force or a constant pressure against the first and second products 300, 301 or the products 3300 which may be contained and/or stored within the pusher system 1000. As a result, the first and second products 300, 301 or the products 3300 may be forced, pressured and/or squeezed between the pusher paddle 1015 and the front plate 1013. The pusher paddle 1015 may connect, attach, secure and/or fasten to and/or snap into the pusher plate 1010 and/or may move or slide lengthwise along one or more grooves in the pusher plate 1010. In embodiments, the pusher paddle 1015 may have the same features and components as the pusher paddle 14 which may function and/or operate in the same or similar manner as the features and/or components of the pusher paddle 14.

The bar mount bracket 1016 may connect, attach, secure, fasten and/or mount to a rear of the hanging gusset 1011. The bar mount bracket 1016 may have one or more fasteners, such as, for example, one or more hooks which may attach, connect, secure, fasten and/or hook the bar mount bracket to the crossbar 403. As a result, the pusher system 1000 may connect, attach, fasten, secure and mount to the crossbar 403 via the bar mount bracket 1016.

In embodiments, one or more the pusher track 1010, the data track component 1012, the front plate 1013, the pusher paddle 115 and/or the bar mount bracket 1016 may be made of a plastic material and/or a moulded plastic material. The plastic material and/or the moulded plastic material may be, for example, a clear plastic material or a non-clear plastic material.

FIG. 19 shows a pusher system configuration 5151 having the pusher system 1000 in a fully assembled state. In an embodiment, the pusher system 1000 may be storing, holding, securing and/or displaying one or more products 3300 which may be forced, pressured and/or squeezed between the pusher paddle 1015 and the front plate 1013 via a pusher spring and/or a pusher mechanism, such as, for example, a clock-type spring (not shown). The wire dividers 1014 may be moved, retracted and/or slid together or inward with respect to each other to accommodate an approximate width of the one or more products 3300. The bar mount bracket 1016 may be utilized in the pusher system configuration 5151 such that the pusher system 1000 may be connected, attached, fastened, secured and/or mounted to the crossbar 403. The pusher system 1000 may have a snap track 1037 which may connect, attach, secure and/or snap into a snap clip 1023 on the pusher track 1010.

Figure 20:
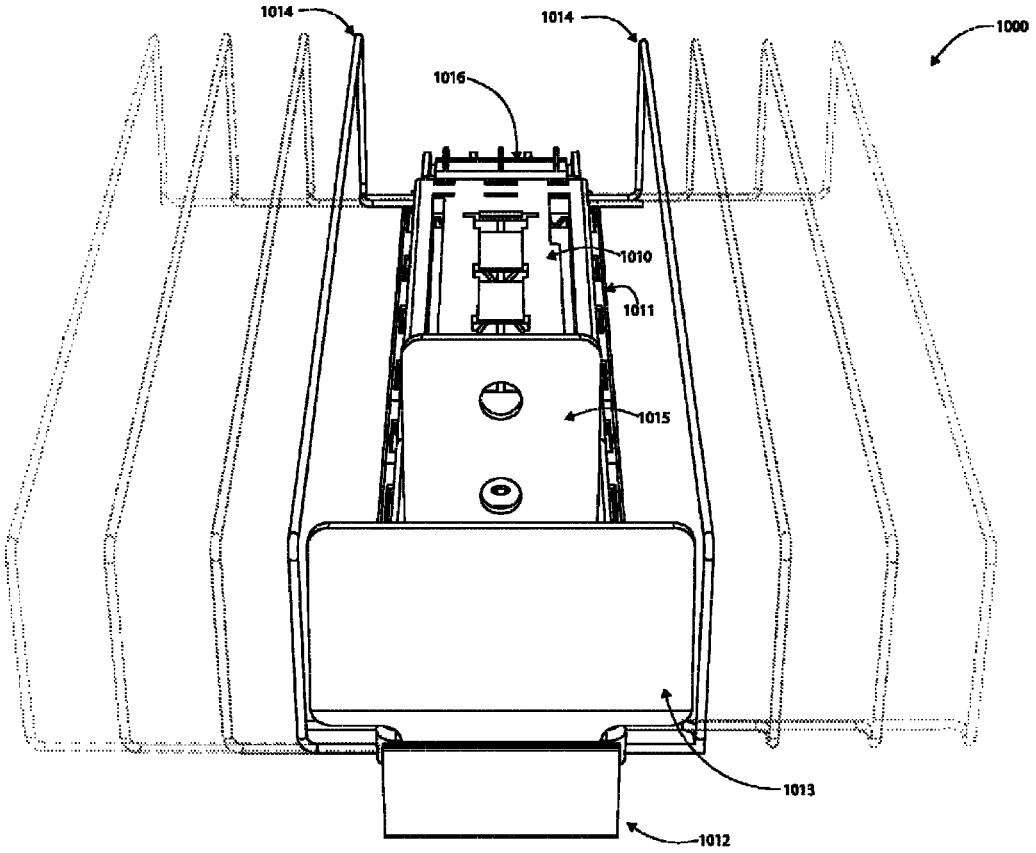
FIG. 20 illustrates a front perspective view of a quick-load pusher system in an embodiment.

FIG. 20 shows an elevated front perspective view of the pusher system 1000. The wire dividers 1014 may be installed into the rear tube mounts 1017 and/or the tube mounts 1036 of the pusher track 1010. The wire dividers 1014 may be configured to telescope outward and/or to retract inward to change and/or adjust a distance or width between the wire dividers 1014. As a result, the distance or width between the wire dividers 1014 may be changed and/or adjusted to receive one or more of the products 3300 and/or to correspond to a width associated with the one or more products 3300.

FIG. 21 shows a top side of the pusher track 1010, whereby the pusher track 1010 may be sized and/or configured to move, extend, retract and/or forward and back via a pusher track rail 1022 when the hanging gusset 1011 is not being utilized. This may be accomplished by mounting the pusher track 1010 to other parts and/or components which may allow the pusher track 1010 to be used on other fixtures, such as, for example, a first or second shelf 152, 153 by incorporating a similar interface to relevant features of the pusher system 1000. The pusher track 1010 may have one or more rear tube mounts 1117 which may be sized and/or configured to guide and/or assist the wire dividers 1014 along their telescoping path. The pusher track 1010 may have one or more main pusher paddle grooves 1019 which may be sized and/or configured to allow the pusher paddle 1015 to connect, attach, secure, fasten and/or mount to the pusher track 1010 and to move and/or slide along a length of pusher track 1010. The pusher track 1010 may have one or more front dovetail tabs 1020 which may be sized and/or configured to create a tight frictional interface and precise registration by the connection of the front dovetail tabs 1020 with interchangeable front plate 1013. The pusher track 1010 may have one or more front windows 1021 which may be sized and/or configured such that the wire dividers 1014 may pass through pusher track 1010 and/or may access the tube mounts 1036 on the data track component 1012. The pusher track 1010 may have one or more pusher track rails 1022 which may be sized and/or configured to allow the pusher track 1010 to move, extend, retract and/or slide longitudinally on the hanging gusset 1011 such that side-to-side motion and/or up-and-down motion may be controllable. The pusher track 1010 may have one or more snap clips 1023 which may connect, attach, secure, fasten and/or snap onto a snap track on the data track component 1012. The pusher track 1010 may have one or more pusher track terminus 1048 which may be sized and/or configured to be a rear limit to linear motion of and/or on the pusher track 1010. In an embodiment, the push track terminus 1048 may be sized and/or configured to physically interface with a rear gusset wall 1034 of the hanging gusset 1011.

In FIG. 22, a bottom side the pusher track 1010 may have one or more bottom extrusion teeth 1032 which may be sized and/or configured to be utilized as a hook interface and/or hook mechanism with an end return 1038 of the data track component 1012. The pusher track 1010 may have one or more pusher track stoppers 1033 which may be sized and/or configured to restrict, prevent and/or limit forward movement of the pusher track 1010 on the hanging gusset 1011 through, for example, physical interface with a gusset ramp 1029 of the hanging gusset 1011. The pusher track 1010 may have one or more accessory mounts 1045 which may be sized and/or configured for mounting one or more peripheral accessories for alternate assemblies.

Figure 23:
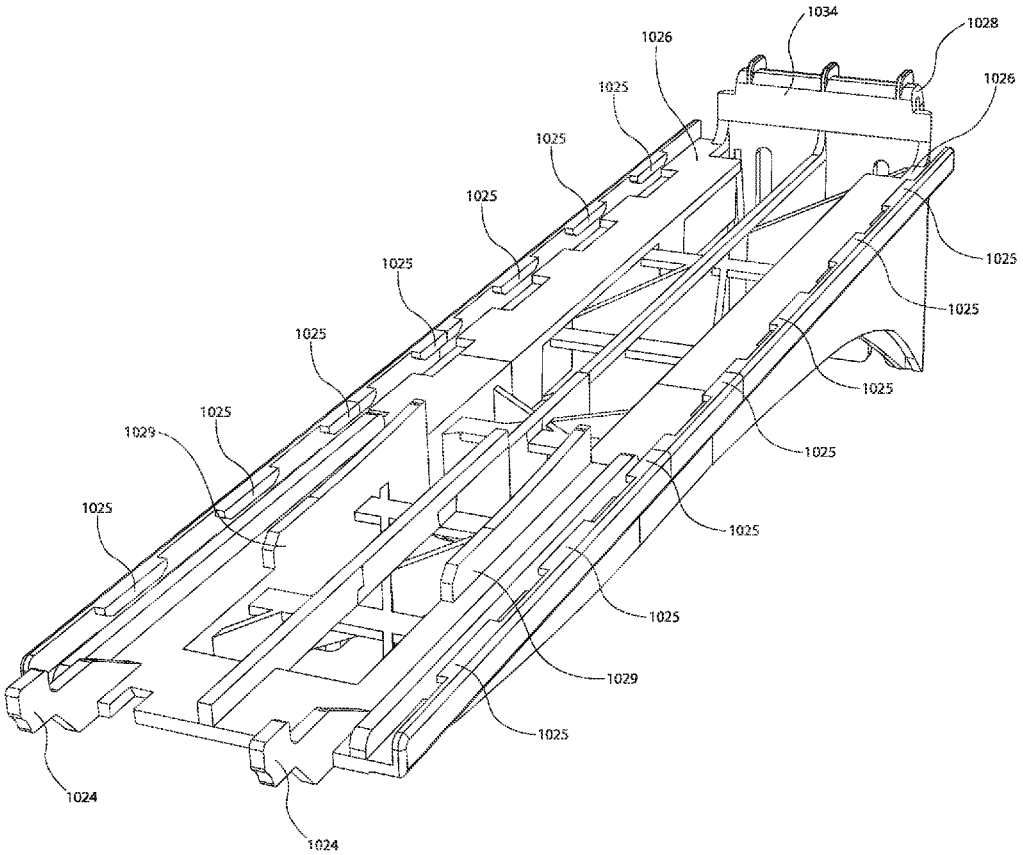
FIG. 23 illustrates a top perspective view of a hanging gusset in an embodiment.

FIG. 23 shows a top perspective view of the hanging gusset 1011 which may have one or more front retainer teeth 1024 which may be sized and/or configured to limit forward movement of the pusher paddle 1015 and/or to allow release of force and/or pressure between the pusher paddle 1015, the one or more products 3300, and the front plate 1013 during product loading and/or product rotation. For example, when the pusher track 1010 may pulled outward, the one or more teeth 1024 may force the pusher paddle 1015 to stay behind or may hold the pusher paddle 1015 from moving forward with the pusher track 1010. As a result, a gap may be created, produced and/or formed between the pusher paddle 1015 and the front plate 1013 which may be utilized for product loading and/or product rotation.

The hanging gusset 1011 may have one or more upper gusset teeth 1025 which may be sized and/or configured to be an upper limit for physical interface between the pusher track rail 1022 of the pusher track 1010 and the hanging gusset 1011. The hanging gusset 1011 may have one or more lower gusset surfaces 126 which may be sized and/or configured to be a lower limit of the physical interface between the pusher track rail 1022 of the pusher track 1010 and the hanging gusset 1011. In an embodiment, the lower gusset surfaces 126 may be sized and/or configured to work along with and/or to cooperate with the upper gusset teeth 1025 to lock the pusher track rail 1022 into a sliding path for the pusher track rail 1022. As a result, the pusher track rail 1022 may be locked, secured and/or fastened into the sliding path via the upper gusset teeth 1025 and/or the lower gusset surfaces 126. The hanging gusset 1011 may have one or more rear gusset hooks 1028, which may be sized and/or configured to wrap around a top of the bar mount bracket 1016. As a result, an assembly of the pusher track 1010 and the hanging gusset may be stiffened and/or strengthened and/or made to be more rigid via the rear gusset hooks 1028 and/or the top of the bar mount bracket 1016. The hanging gusset 1011 may have one or more rear gusset wall 1034 which may be sized and/or configured to be a rearward limit to the linear motion of and/or on the pusher track 1010.

Figure 24:
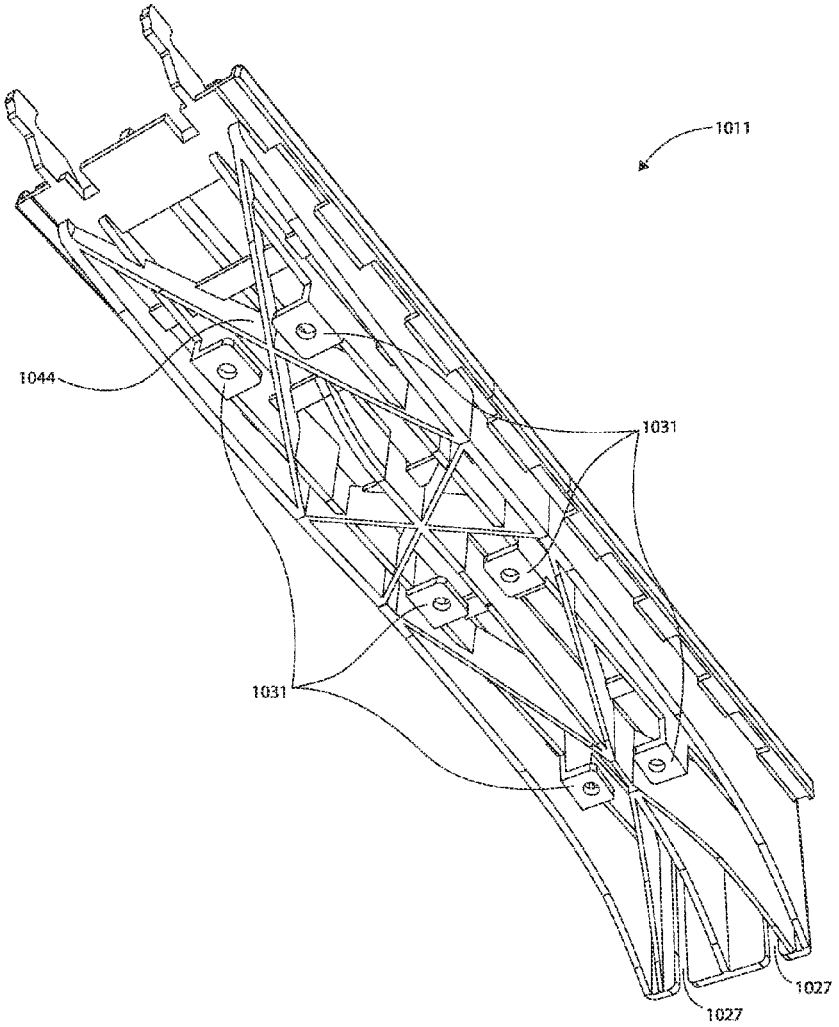
FIG. 24 illustrates a bottom perspective view of a hanging gusset in an embodiment.
Figure 29A:
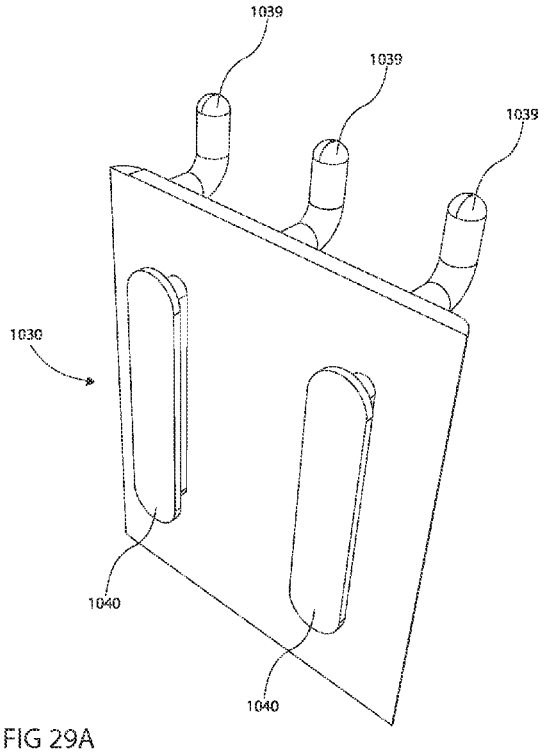
FIG. 29A illustrates a perspective view of a peg mount bracket in an embodiment.
Figure 29B:
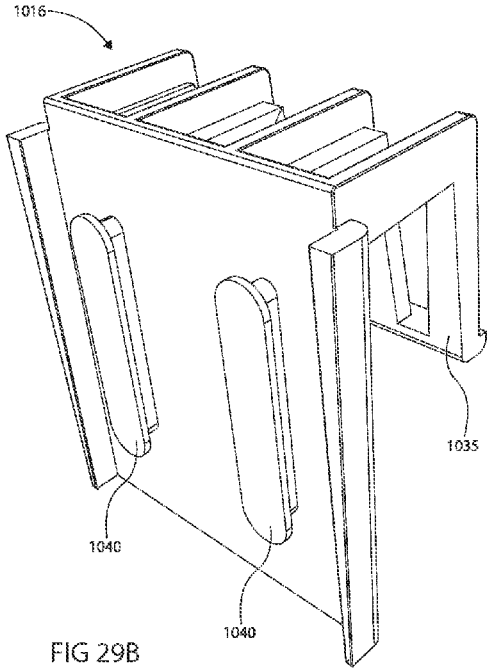
FIG. 29B illustrates a perspective view of a bar mount bracket in an embodiment.

FIG. 24 shows a bottom side of the hanging gusset 1011 having one or more rear vertical slots 1027 which may be sized and/or configured to be a female interface between the hanging gusset 1011 and a vertical bracket track 1040 on bar mount bracket 1016 and/or peg mount bracket 1030 (as shown in FIGS. 29A and 29B). The hanging gusset 1011 may have one or more baffle mounts 1031 which may be sized and/or configured to be one or more mounting points for hardware which may hold the horizontal baffle in place, used to facilitate directional airflow within a refrigerated environment (not shown in drawings). The hanging gusset 1011 may have one or more stiffening structure 1044 which may be sized and/or configured to increase stiffness of the hanging gusset 1011 and/or to airflow through the assembly of the pusher track 1010 and the hanging gusset 1011, with or without the use of the above mentioned baffle.

Figure 25A:
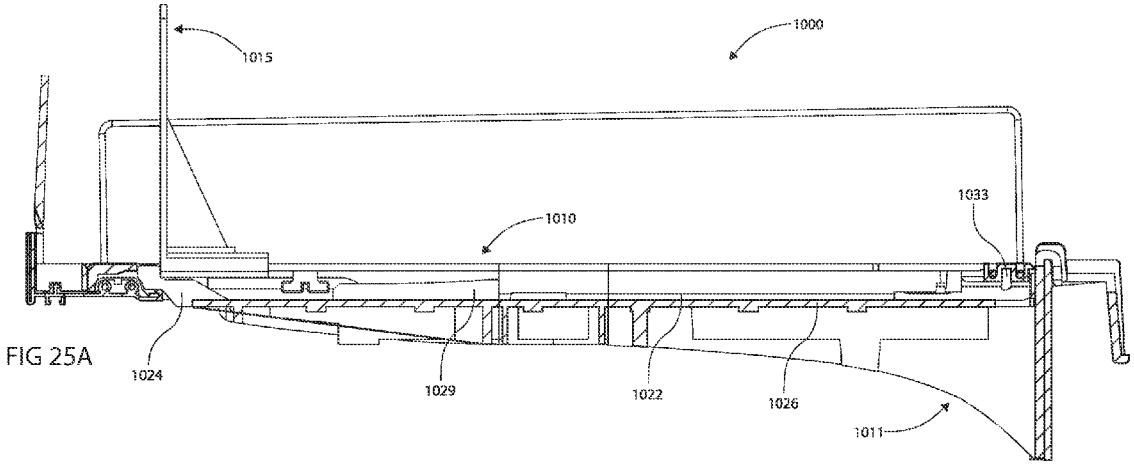
FIG. 25A illustrates a cross-sectional view of a quick-load pusher assembly located in a first position in an embodiment.
Figure 25B:
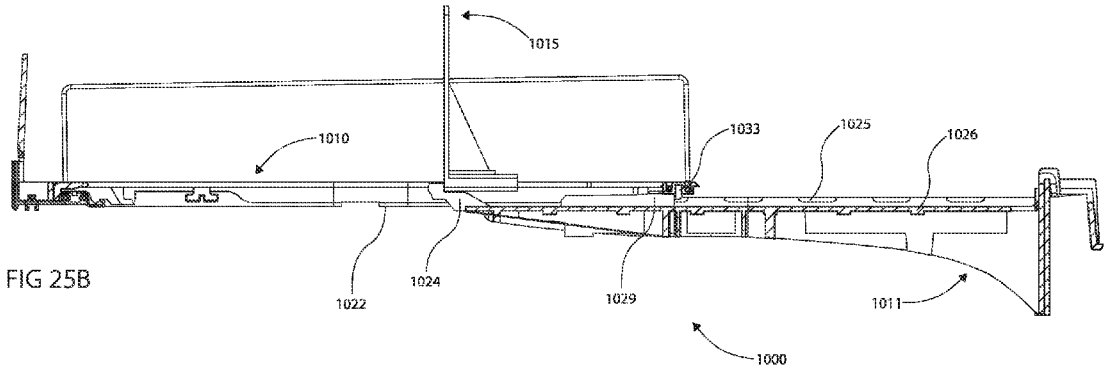
FIG. 25B illustrates a side cross-sectional view of a quick-load pusher assembly located in a second position in an embodiment.

FIGS. 25A and 25B show a pusher system configuration 5151 having the pusher system 1000 in a closed position and an open position, respectively. The pusher track 1010 may have the one or more pusher track rails 1022 which may be rails or lips along left and right sides of the pusher track 1010. The pusher track rails may slide between the upper gusset teeth 1025 and the lower gusset surface 1026 on hanging gusset 1011 which may control the pusher track 1010 front-to-back movements and side-to-side movements.

Once the pusher system 1000 may be assembled, the pusher system 1000 may be configured to allow the pusher track 1010 to move, extend, retract and/or slide longitudinally within and/or between a front limit and a rear limit of the pusher system 1000. The front limit may be dictated, formed, created and/or produced by one or more gusset ramps 1029 of the hanging gusset 1011, and the rear limit may be dictated, formed, created and/or produced by the rear gusset wall 1034 of the hanging gusset 1011. Moreover, forward longitudinal movement of the pusher paddle 1015 may be control, prevented and/or allowed via the front retainer teeth 1024 of the hanging gusset 1011. The gusset ramp 1029 may be sized and/or configured to be a locking mechanism between the pusher track 1010 and the hanging gusset 1011 and/or to limit forward movement of the pusher track 1010 on the hanging gusset 1011 through, for example, physical interface with the pusher track stopper 1033 of the hanging gusset 1011.

One purpose of this independent component retention may be, for example, to allow the pusher paddle 1015 to maintain contact pressure with the one or more products 3300 which may be within the pusher system 1000 while the pusher system 1000 may be in the closed position (see FIG. 25A), and/or to release the pressure when the pusher system 1000 may be in the opened position (see FIG. 25B). As a result, a gap may be created, formed, produced and/or provided between any remaining products 3300 within the pusher system 1000 and the pusher paddle 1015 so that new or additional products 3300 may be placed into the pusher system 1000 behind any previous or remaining products 3300.

FIG. 25A shows the pusher track 1010 may move and/or slide to a point where the pusher track terminus 1048 may make contact with the rear gusset wall 1034. As a result, the rearward motion of the pusher track 1010 may be limited by the pusher track terminus 1048 and/or the rear gusset wall 1034. In an embodiment, the pusher paddle 1015 may make contact with the front retainer teeth 1024 and force and/or pressure applied by the pusher spring may hold the pusher paddle 1015 against the front retainer teeth 1024 when, for example, there is no product 302 in the pusher system 1000.

FIG. 25B shows the pusher track 1010 may extend to a point where the pusher track stopper 1033 may be in contact with the gusset ramp 1029 which may stop the pusher track 1010 from sliding forward to any further point. The pusher paddle 1015 may remain pulled firmly against the front retainer teeth 1024 with the pusher spring in a further extended position than in FIG. 25A. In an embodiment, the pusher track rail 1022 may remain confined between the upper gusset teeth 1025 and the lower gusset surface 1026 which may provide support for this increased cantilever form.

Figure 26:
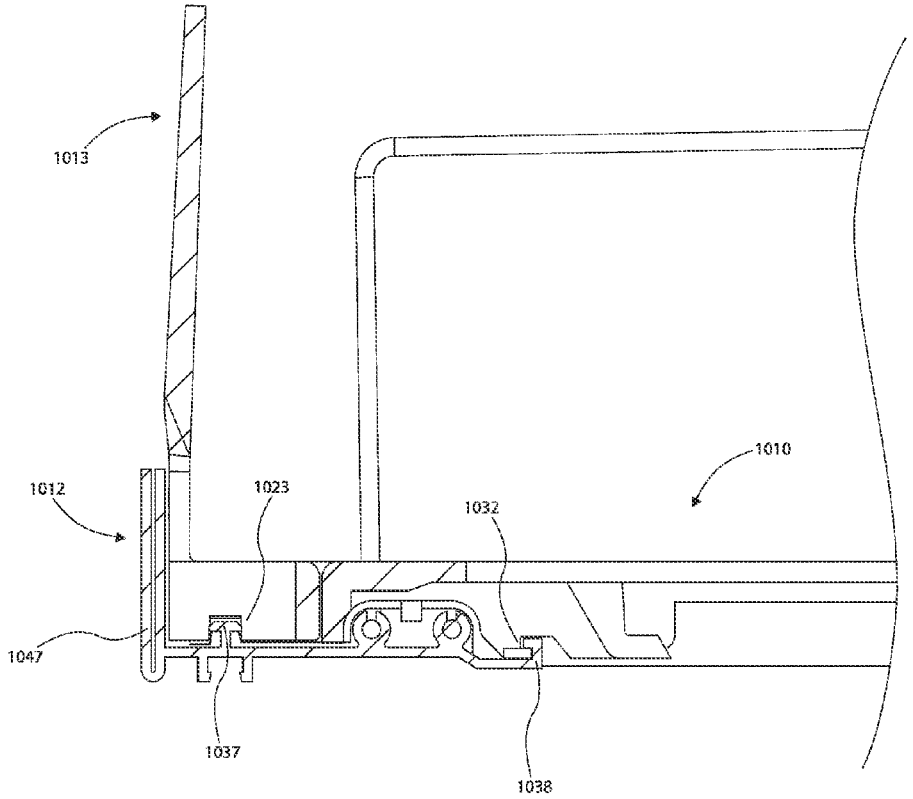
FIG. 26 illustrates a side cross-sectional view of a front portion of a quick-load pusher assembly in an embodiment.

FIG. 26 shows a cross-sectional view of the assembly of the pusher track 1010 and the hanging gusset 1011 and any interactions, at the front-side of the pusher system 1000, between the pusher track 1010 and the hanging gusset 1011. For example, a data track slot 1047 may be located or sandwiched between two front walls of data track component 1012. The data track slot may be sized and/or configured to hold a product information strip. In an embodiment, the pusher system 1000 may have frictional interfaces between the snap clip 1023 on the pusher track 1010 and a snap track 1037 on the data track component 1012. The extrusion snap track 1037 may be sized and/or configured to connect, attach, secure and/or snaps into the snap clip 1023 on the pusher track 1010. In an embodiment, the pusher system 1000 may have contact interface between an end return 1038 on the data track component 1012 and the bottom extrusion teeth 1032 on the pusher track 1010. The end return 1038 may be sized and/or configured to be a hook interface or hook mechanism with the bottom extrusion teeth 1032.

At early stages of the assembly of the pusher system 1000, the data track component 1012 may be installed onto the pusher track 1010 which may be accomplished and/or achieved in a pivoting manner, where, for example, the contact interface between the pusher tracker 1010 and the data track component 1012 may be created first. For example, data track component 1012 may be angled below the pusher track 1010, and may then be swung upward which may pivot on the contact point and/or may engage the frictional interface between the snap clip 1023 on the pusher track 1010 and the snap track 1037 on the data track component 1012.

Figure 27:
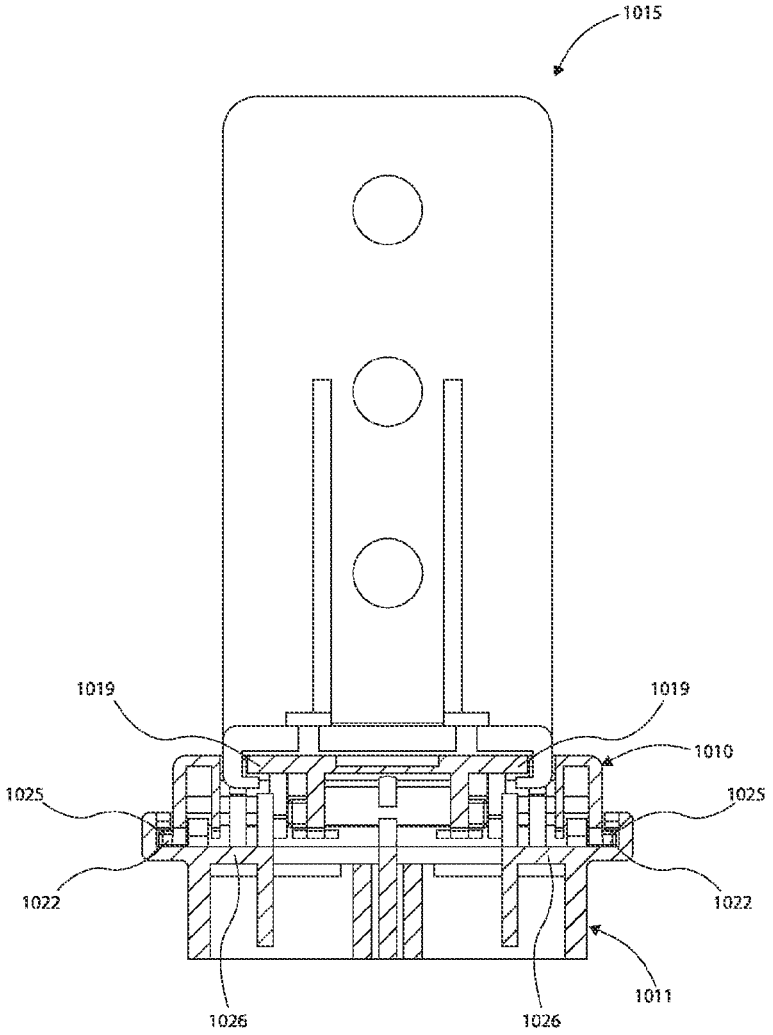
FIG. 27 illustrates a front cross-sectional view of a quick-load pusher assembly in an embodiment.

FIG. 27 shows a front cross-sectional view the pusher system 1000 which shows the pusher track 1010, the hanging gusset 1011 and the pusher paddle 1015. FIG. 27 also illustrates two front-to-back, track-like interfaces which may be provided by the pusher system 1000. For example, lower legs of the pusher paddle 1015 may connect, attach, secure, fasten and/or hook around track slots 1019 which may prevent, restrict and/or limit up-and-down movements of the pusher paddle 1015 while allowing the pusher paddle 1015 to move, extend, retract and/or slide forward and backwards with respect to the front-side of the pusher system 1000. In an embodiment, both left and right pusher track rails 1022 may be located or sandwiched between the upper gusset teeth 1025 and the lower gusset surface 1026, whereby a tolerance between these components may allow them to move freely along a central axis of the pusher system 1000.

FIG. 28A shows a perspective view of the data track component 1012 having one or more bar hook 1035 which may be sized and/or configured to connect, attach, secure, fasten and/or hook over the crossbar 403 to supporting the pusher system 1000. The data track component 1012 may have one or more extruded tube mounts 1036 which may be sized and/or configured to guide and/or assist the wire dividers 1014 along the telescoping path of the wire dividers 1014. The data track component 1012 may have one or more snap clip 1046 which may be sized and/or configured to connect, attach, fasten, secure and/or snap onto a peripheral snap track on alternate assemblies.

Figure 28B:
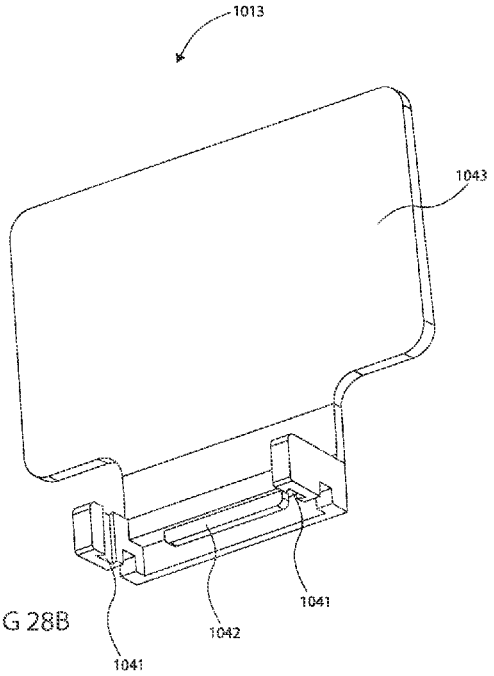
FIG. 28B illustrates a perspective view of a front plate in an embodiment.

FIG. 28B shows a perspective view of the front plate 1013 having one or more female dovetail tabs 1041 which may be sized and/or configured to be a tight frictional interface and/or precise registration creatable by connection of the female dovetail tabs 1041 and the male dovetail tabs 1020 on the pusher track 1010. The front plate 1013 may have one or more interfaces 1042 which may be sized and/or configured to interface, cooperate and/or corresponding with a stiffening cavity 1050 on the pusher track 1010. The front plate 1013 may have one or more terminal surface 1043 which may be sized and/or configured to be a forward limit for the products 3300 which may be pushed forward by the pusher paddle 1015.

FIG. 29A shows a peg mount bracket 1030 which may be sized and/or configured to connect, attach, secure, fasten and/or mount to a rear of the hanging gusset 1011. The peg mount bracket 1030 may connect, attach, secure, fasten and/or hook onto a peg board 400 to hang the pusher system 1000 from the peg board 400. In an embodiment, the peg board 400 may be, for example, a vertical pegboard and/or may have one or more holes which may be spaced about one inch from one another. It should be understood that the present disclosure should not be deemed as limited to a specific embodiment of pegboard.

The peg mount bracket 1030 may have one more peg hooks 139 which may be sized and/or configured to be inserted into the peg board 400 to support the pusher system 1000. The peg mount bracket 1030 may have one or more vertical bracket tracks 1040 which may be sized and/or configured to be male interfaces between the bar mount bracket 1016, the peg mount bracket 1030 and/or the hanging gusset 1011.

FIG. 29B shows a bar mount bracket 1016 having one or more vertical bracket tracks 1040 and/or one or more bar hooks 1035 for supporting the pusher system 1000.

Figure 30A:
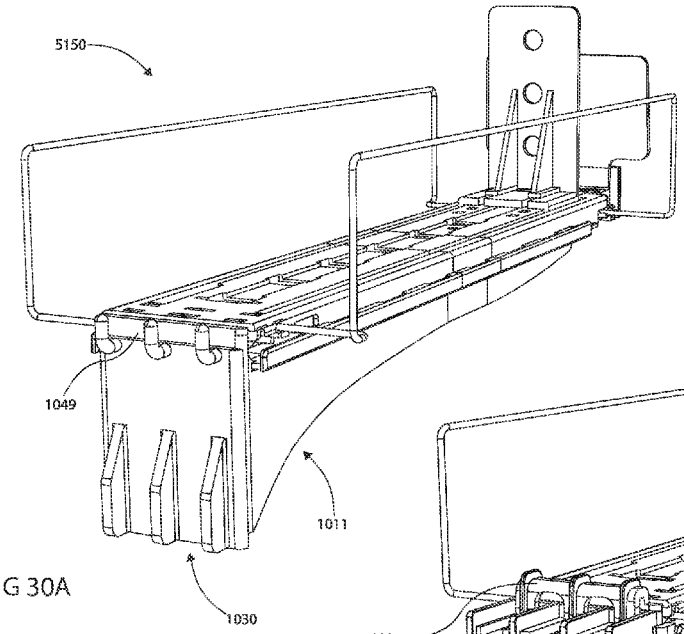
FIG. 30A illustrates a rear perspective view of a quick-load pusher assembly in an embodiment.

FIG. 30A shows pusher system configuration 5150 having the pusher system 1000 and the peg mount bracket 1030. In the pusher system configuration 5150 the rear gusset hook 1028 may have to be removed from the hanging gusset 1011 in order to maintain compatibility with the peg mount bracket 1030 and/or the peg board 400.

Figure 30B:
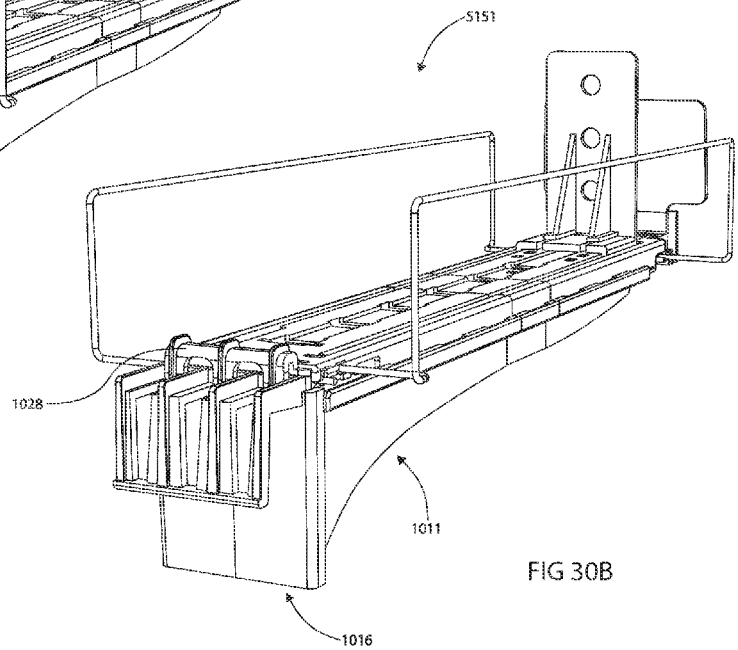
FIG. 30B illustrates a rear perspective view of a quick-load pusher assembly in an embodiment.

FIG. 30B shows pusher system configuration 5151 having the pusher system 1000 and the bar mount 1016 which may also be compatible with the crossbar 403.

FIG. 31 shows the pusher system configuration 5151 as it may appear in a retail environment. In an embodiment, a number of pusher systems 1000 may be connected, attach, secured, fastened and/or mount to, for example, a number of cross bars 403. For example, two pusher systems 1000 may be hung on each of three cross bars 403 which may, in turn, be inserted into two upright 402. For example, one or more pusher systems 1000 may be installed in series along one or more crossbars of varying lengths which may create a shelf-like presentation for the first and second products 300, 301 or the products 3300. Vertical distance(s) between each row of pusher systems 1000 may be changed and/or adjusted to suit the first and second products 300, 301 or the products 3300 which may have varying heights and/or sizes by adjusting vertical positioning of the cross bars 403 along the uprights 402. In an embodiment, the pusher system configuration 5151 and/or the pusher systems 1000 may be utilized in, for example, a common retail environment, such as, for example, aisles, refrigerators and/or the like.

FIG. 32 shows the pusher system configuration 5150 as it may appear in a retail environment. In an embodiment, the pusher system configuration 5150 may have one or more pusher systems 1000 which may be connected, attached, secured, fastened and/or mounted to the peg board 400. For example, the pusher system configuration 5150 may have six pusher systems 1000 which may be hung on a section of the peg board 400. FIG. 32 illustrates that one or more pusher system 1000 may be installed in a myriad of planar arrangements on the peg board 400. Vertical and horizontal distances between the pusher systems 1000 may be changed and/or adjusted by moving and/or altering an arrangement of the peg board brackets 30 of the pusher systems 1000 on the peg board 400.

FIG. 33 shows a variety of the pusher systems 1000 having a variety of different lengths. In order to accomplish the variations in length, the pusher tracks 1010 and the hanging gussets 1011 of the pusher systems 1000 may be injection moulded within a modular mould. By adding central inserts to the mould, parts with different lengths may be created, produced and/or formed while maintaining front and rear mould components. FIG. 33 shows four sizes available for the pusher systems 1000 along with a number of inserts which may be needed to create the different lengths.

In embodiments, the pusher systems 1000 may be comprised of individual, self-contained product holders which may eliminate a need for a traditional store shelf and may increase merchandising flexibility. The pusher systems 1000 may have an ability to be mounted to a traditional store shelf but may excel when mounted to pegboard 400 or a cross bar 403. The pusher track 1010 on which the products 302 may sit and/or may be positioned may have an ability to pull forward and out from underneath the shelf or fixture above. This improves an ease and speed of loading as a majority of the pusher track 1010 may be exposed and free from obstruction. Less vertical space may be required between product rows which may result in additional product holding power within the aisle section. Furthermore, when the pusher track 1010 may be pulled forward for loading, the pusher paddle 1015 may remain retracted, and may allow for quick two-handed loading of the products 302 into the pusher systems 1000. Unlike any other known pull-out system, a majority of components of the pusher systems 1000 including attachment brackets and structural members may be made from moulded plastic. Metal components such as the wire dividers 1014 and/or the pusher spring may be made from corrosion resistant metals for use in cold or damp locations such as coolers, fridges and freezers, drastically reducing the risk of metal corrosion within a food environment. This also may ensure that moving mechanical components may retain consistent and proper function.

As shown in FIGS. 34-50, one or more retail products 3301 (hereinafter "retail products 3301") and/or one or more retail products 3302 (hereinafter "retail products 3302") may be housed, stored, secured and/or displayed or dispensed from at least one of a quick-load pusher system 5152 (hereinafter "pusher system 5152"), a quick-load pusher system 5153 (hereinafter "pusher system 5153"), a quick-load pusher system 5154 (hereinafter "pusher system 5154"), a quick-load pusher system 5154 (hereinafter "pusher system 5154"), a quick-load pusher system 5155 (hereinafter "pusher system 5155") and/or a quick-load pusher system 5156 (hereinafter "pusher system 5156"), collectively known hereinafter as "pusher systems 5152, 5153, 5154, 5155, 5156". The retail products 3301 may be, for example, packaged products, such as, meats and/or cheese which may typically be merchandised using hanging hooks, and the retail products 3302 may be, for example, ridged packaged products, such as, frozen food packages, boxes, microwave meals which may be merchandised using a pusher system. In embodiments, the retail products 3301 and/or the retail products 3302 (collectively know hereinafter as "retail products 3301, 3302") may be similar to or the same as the first and second products 300, 301 and/or the retail products 3300.

The pusher systems 5152, 5153, 5154, 5155, 5156 may be connected, attached, mounted, fastened, joined and/or secured to a retail gondola section 405 having aisle uprights 402, a retail gondola shelf 406, a back structural lip 407 of the retail gondola shelf 406 or a back wall 408 of the gondola section 405 or a refrigerator (not shown in the drawings. In embodiments, the retail gondola section 405 may be a typical retail gondola section having a width of more than about two feet, such as, for example, about four feet, and the shelf 406 may be a typical retail gondola shelf having a depth of less than about twenty-four inches, such as, for example, about eighteen inches.

The pusher systems 5152, 5153, 5154, 5155, 5156 may comprise one or more of the following structural features and/or components, which may be connected, attached, fastened, secured, joined and/or mounted to each other and/or combinations thereof: a data Track Extrusion 1051; a first moulded air divider assembly 1052; a second moulded air divider assembly 1053; moulded air holes 1054; moulded divider rails 1055; a moulded divider body 1056; guide holes 1057; snap mounts 1058; a wide pusher paddle 1059; a hanging baffle bar assembly 1060; hanging baffle bar mounting brackets 1061; a forward leveling bar 1062; a baffle sheet 1063; a hook grip clip 1064; a Safety flange 1065; a horizontal lip shelf extrusion 1066; a vertical lip shelf extrusion 1067; a lock slot 1068; forward tube mounts 1069; in interchangeable curved front plate 1070; graphic tabs 1071; a modular baffle 1072; Baffle mounting hardware 1073; a shelf grip mount 1074; a shelf anchor clip 1075; loading lock tabs 1076; pusher track retaining clips 1077; loading lock ramps 1078; a moulded snap clip 1079; a base retainer plate 1080; base slide rails 1081; base track gripper legs 1082; a base track 1083; an adjustment Pin 1084; a T-Snap track 1085; a depth adjustment plate 1086; depth holes 1087, 1088; a horizontal flange 1090; a vertical flange 1091; a friction O-ring 1092; a loading gap 1093. One or more of the above-identified structural features and/or components may be connected, attached, secured, joined and/or mounted to each other or combinations thereof to assembly, produce and/or provide one or more of the pusher systems 5152, 5153, 5154, 5155, 5156 as shown in and illustrated by FIGS. 34-50.

The data track extrusion 1051 may be connected, attached, fixed, joined and/or secured to the front plate 1013 via an adhesive or to the pusher track 1010 via 1023 snap clip 1023 and/or the extrusion snap track 1032. The first moulded air divider assembly 1052 may extend upwardly in the vertical or substantially vertical direction to provide an adjustable horizontal barrier for retail product and/or may be connected, attached, joined, fastened and/or secured to the pusher track 1010 at the front tube mount 1069 and/or the rear tube mount 1017. The second moulded air divider assembly 1053 may extended in the vertical or substantially vertical direction to provide an adjustable horizontal barrier for retail product and/or may be connected, attached, joined, fastened and/or secured to the pusher track 1010 at the front tube mount 1069 and/or the rear tube mount 1017.

The moulded divider body 1056 may be, for example, an L-shaped divider and/or may provide support for larger bagged products which may improve functionality of the systems. The moulded divider body 1056 may have a solid plastic construction with the air holes 1054 which may help control, manage and/or maintain temperatures surrounding the retail products 3302 when the moulded divider body and the retail products 3302 are located within a refrigerated environment. The air holes 1054 may help control, manage and/or prevent cold air loss by, for example, slowing and/or channeling cold air movement between adjacent products and dividers before its eventual release into the surrounding environment. The air holes 1054 may be moulded into and/or formed or positioned within the vertical sides of the moulded divider body 1056, and the air holes 1054 may help control, manage and/or prevent cold air loss by slowing and channeling cold air movement between adjacent products and dividers before the cold air may be eventual released into the surrounding environment.

The moulded divider rails 1055 may be connected, attached and/or affixed to the moulded divider body 1056 through the guide holes 1057 and the snap mounts 1058. In an embodiment, the moulded divider rails may comprise at least one metal wire and may connect, attach, fasten or affix to the pusher track 1010 at the front tube mount 1069 and/or the rear tube mount 1017. The guide holes 1057 may be moulded into and/or formed or position on the divider body 1056 to position or affix the moulded divider rails 1055 for alignment with connection points on the pusher plate 1010. The snap mounts 1058 may fasten, lock or secure the moulded divider rails 1055 to an underside of the moulded divider body 1056 when connected, attached and/or mounted in the guide holes 1057. The friction O-ring 1092 may be formed, provided and/or located on the moulded divider rails 1055. In an embodiment, the parallel wire divider 1014 and/or the friction O-ring 1092 may be provided, positioned and/or located within the underside of pusher plate 1010 in the front and rear tube mounts 1069, 1017 which may increase friction and/or may slow horizontal movement of the connected or attached moulded divider bodies 1056.

The wide pusher paddle 1059 is a variation of pusher paddle 1015 for use with wide or heady products, such as, for example, the retail product 3301 to vertically or substantially vertically support the wide or heady products and/or to provide or exert forward pressure against the retail products 3301, 3302. The hanging baffle bar assembly 1060 may replaces modular baffle 1072 in a refrigerated environment when a row of the pusher systems 5152, 5153, 5154, 5155, 5156 may be used. The 1061 hanging baffle bar mounting brackets 1061 may connect, attach, affix and/or mount the hanging baffle bar 160 to the crossbar 403. The forward leveling bar 1062 may be utilized with the divider system 5 such that the divider system 5 may vertically settle when weight of the retail products, such as, the first and second products 300, 301 may be applied thereon. In embodiments, different retail products of varying weight (i.e., the first and second products 300, 301) may be merchandised adjacent to one another in more than one divider systems 5. The forward leveling bar 1062 may control, reduce, restrict and/or limit an amount of vertical settle of the divider systems 5. As a result, horizontal visual consistency of the divider systems 5 may be maintained and/or achieved via the forward leveling bar 1062.

In embodiments, the baffle sheet 1063 may be made from, for example, high grade durable plastic. In a refrigerated environment, the modular baffle 1072 may harness and/or may capture cool air from the rear of the fridge and/or move, direct and/or channel the cool air forward towards the front of the pusher systems 5152, 5153, 5154, 5155, 5156. As a result, a desired temperature of the forward most retail product or the retail product located at the front of the pusher system may be maintained or achieved via the modular baffle 1072.

The hook grip clip 1064 on horizontal shelf lip extrusion 1066 may connect, attach, join, fasten and/or interlock with the horizontal flange 1090. The safety flange 1065 may be connected to a back side of the crossbar 403 which may be configured or designed to fully, or at least partially, encapsulate the bar hook 1035 on the bar mount bracket 1016. As a result, the safety flange 1065 may preventing undesired separation from the crossbar 403 when excess force(s) and/or weight(s) may be applied to the pusher systems 5152, 5153, 5154, 5155, 5156. The horizontal lip shelf extrusion 1066 may connect, attach, join, fasten and/or secure a first shelf bracket assembly 5200 or second shelf bracket assembly 5210 to the back structural lip 407 via the depth adjustment plate 1086. The vertical lip shelf extrusion 1067 may connect, attach, join, fasten and/or secure one of the first and/or second shelf bracket assemblies 5200, 5210 to the back structural lip 407 via the depth adjustment plate 1089. The first shelf bracket assembly 5200 may have the horizontal lip mount 1086 along with the horizontal lip shelf extrusion 1066. The second shelf bracket assembly 5210 may have the vertical lip mount 1089 along with the vertical lip shelf extrusion 1067

The lock slot 1068 may lock, fasten and/or secure the locking pusher track 1010 in a rear or closed position with the hanging gusset 1011 via the pusher track retaining clips 1077. The forward tube mounts 1069 may guide or led the wire divider 1014 along the telescoping path of the wire divider. The interchangeable curved front plate 1070 may provide a transparent customer facing front barrier for the retail products, such as, the retail product 3300 and/or may restrict, prevent and/or limit any forward movement of, for example, the retail product 3300. The interchangeable curved front plate 1070 may connect, attach, join and/or fasten to the pusher track 1010 via the female dovetail slots 1041 to the front dovetail tabs 1020 on pusher track 1010. As a result, the interchangeable curved front plate 1070 may provide increased and/or improved spacing for merchandising bagged or irregular shaped products such as salad or the like.

The graphic tabs 1071 on the interchangeable curved front plate 1070 may affix or hold at least one horizontal graphic and/or price ticked flush against terminal surface 1043. The modular baffle 1072 may connect, attach, join, fasten and/or secure to the baffle mounts 1031 on the underside of hanging gusset 1011 via the baffle mounting hardware 1073 which may be advantageous for configurations where only a part or portion of the crossbar 403 may be occupied by the pusher system 5152 and may not require use of the baffle bar 1060. In a refrigerated environment, the modular baffle may harass, divert or capture cool air from the rear of the fridge and/or may channel, move and/or distribute the cool air forward towards the front of the pusher system 5152 which may maintain and/or achieve the desired temperature of the forward most retail products within the pusher system 5152. The baffle mounting hardware 1073 may connect, attach, join, fasten and/or secure the modular baffle 1072 to hanging gusset through the baffle mounts 1031

The shelf grip mount 1074 may have a vertical lip shelf extrusion 1067. In an embodiment, the shelf grip mount 1074 or the vertical lip shelf extrusion 1067 may be a single long track that may extend the entire with of the retail shelf on which the pusher systems 5152, 5153, 5154, 5155, 5156 may be mounted. The shelf anchor clip 1075 may have a horizontal lip shelf extrusion 1067 which may be sized and/or configured such that it may compress to pass between the shelf 406 and a back wall of the gondola 408 and/or may expands underneath the back structural lip 407 locking the shelf bracket assemblies 5200, 5210 vertically in place while still allowing for horizontal adjustability. In an embodiment, the horizontal lip self extrusion 1067 may be a plurality of smaller individual section of track. The loading lock tabs 1076 may connect, attach, join, fasten and/or secure to the loading lock ramps 1078 on the pusher track 1010 to hold the pusher track 1010 in the opened or extended position for facilitating easy product loading, unloading and/or rotating. The loading gap 1093 provides space or area for loading the retail product between the pusher front 1013 and the pusher paddle 1059 or the pusher paddle 1015 and/or may be created or formed when the pusher plate 1010 is pulled outwardly on the gusset 1011 for loading the retail products, such as, the retail products 3301 and/or the first and second products 300, 301.

The pusher track retaining clips 1077 may lock, fasten and/or secure the pusher track 1010 in the closed position against the rear gusset wall 1034 via the lock slot 1068. The loading lock ramps 1078 on the pusher track 1010 may connect, join, fasten and/or mate with the loading lock tabs 1076 on the hanging gusset 1011 to hold, maintain and/or secure the pusher track 1010 in a fixed position, such as, for example, the opened or extended position for ease of product loading. The moulded snap clip 1079 may connect, attach, join, fasten and/or affixes to a T-snap track tape 1085 which may allow and/or facilitate horizontal adjustment of the shelf bracket assemblies 5200, 5210. In an embodiment, the T-snap track tape 1085 may be a magnetic tape for connecting, attaching, joining and/or affixing to the moulded snap clip 1079.

Figure 45:
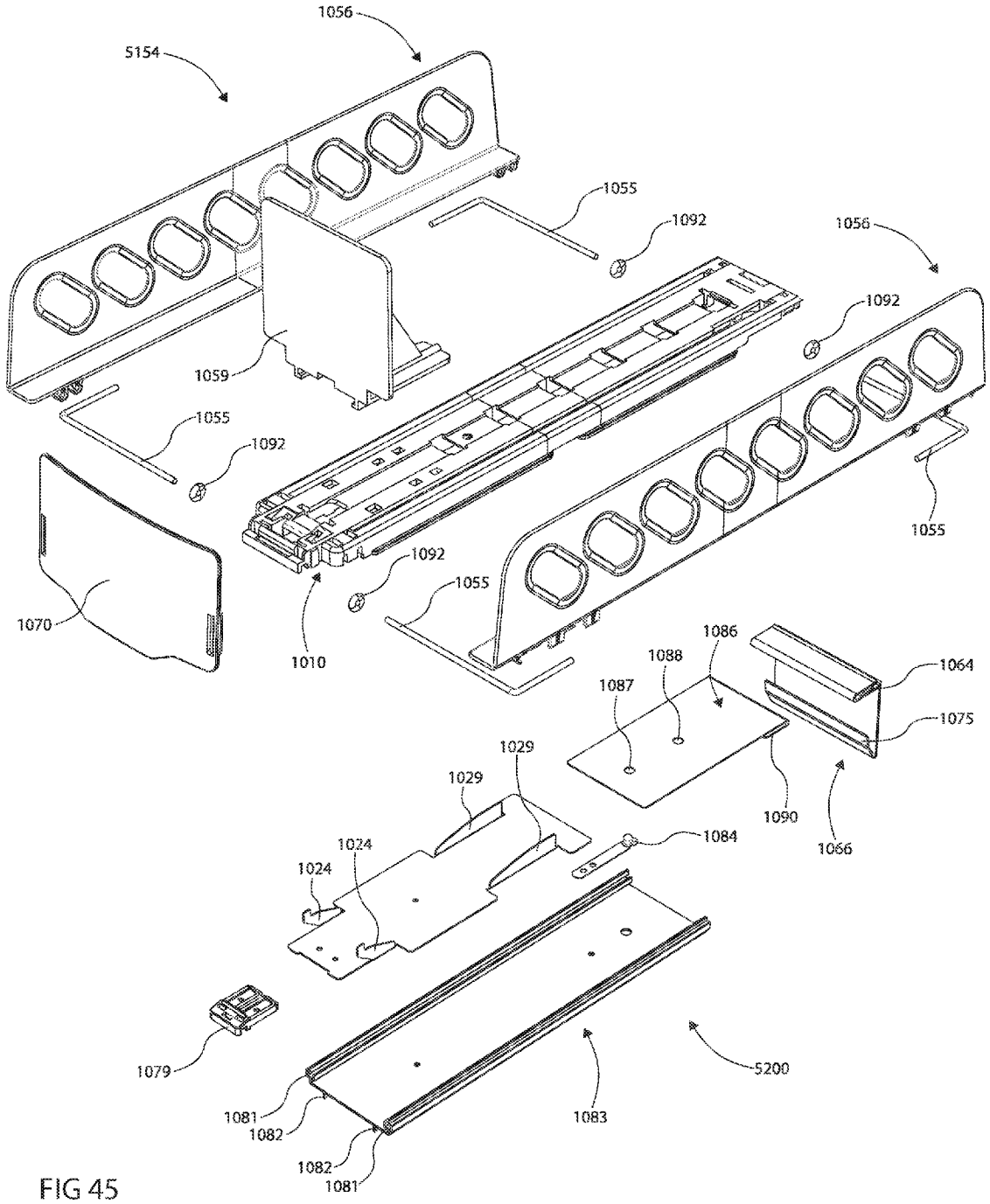
FIG. 45 illustrates an exploded perspective view of a quick-load pusher system with a shelf bracket assembly in an embodiment.
Figure 46A:
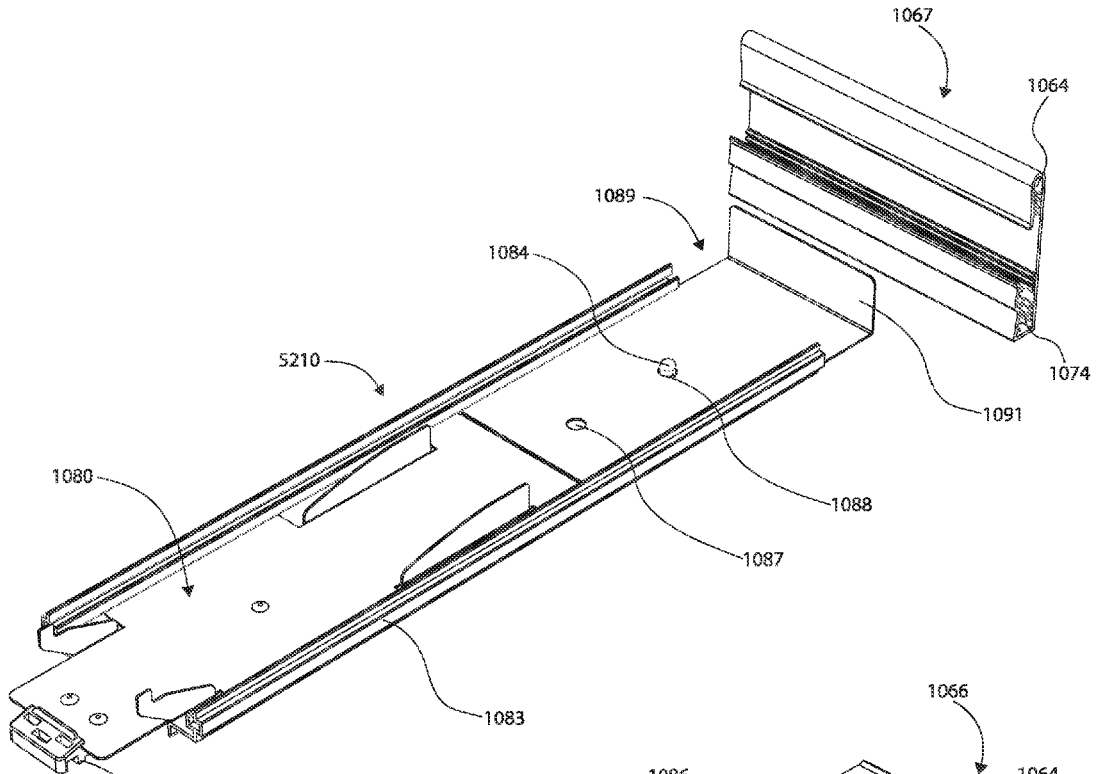
FIGS. 46A and 46B illustrate a perspective view of shelf bracket assemblies having lip mounts in embodiments.
Figure 46B:
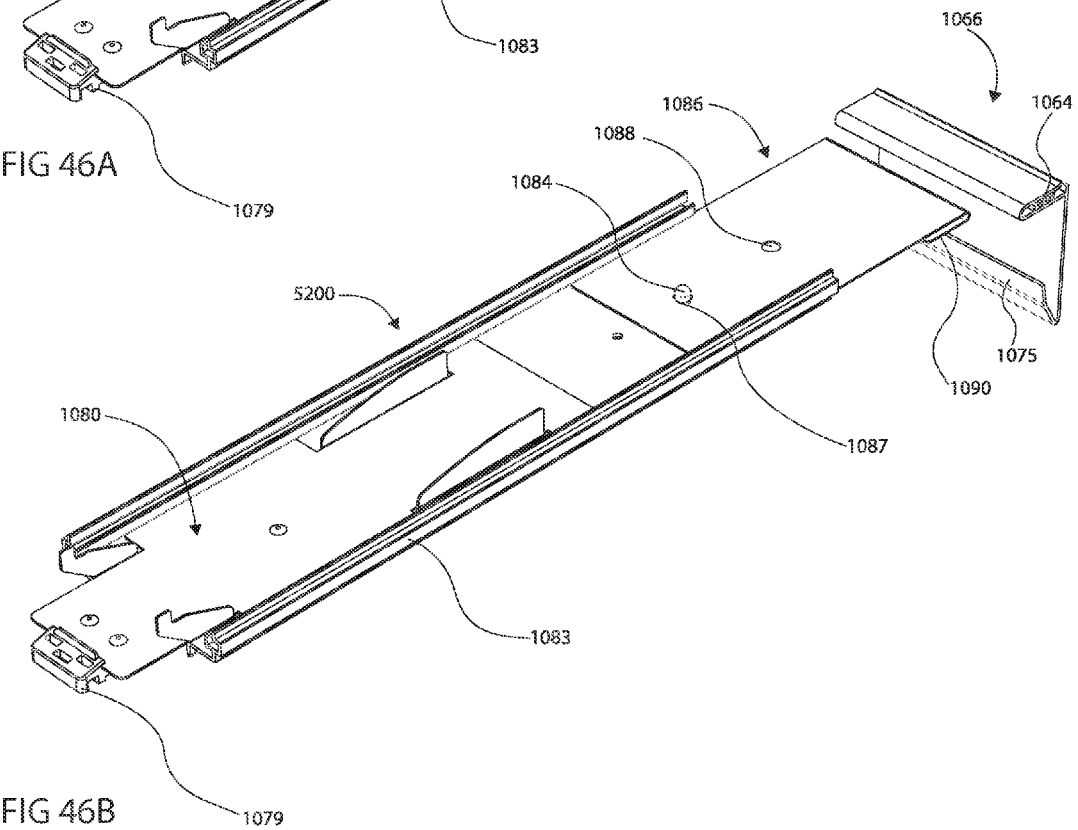

As shown in FIGS. 45, 46A and 46B, the base retainer plate 1080 may connect, attach, join, fasten and/or mount to an inside or a top side of the base rack 1083 and/or may comprise the front retainer teeth 1024 and the gusset ramps 1029 which may be used in or may facilitate connecting, attaching, joining, fastening and/or securing the pusher plate 1010 and/or positioning of the pusher paddle 1059 or the pusher paddle 1015. The base slide rails 1081 may retain the pusher track 1010 within the inside or top side of the base rack 1083. The base track gripper legs 1082 may provide friction, spacing and/or support between the shelf bracket assemblies 5200, 5210 and the retail shelf 406. The base track 1083 may be shaped, sized and/or configured to provide a main mounting platform for the shelf bracket assemblies 5200, 5210 and/or a sliding connection point for the pusher track 1010. The adjustment pin 1084 may be connected, attached, joined and/or mounted to the base track 1083 and/or may allow for adjustment of the depth adjustment plates 1086, 1089 via the depth adjustment holes 1087, 1088. The T-snap track 1085 may connect, attach, join, fasten and/or mount at least one of the shelf bracket assemblies 5200, 5210 to the retail shelf 406 via the moulded snap clip 1079

The depth adjustment plate 1086 may comprise the first depth hole 1087, the second depth hole 1088 and/or the horizontal lip or flange 1090 which may provide and/or facilitate shelf adjustment for the shelf bracket assembly 5200. As a result, the depth of the shelf bracket assembly 5200 may be adjustable to correspond to the depth of any retail shelf, such as, for example, the retail shelf 406. The horizontal flange 1090 may connect or attach to or may join, mate and/or interlock with the hook grip clip 1064 on the horizontal shelf lip extrusion 1066. The first depth hole 1087 may be formed in and/or provided on the depth adjustment plates 1086, 1089, and the second depth hole may be formed in and/or provided on the depth adjustment plates 1086, 1089. The first and second depths associated with the first and second depth holes 1087, 1088, respectively, may be, for example, less than about twenty-four inches, greater than about ten inches, about sixteen inches or about eighteen inches. For example, when the adjustable pin 1084 may be move to or positioned or located within the first depth hole 1087, the shelf bracket assembly 5200 may have a depth that may be less than when the adjustable pin 1084 may be moved to or positioned or located within the second depth hole 1088. In an embodiment, the first depth hole 1087 may correspond to a depth, for the shelf bracket assembly 5200, of about eighteen inches, and the second depth hole 1088 may correspond to a depth, for the shelf bracket assembly 5200, of about sixteen inches.

The depth adjustment plate 1089 may comprise the first depth hole 1087, the second depth hole 1088 and/or the vertical lip or flange 1091 which may provide and/or facilitate shelf adjustment for the shelf bracket assembly 5210. As a result, the depth of the shelf bracket assembly 5210 may be adjustable to the first depth corresponding to the first depth hole 1087 or to the second depth corresponding to the second depth hole 1088. The vertical flange 1091 may connect or attach to or may join, mate and/or interlock with the hook grip clip 1064 on the vertical shelf lip extrusion 1067.

Figure 34A:
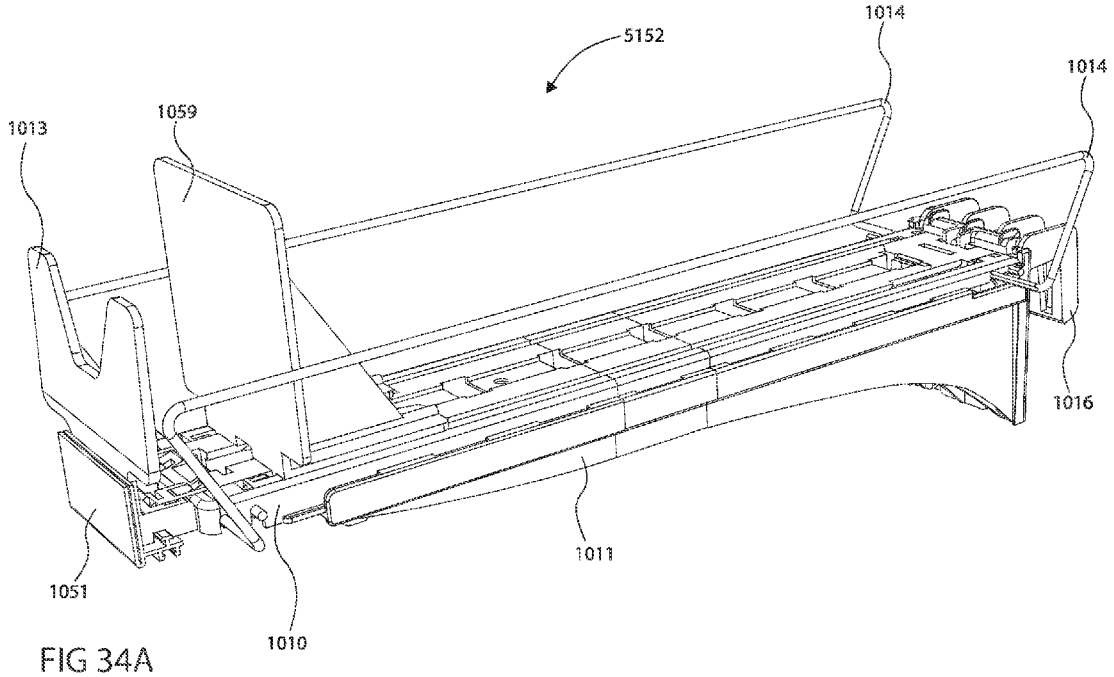
FIGS. 34A and 34B illustrate perspective views of a quick-load pusher assembly in an embodiment.
Figure 34B:
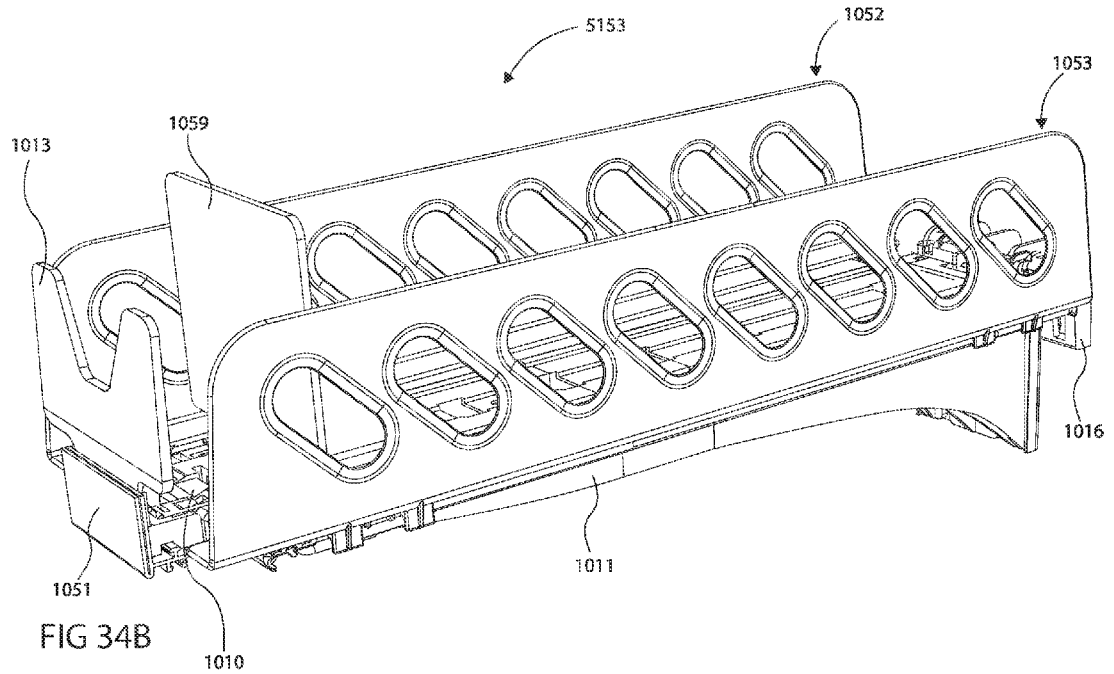
Figure 35A:
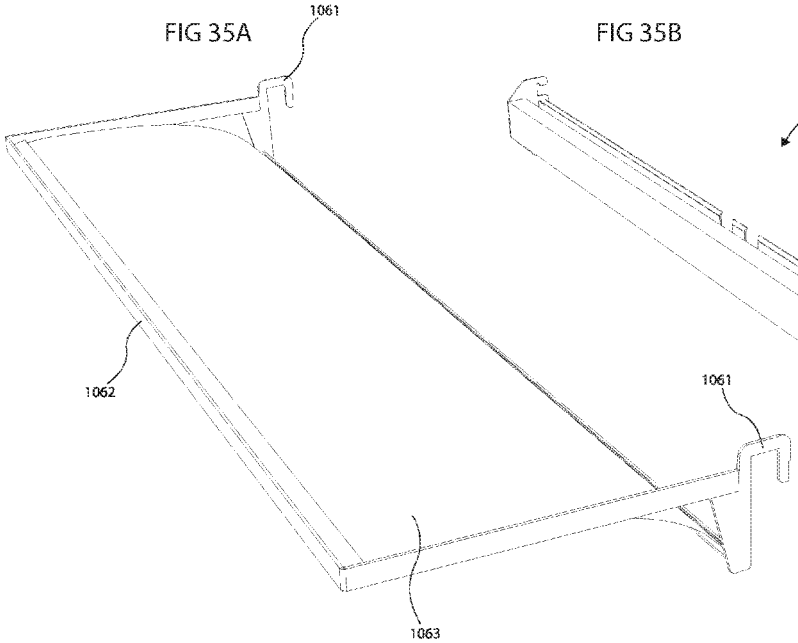
FIGS. 35A and 35B illustrate perspective views of a hanging baffle bar and a merchandising crossbar, respectively, in an embodiment.
Figure 35B:
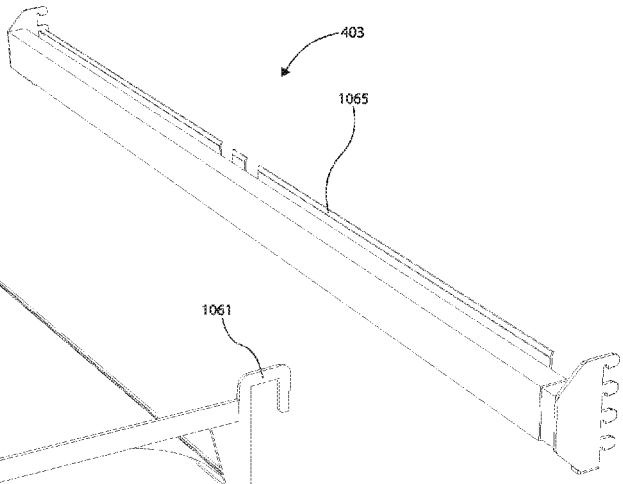
Figure 36A:
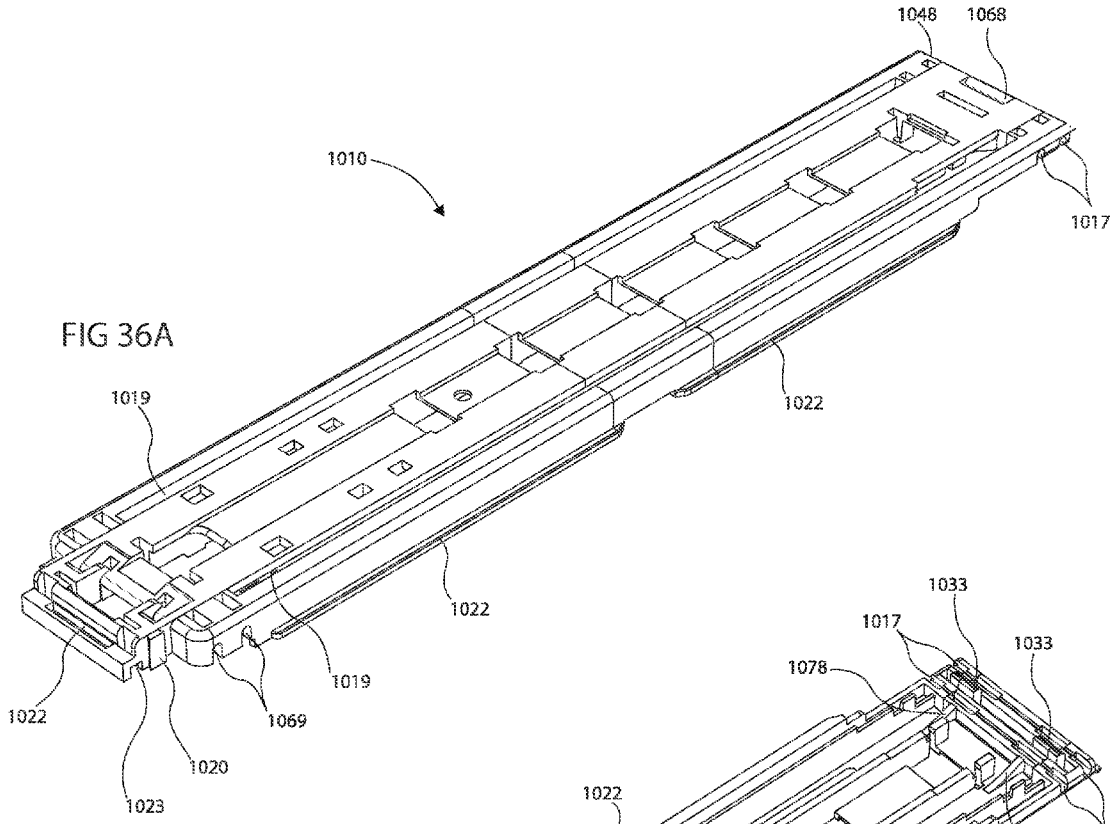
FIGS. 36A and 36B illustrate perspective views of a top side and a bottom side, respectively, of a pusher track in an embodiment.
Figure 36B:
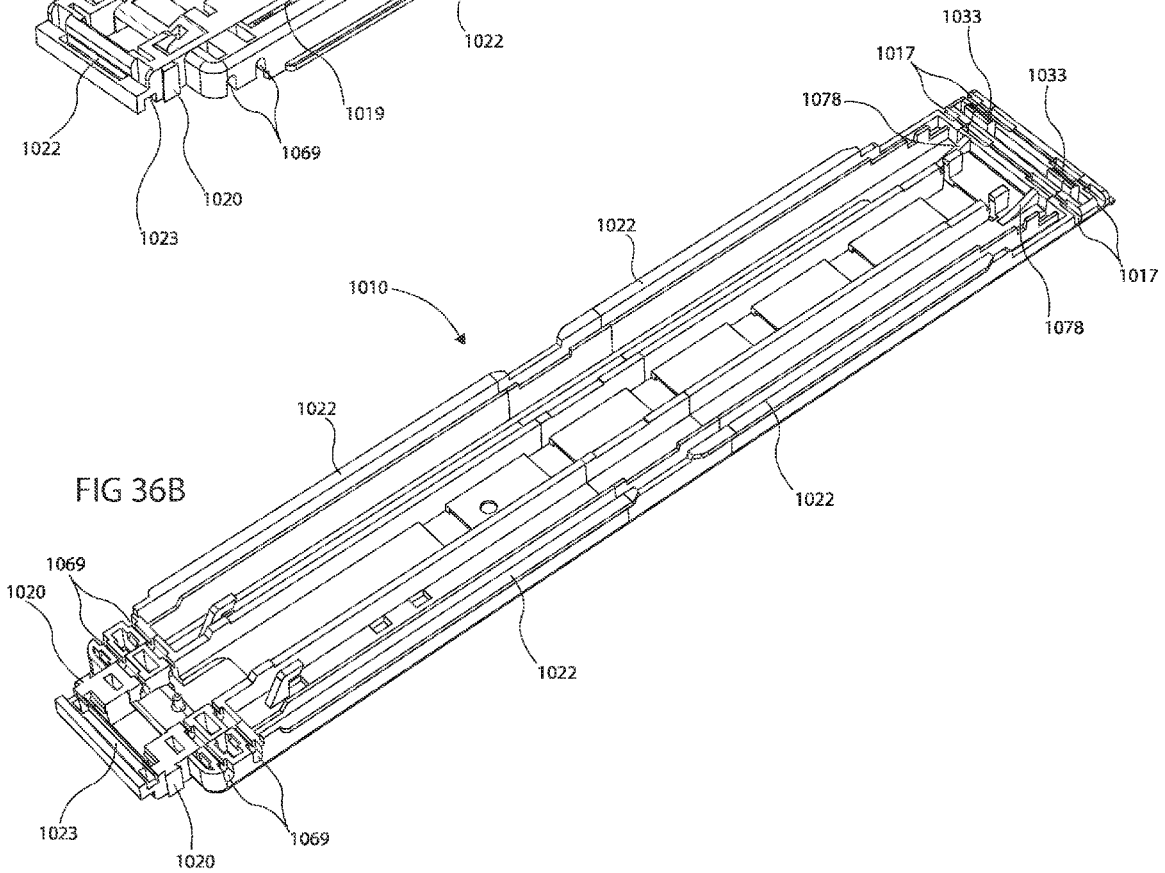
Figure 37:
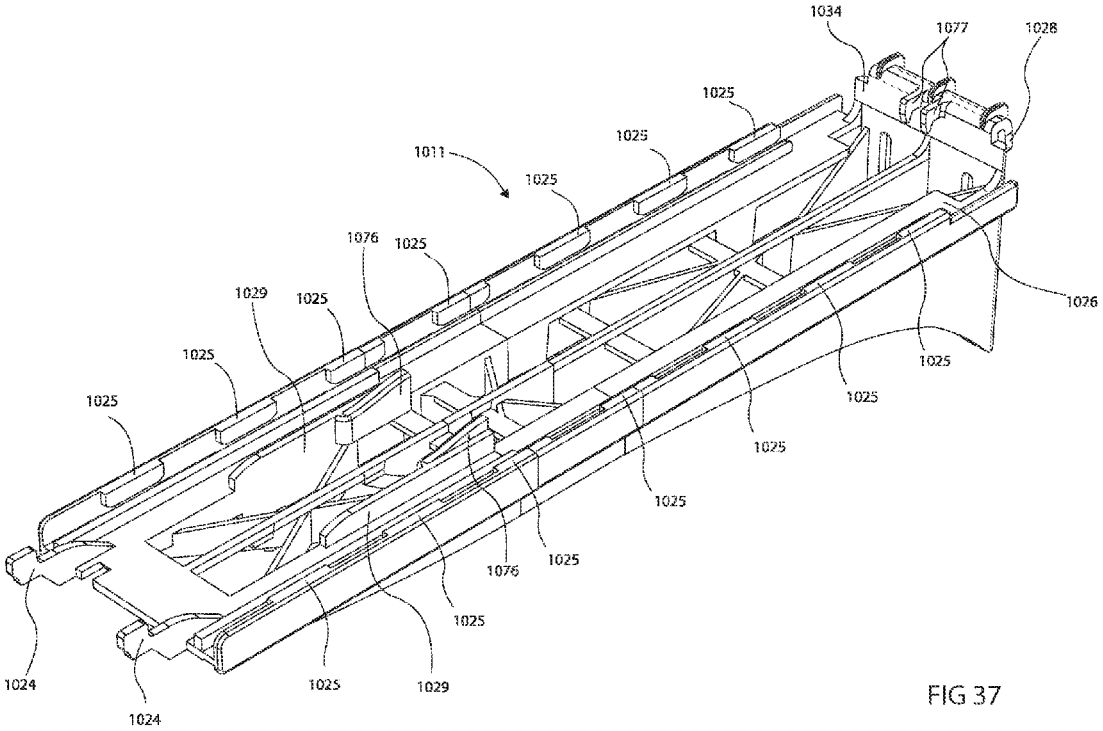
FIG. 37 illustrates a perspective view of a hanging gusset in an embodiment.

FIGS. 34A and 34B show perspective views of the pusher systems 5152, 5153 which may comprise the hanging gusset 1011 as the method or means for mounting the pusher systems 5152, 5153. FIG. 34A shows the pusher system 5152 which may also comprise the parallel wire dividers 1014, the interchangeable front plate 1013 and/or the wide pusher paddle 1059 connected through the pusher plate 1010. FIG. 34B shows the pusher system 5153 which may also comprise the first and second moulded dividers 1052, 1053, the interchangeable front plate 1013 and/or the wide pusher paddle 1059 connected the through pusher plate 1010.

Figure 38A:
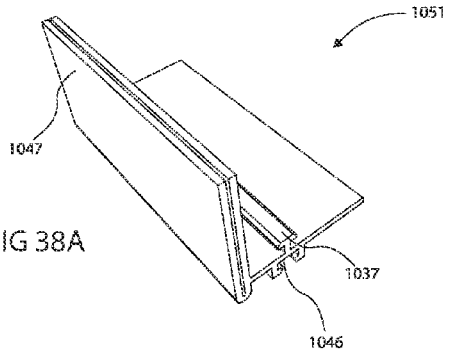
FIGS. 38A-38C illustrate perspective view of product and/or graphic retaining components in an embodiment.
Figure 38B:
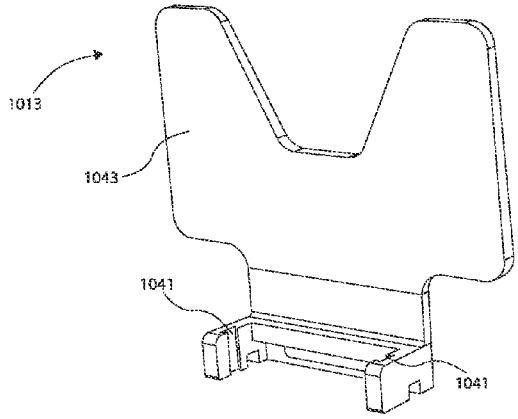
Figure 38C:
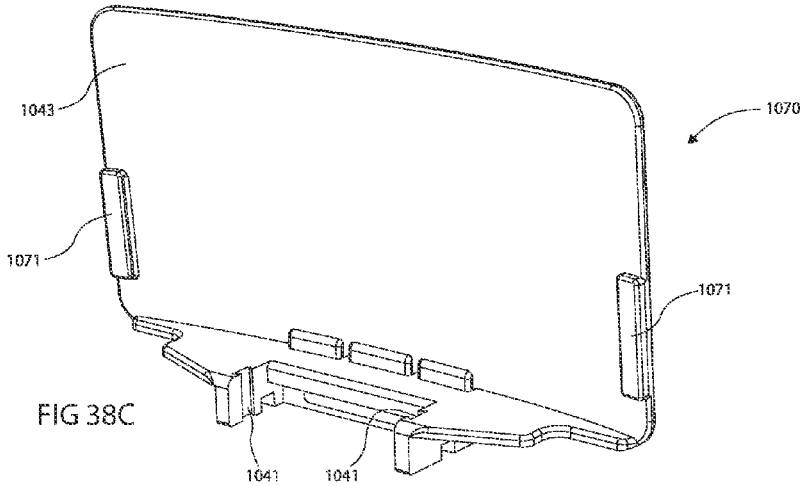
Figure 39:
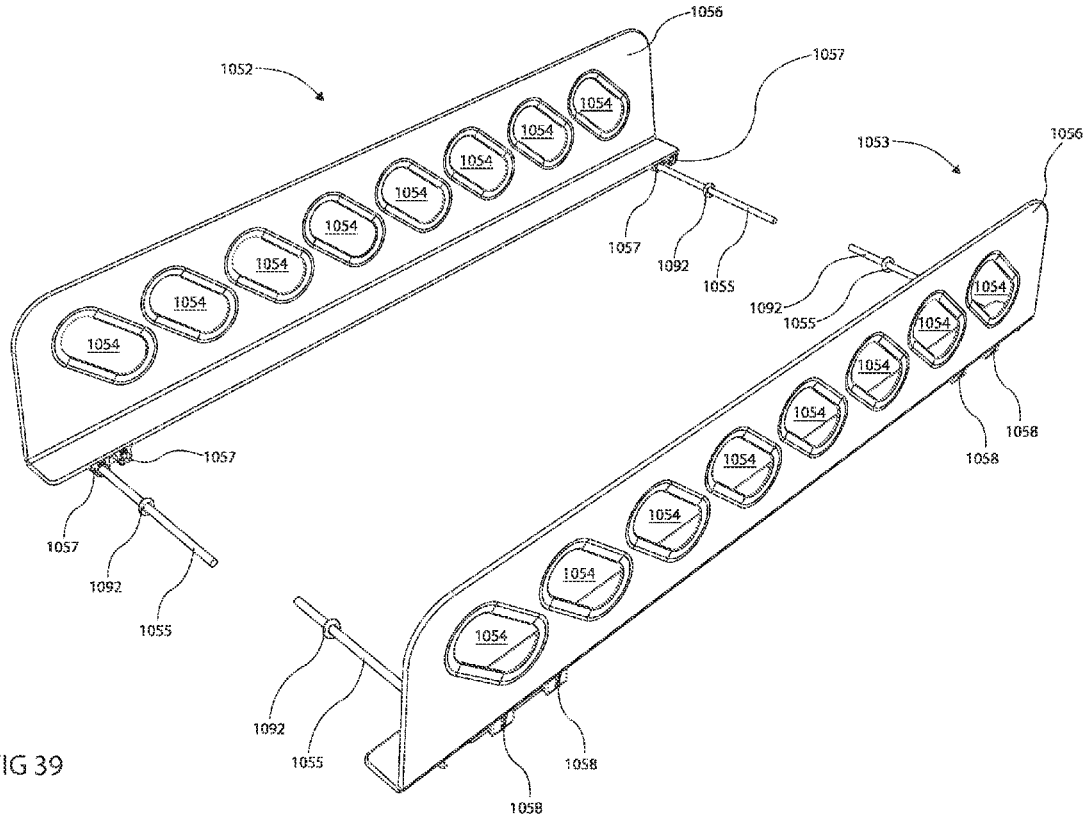
FIG. 39 illustrates perspective views of first and second divider assemblies in an embodiment.

FIGS. 38A-38C a plurality of interchangeable product and/or graphic retaining components which may be mountable to a forward section of the pusher tract 1010 via, for example, the front dovetail tabs 1020, the pusher track rail 1022 and/or the snap clip 1023. FIG. 38A shows a perspective view of the data track extrusion 1012, without the extruded tube mounts 1036, which may be mountable to a forward section of the pusher tract 1010 via the front dovetail tabs 1020, the pusher track rail 1022 and/or the snap clip 1023. FIG. 38B shows a perspective view of interchangeable front plate 1013 which may be mountable to a forward section of the pusher tract 1010 via the front dovetail tabs 1020, the pusher track rail 1022 and/or the snap clip 1023. FIG. 38C shows a perspective view of the interchangeable curved front plate 1070 which may be mountable to a forward section of the pusher tract 1010 via the front dovetail tabs 1020, the pusher track rail 1022 and/or the snap clip 1023

Figure 40:
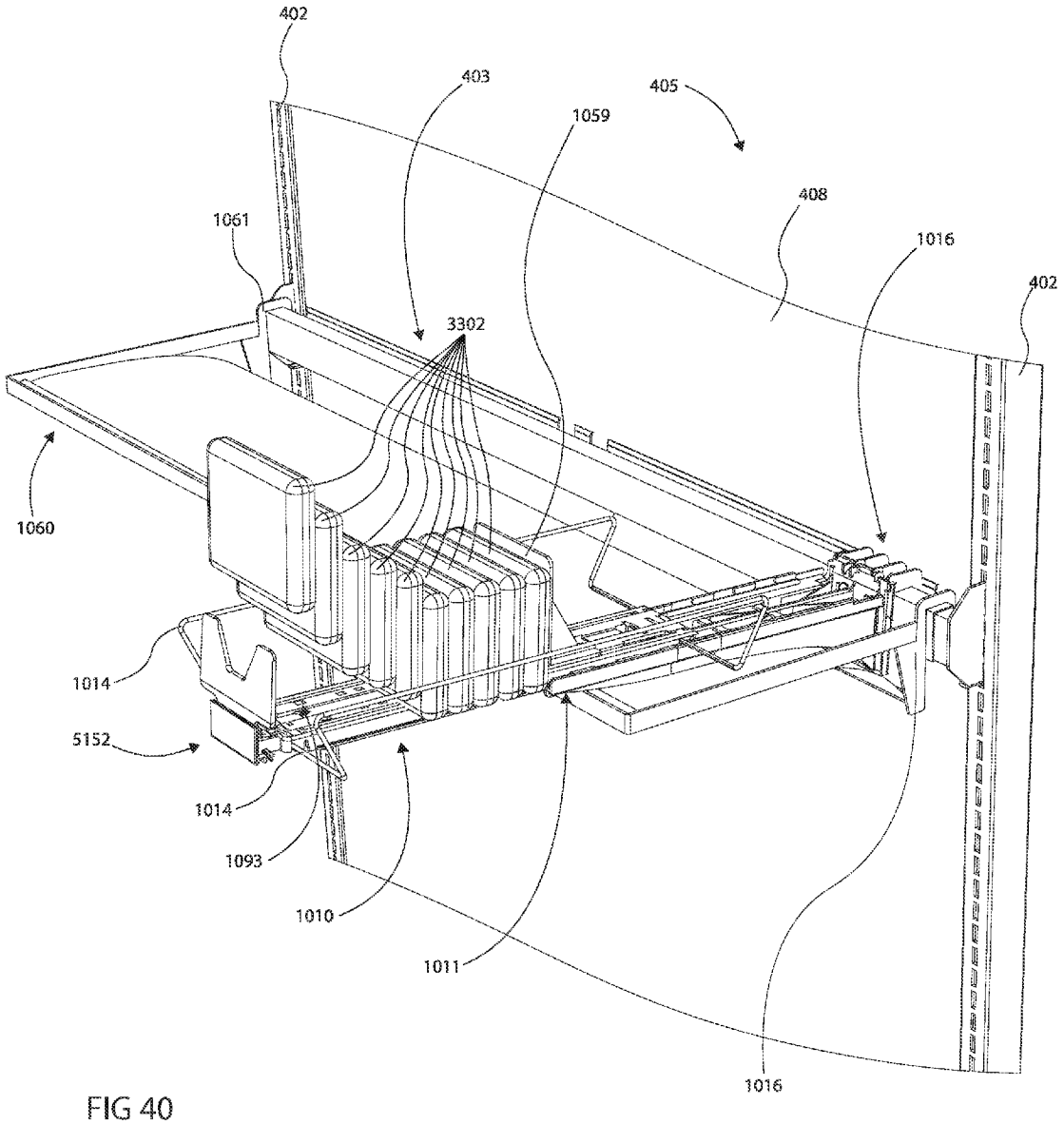
FIG. 40 illustrates a perspective view of a quick-load pusher system mounted to merchandising crossbar being loaded with retail products.

FIG. 40 shows a perspective view of the pusher system 5152 which may be mounted to the crossbar 403. The pusher system 5152 may be opened or extended and locked for loading as shown in FIG. 41C with the retail products 3302 which may be loaded into the loading gap 1093 on the pusher plate 1010 between the parallel wire dividers 1014

Figure 41A:
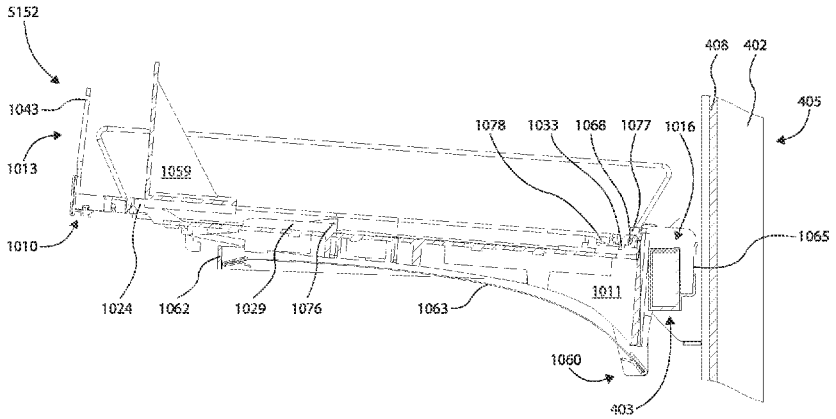
FIGS. 41A-41D illustrate cross-sectional view of a quick-load pusher system mounted to a retail gondola section being opened, loaded with retail products, and closed in an embodiment.

FIGS. 41A-AD show cross-sectional views of the pusher system 5152 and depicts steps and mechanical interactions between structural components of the pusher system 5152 while the pusher system 5152 may be loaded with retail products 3301. FIGS. 41A-D shows the pusher system 5152 mounted to gondola section 405 via the crossbar 403 mounted to the uprights 402. The hanging gusset 1063 is mounted to the crossbar 403 via the bar mount bracket 1016 and is secured to the crossbar 403 by the safety flange 1065. The hanging baffle bar assembly 1060 may also be mounted to the crossbar 403.

Figure 41B:
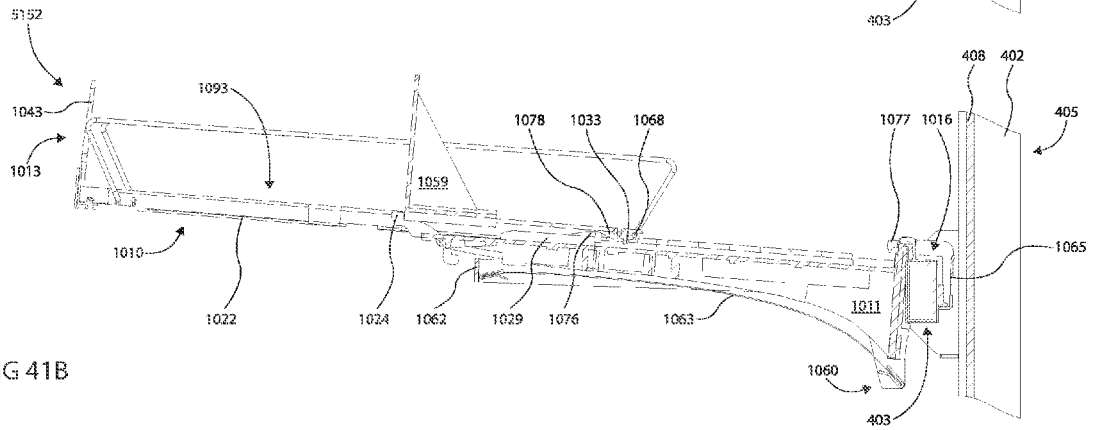

FIG. 41A shows the pusher system 5152 located in the closed position with the pusher plate 1010 held in place or in a fixed position by the pusher track retaining clips 1077 which may be connected, attached, joined, fastened and/or secured through the lock slot 1068. The pusher paddle 1059 is in a forward most position against the front retainer teeth 1024. FIG. 41B shows a first step in activating or utilizing the pusher system 5152 for loading the retail products 3301. The pusher plate 1010 may be pulled or moved forward on the hanging gusset 1011 which may release the pusher track retaining clips 1077. The pusher paddle 1059 is held or maintained in fixed or stationary position with respect to the hanging gusset 1011 which forms or creates the loading gap 1093. In the fixed or stationary position, the loading lock ramps 1078 begins to make contact and/or maintain contact with locking tabs 1076.

Figure 41C:
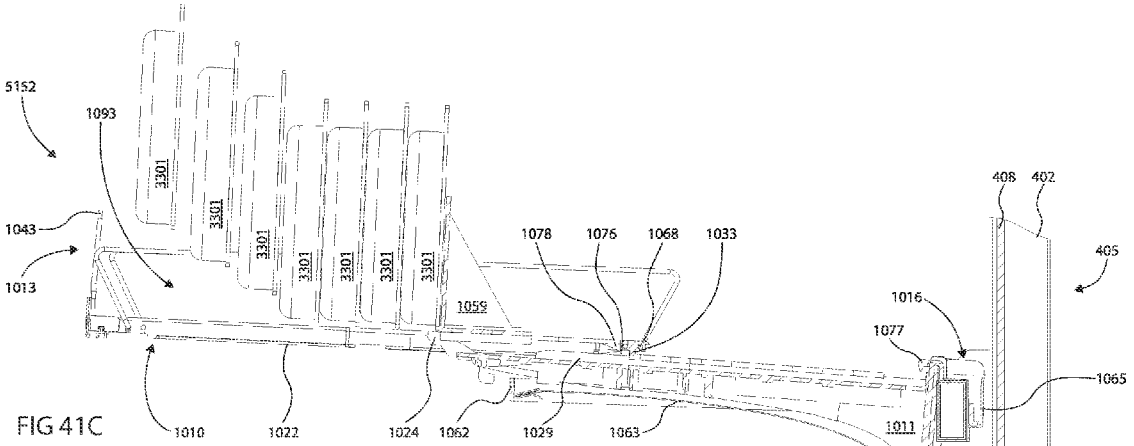
Figure 41D:
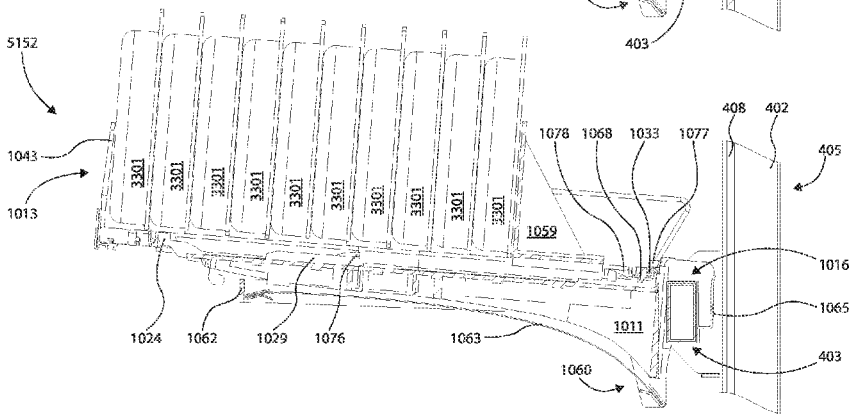

In FIG. 41C, the pusher plate 1010 may be pulled out to a further most extended position associated with the pusher plate 1010. The loading lock ramps 1078 may ride or move up and over the locking tabs 1076 until the pusher track stopper 1033 may contact or abut the locking tabs 1076. The pusher plate 1010 may now be locked in place or a fixed position for loading the retail products 3301 which may resist or counter rearward pressure or forces being applied from or exerted by the spring (not shown). The formed or created loading gap 1093 may no be loaded with the retail product 3301. FIG. 41D shows a pusher paddle 1010 pushed inwardly or back towards the rear of hanging gusset 1011 which may unlock or release the lock between the locking tabs 1076 and the locking ramps 1078. The pusher paddle 1059 may hold against the rearmost retail product 3301 as the forward most retail product 3301 may make contact with or may abut the front plate 1043. The pusher plate 1010 may slide rearwardly or back into the closed position which may make locking contact between the retaining clips 1077 and the locking tab 1078. The pusher system 5152 is now loaded and ready for dividing, pushing and/or dispensing one or more of the retail products 3301.

Figure 42:
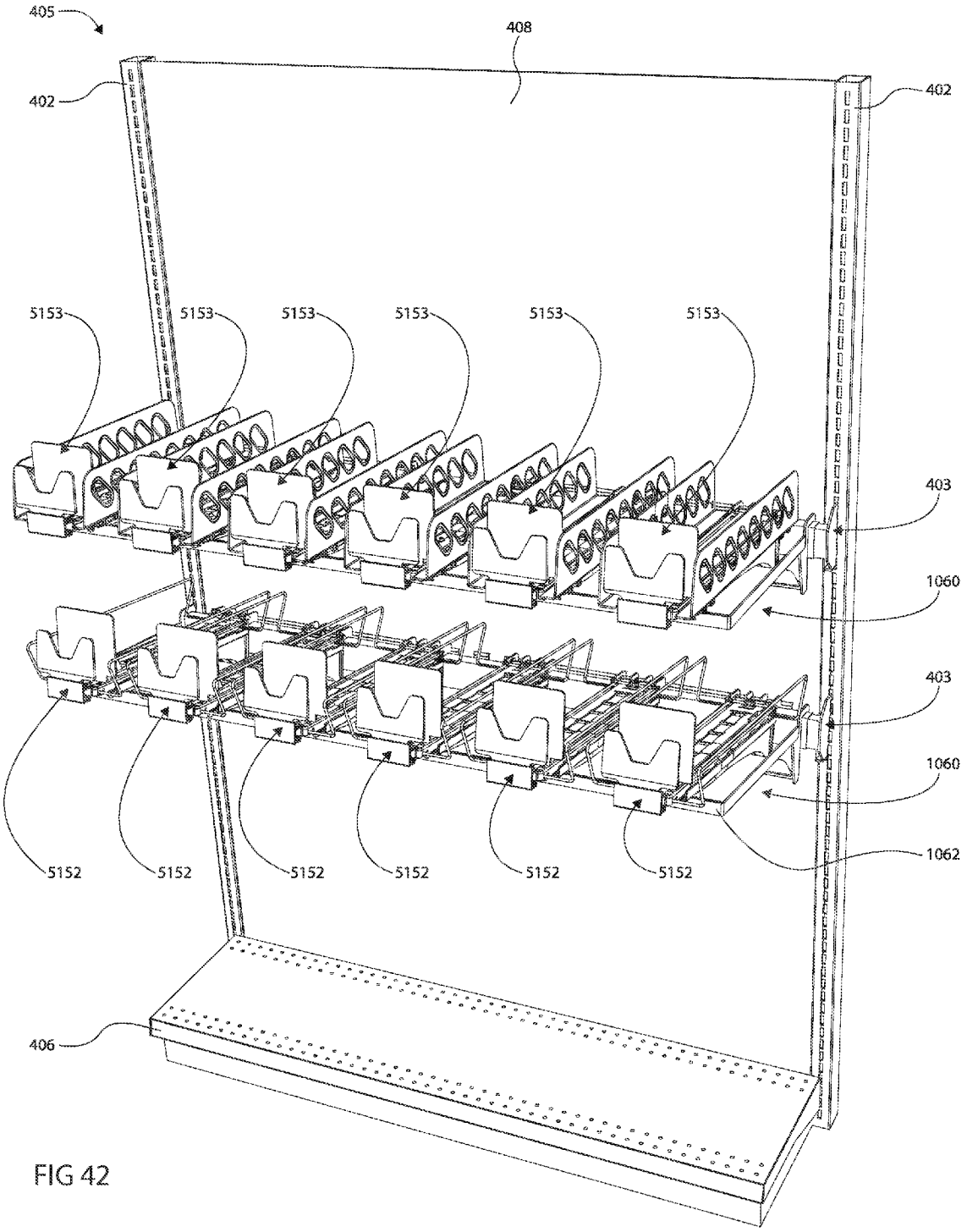
FIG. 42 illustrates a perspective view of quick-load pusher systems mounted to uprights by way of a merchandising crossbar in an embodiment.
Figure 43:
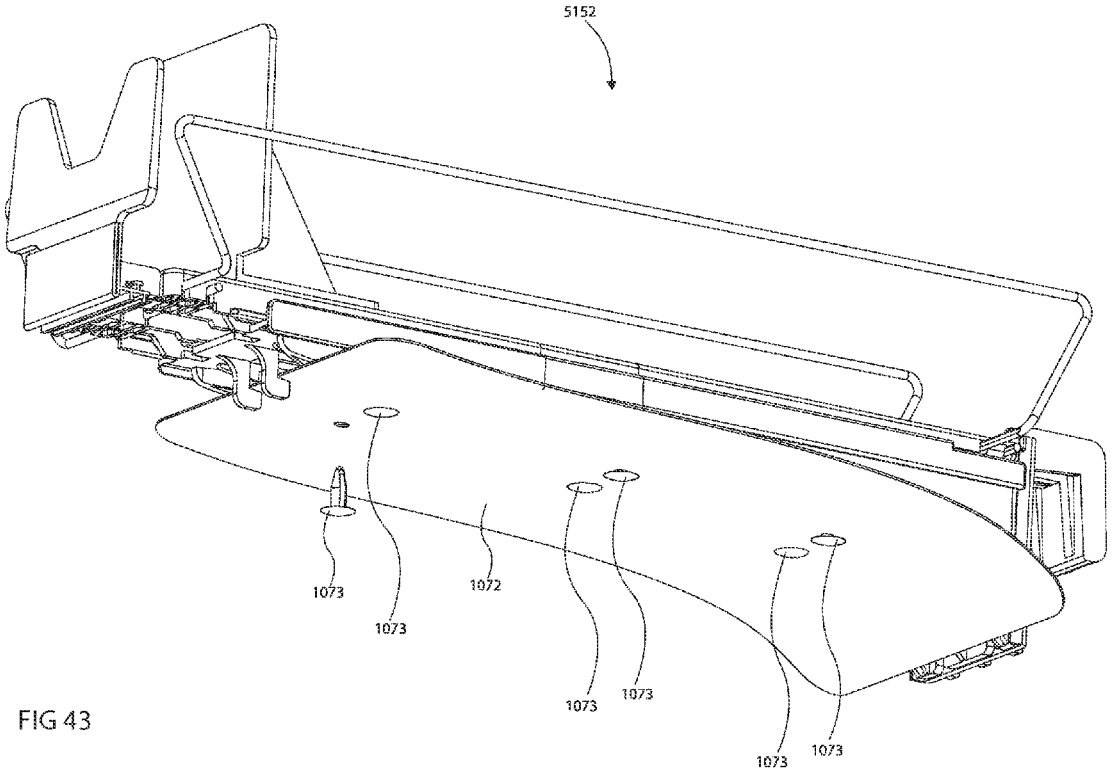
FIG. 43 illustrates a perspective view of a quick-load pusher system having a modular baffle in an embodiment.

FIG. 42 shows a plurality of pusher systems 5152, 5153 mounted to aisle or fridge gondola uprights 402 via more than one of the crossbars 403. Also attached to the crossbar 403 is the hanging baffle bar assembly 1060. FIG. 43 shows the pusher system 5152 with the modular baffle 1072 which may be mounted to the underside of the hanging gusset 1011 via the baffle mounting hardware 1073 through the baffle mounts 1031 on the hanging gusset 1011. FIG. 43 also shows one of the baffle mounting hardware 1073 is removed illustrating simple installation or removal of the modular baffles 1072. In an embodiment, the baffle mounting hardware 1073 may be a fastener, such as, for example, a pin, a screw, a rod or a tack.

Figure 44:
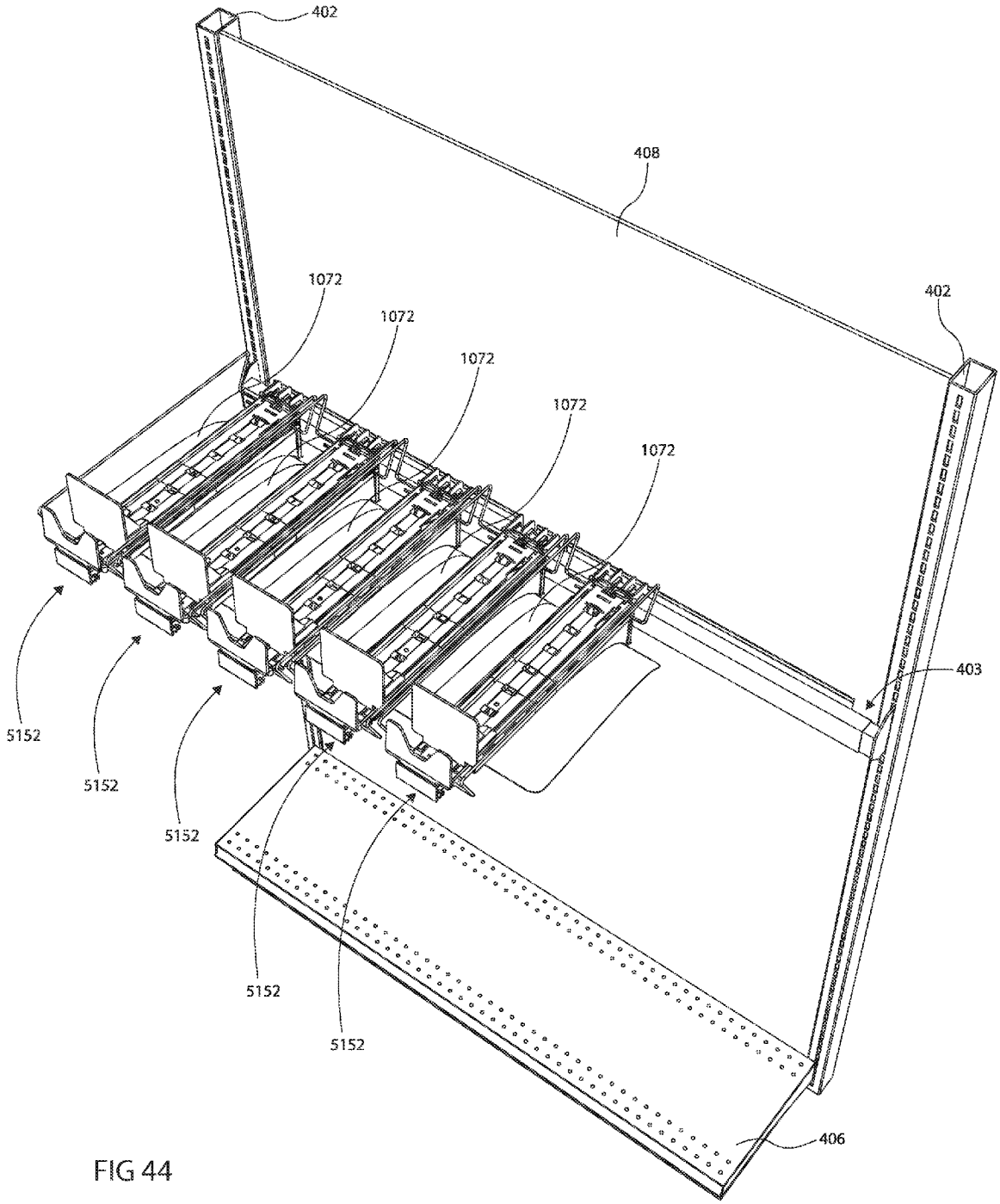
FIG. 44 illustrates a perspective view of quick-load pusher systems mounted to uprights via a merchandising crossbar in an embodiment.

FIG. 44 shows a perspective view of a plurality of the pusher systems 5152 which may be connected, attached, joined, fastened and/or mounted to uprights 402 via the crossbar 403 and/or the modular baffles 1072 in a retail environment. In an embodiment, the plurality of the pusher systems 5152 may be located, placed or positioned in, for example, a refrigerated retail environment. The modular baffles 1072 may be used in the described configuration as the number of the system hanging modules may be less than required to span a full width of crossbar 403. The modular baffles 1072 may overlap one or more adjacent modular baffles 1072; thus, limiting air loss between adjacent modular baffles 1072. FIG. 45 shows an exploded perspective view of the pusher system 5154 along with the shelf bracket assembly 5200.

FIG. 46A shows the shelf bracket assembly 5210 along with the vertical lip mount 1089. The vertical lip mount 1089 may be positioned, located in or moved to the first depth position via the adjustment pin 1084 through the second depth hole 1088 which may be connected, attached, joined and/or held within the base track 1083. The base retainer plate 1080 may be connected, attached, joined, fastened and/or secured to the base track 1083. FIG. 46B shows the shelf bracket assembly 5200 with the horizontal lip mount 1086. The horizontal lip mount 1086 may be positioned or located in or moved to the second depth position via the adjustment pin 1084 through first depth hole 1087 which may be connected, attached, joined and/or held within the base track 1083. The base retainer plate 1080 may be connected, attached, joined, fastened and/or secured to the base track 1083.

Figure 47:
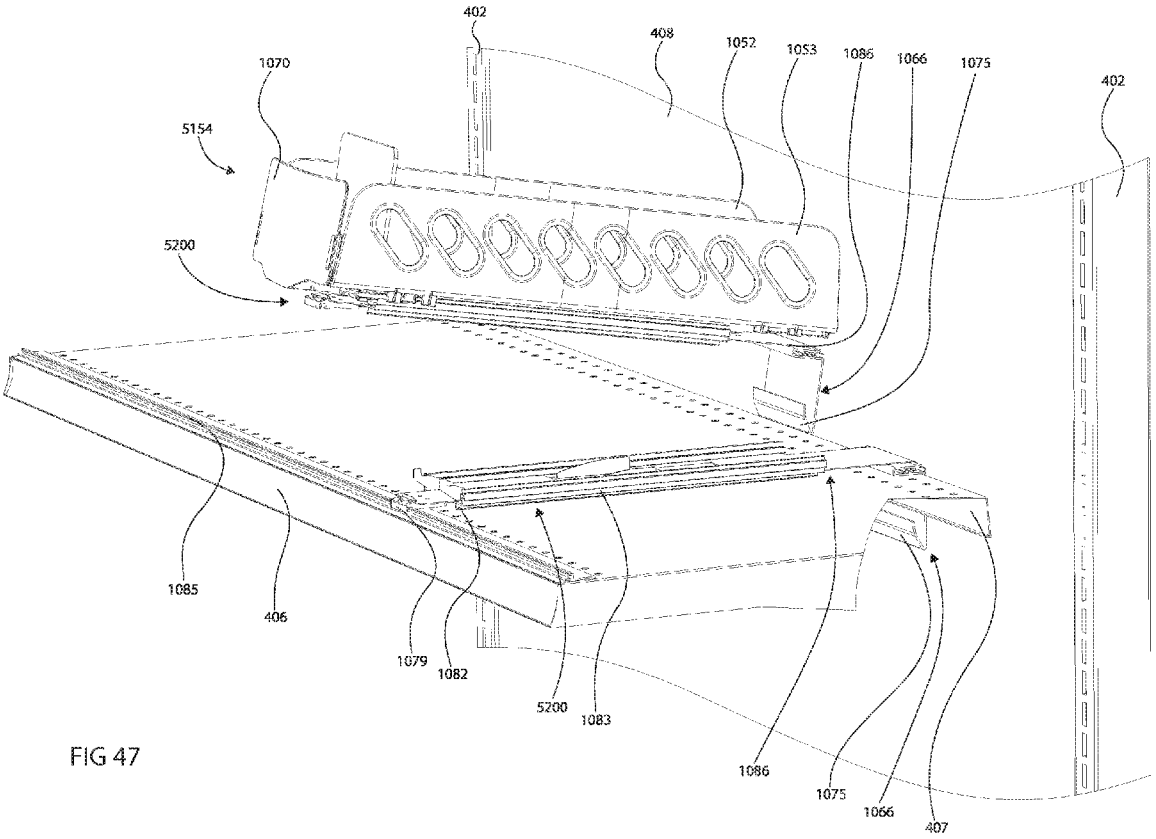
FIG. 47 illustrates a perspective view of quick-load pusher systems mounted and being mounted to a retail shelf in an embodiment.

FIG. 47 shows a perspective view of the pusher system 5154 along with the retail shelf 406. The pusher system 5154 may be connected, attached or mounted to the retail shelf 406 via the horizontal lip shelf extrusion 1066 and/or may be moved to and/or held or maintained at an upward angle as the shelf anchor clip 1075 may be forced down between back structure lip 407 and back wall of gondola 408. A Shelf bracket assembly with the horizontal lip mount 5200 may be already mounted to the retail shelf 406 with the moulded snap clip 1079 attached to the t-snap track 1085 and/or the base track gripper legs 1082 resting against the retail shelf 406. The depth adjustment plate with horizontal lip 1090 may be connected, attached and/or joined to the horizontal lip shelf extrusion 1066 and/or the shelf anchor clip 1075 may expanded below the back structure lip 407.

Figure 48:
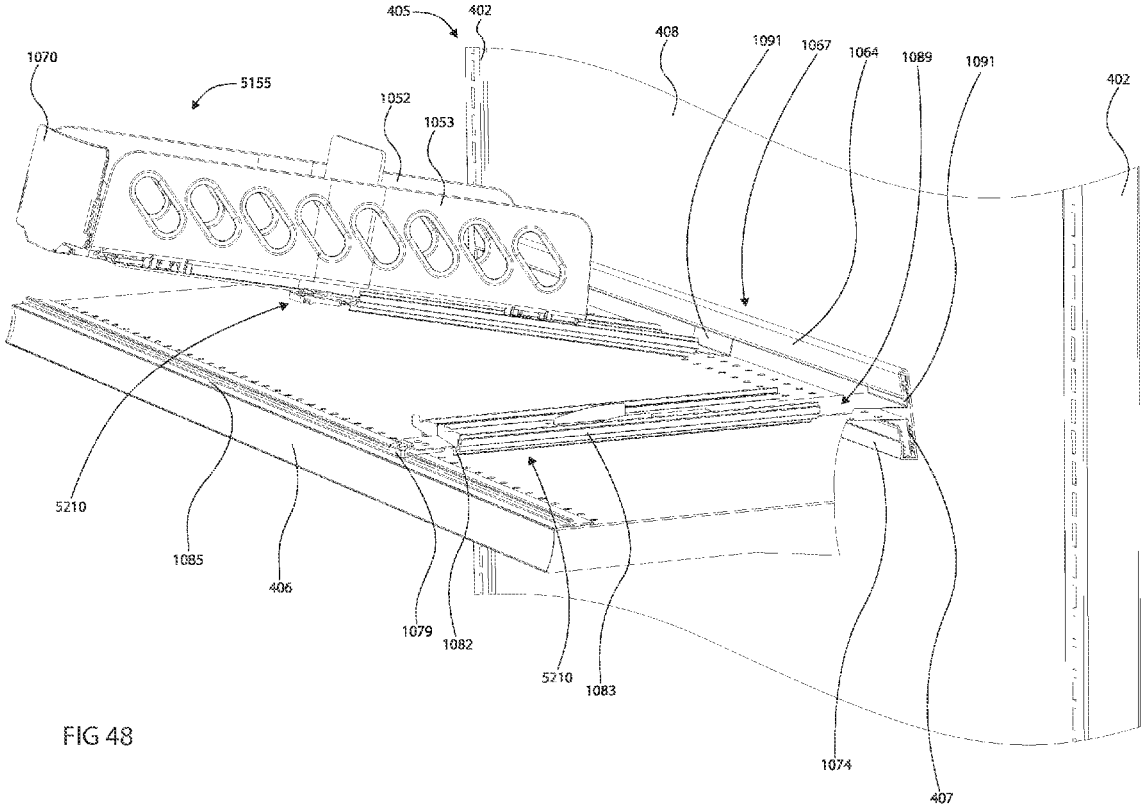
FIG. 48 illustrates a perspective view of quick-load pusher systems mounted and being mounted to a retail shelf in an embodiment.

FIG. 48 shows a perspective view of the pusher system 5155 being mounted to the retail shelf 406 via the vertical lip shelf extrusion 1064. The pusher system 5155 may be moved to and/or held or maintained at an upward angle as the vertical flange 1091 of the depth adjustment plate 1089 may be forced up into the hook grip clip 1064 of the vertical shelf lip extrusion 1067 which may be connected, attached and/or mounted to the back structure lip 407 via the shelf gripper mount 1074. A Shelf bracket assembly with the vertical lip mount 5210 may already be mounted to the retail shelf 406 with the moulded snap clip 1079 which may be connected, attached and joined to the t-snap track 1085, and/or the base track gripper legs 1082 may be resting against the retail shelf 406.

Figure 49:
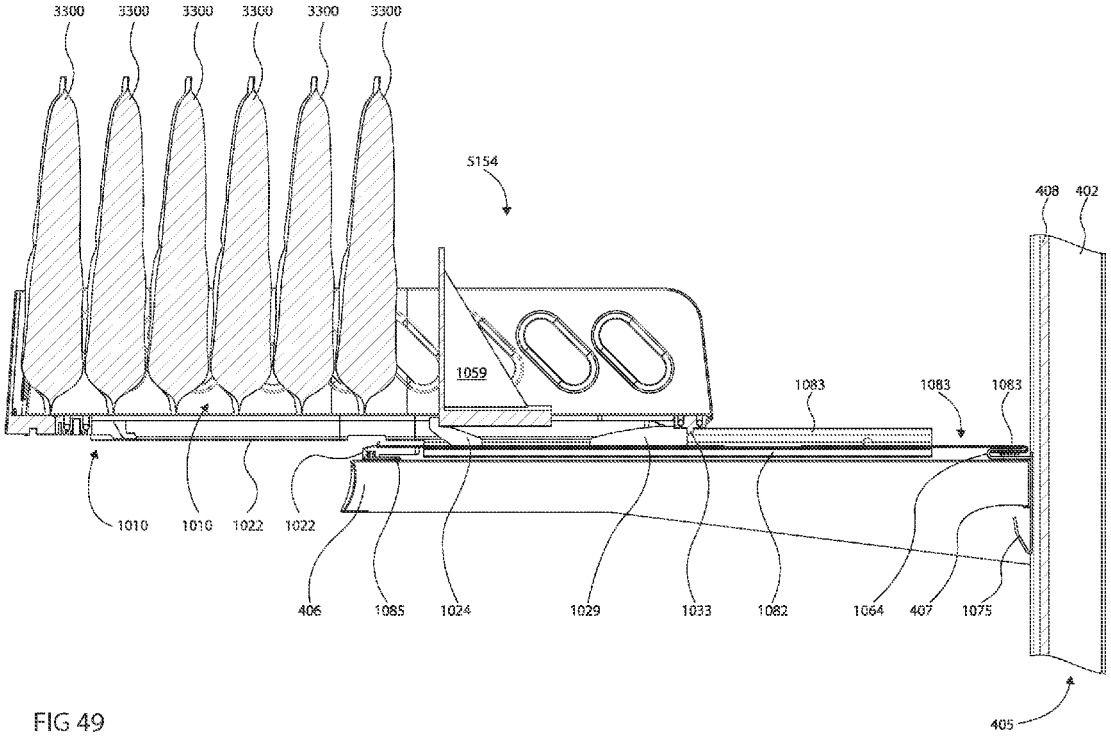
FIG. 49 illustrates a cross-sectional view of a quick-load pusher system located in an open or extended positioned and having retail products positioned therein in an embodiment.

FIG. 49 shows a cross-sectional view of the pusher system 5154 located or positioned in the opened or extended state. The pusher track 1010 may be moved and/or pulled forward within the base track 1083. As a result, the front retainer teeth 1024 may make and/or maintain contact with the pusher paddle 1059 and/or may hold the pusher paddle 1059. The pusher track stopper 1033 may move forward and/or may collide with or abut the gusset ramp 1029 thereby terminating any further extension of the pusher paddle 1059. Subsequently, the retail product 3300 may be loadable within the loading gap 1093 and the pusher track 1010 may be pushed or moved rearwardly or back towards the back wall 408 of the gondola section.

Figure 50:
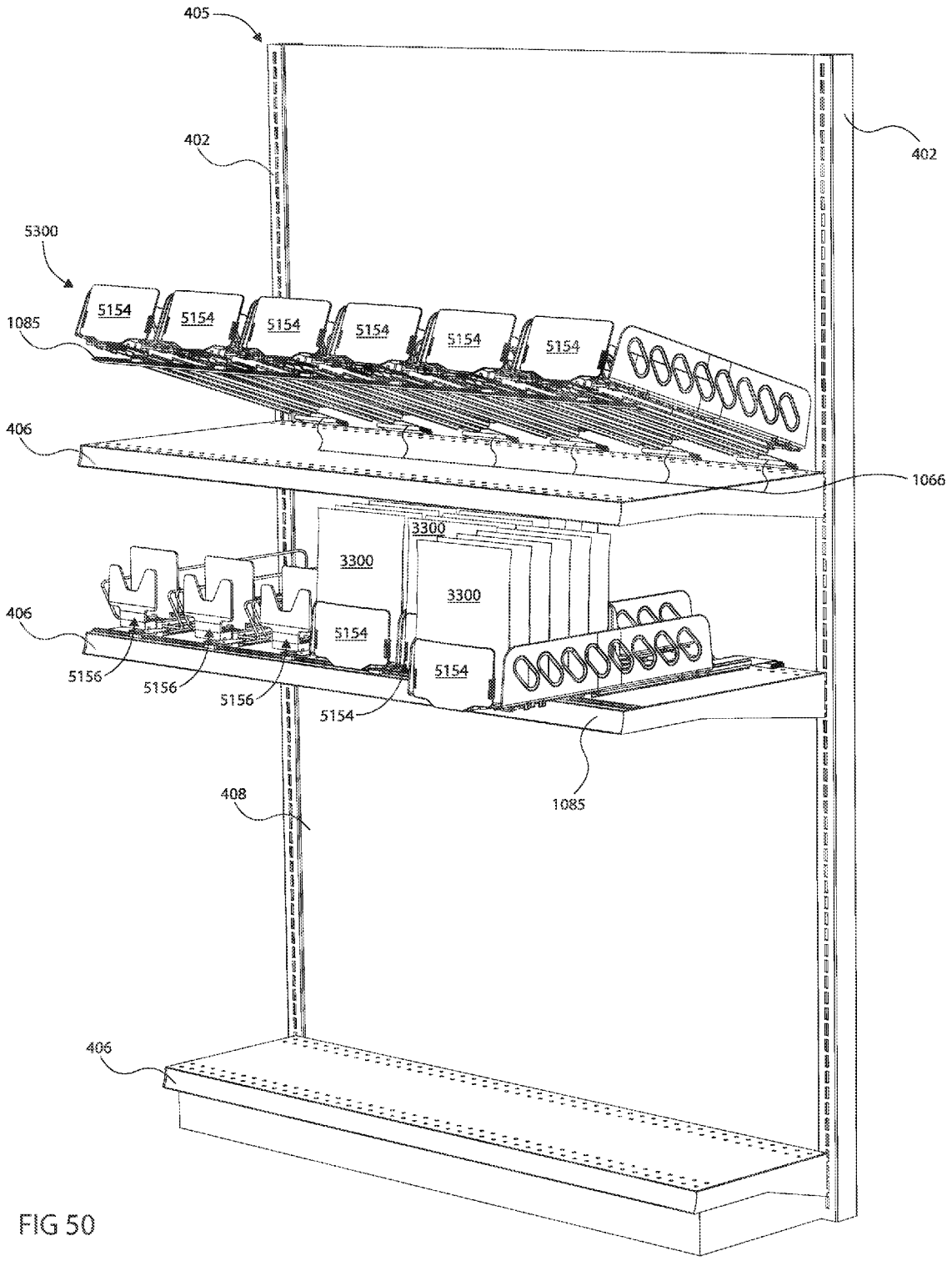
FIG. 50 illustrates a perspective view of quick-load pusher systems mounted to retail shelves and retail uprights.

FIG. 50 shows a first lower shelf 406 having the pusher systems 5154, 5156 mounted thereon. A second upper retail shelf 406 may display a plurality of the pusher systems 5154. The pusher systems 5154 may be connected, attached and/or joined via the T-snap track 1085 and/or may be moved to and/or held or maintained at an upward angle with respect to the second upper retail shelf 406 to facilitate cleaning of the second upper retail shelf 406. The horizontal lip shelf extrusions 1066 may be flexible, bendable and/or movable to allow upward movement of the pusher systems 5154 to facilitate cleaning of the second upper retail shelf 406. After cleaning of the second upper retail shelf 406, the pusher systems 5154 may be lowered or moved back down onto the second upper retail shelf 406 where the T-snap track 1085 may engage and/or rest on the second upper retail shelf 406.

Figure 54A:
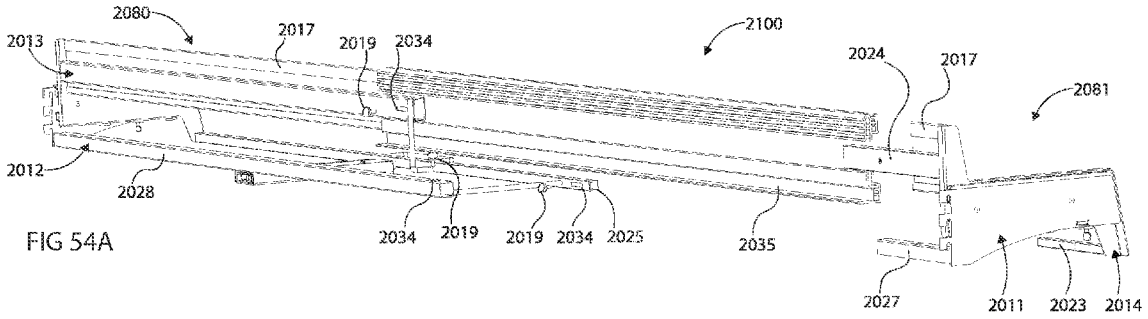
FIGS. 54A and 54B illustrate a perspective view of an adjustable depth merchandising crossbar having a removable width adjustment assembly and a fixed main assembly in an embodiment.
Figure 54B:
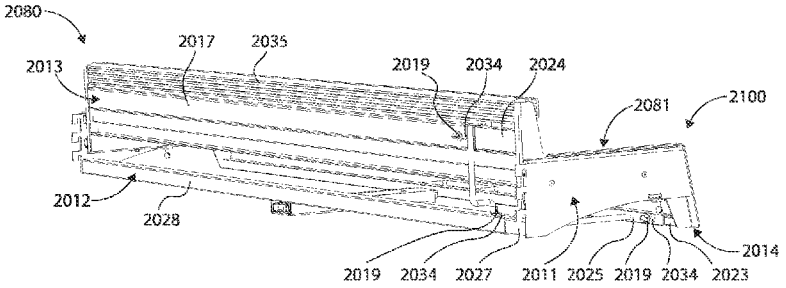
Figure 55:
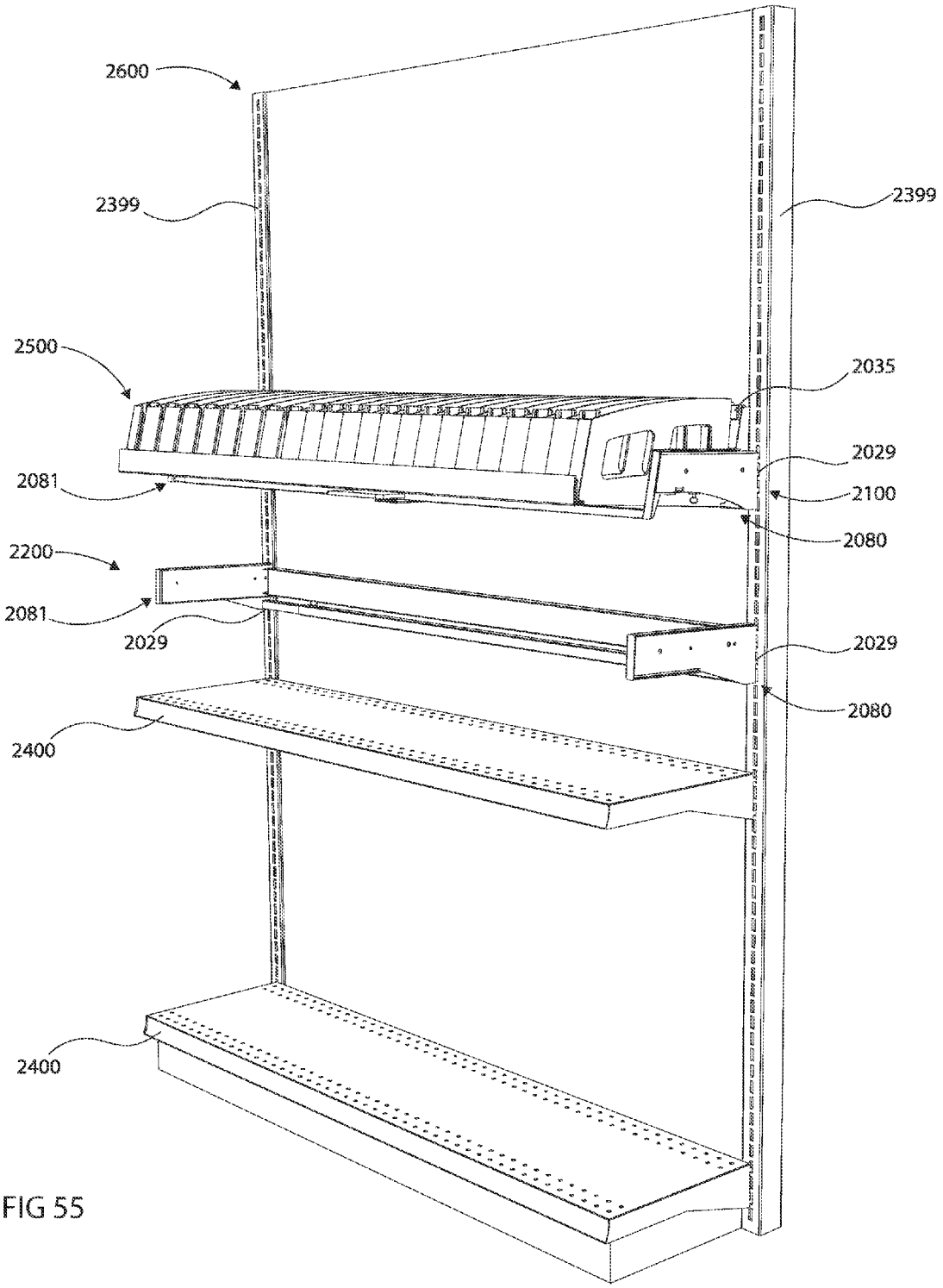
FIG. 55 illustrates perspective view of an adjustable depth merchandising crossbar mounted to a retail gondola section in an embodiment.

FIGS. 51A, 52, 53A, 53B, 54A, 54B, 55 and 56A show a first adjustable depth merchandising crossbar 2100 (hereinafter "first adjustable crossbar 2100") which may be located in a closed or substantially closed position. Further, FIGS. 53E, 53F and 56B show a second adjustable depth merchandising crossbar 2101 (hereinafter "second adjustable crossbar 2101") which may be located in a first partially extended position between the closed position and an open position. Still further, FIG. 56C shows a third adjustable depth merchandising crossbar 2102 (hereinafter "third adjustable crossbar 2102") which may be located in a second partially extended position between the closed position and the open position. Moreover, FIGS. 51B, 53C, 53D and 56A-56C shows an adjustable depth merchandising crossbar 2103 (hereinafter "adjustable crossbar 2103") which may be located in an opened or extended position, which may be partially or fully opened or extended.

The first adjustable crossbar 2100, the second adjustable crossbar 2101, the third adjustable crossbar 2102 and/or the fourth adjustable crossbar 2103 (hereinafter "adjustable crossbars 2100, 2101, 2102, 2103") may have same or similar features and/or components as the upright cross bar 39 and/or the adjustable crossbar 154. Further, features and/or components of the adjustable crossbars 2100, 2101, 2102, 2103 may operate and/or function in same or similar manners as features and components of the upright cross bar 39 and/or the adjustable crossbar 154.

When the first adjustable crossbar 2100 is located in the closed position, a depth of the first adjustable crossbar 2100 may be between about ten inches and about twenty-four inches, such as, for example, about twelve inches. In embodiments, the first adjustable crossbar 2100 may have a first depth configuration and/or may be configured to be connected, attached, joined, fastened and/or secured to a hanging product divider and/or pusher system 2500 (hereinafter "divider system 2500"). In embodiments, the second adjustable crossbar 2101 may have a second depth configuration and/or may be configured to be connected, attached, joined, fastened and/or secured to the divider system 2500. In embodiments, the third adjustable crossbar 2102 may have a third depth configuration and may be configured to be connected, attached, joined, fastened and/or secured to the divider system 2500. In embodiments, the fourth adjustable crossbar 2103 may have a fourth depth configuration and may be configured to be connected, attached, joined, fastened and/or secured to the divider system 2500.

The divider system 2500 may have same or similar features and/or components as the divider system 5. Further, features and/or components of the divider system 2500 may operate and/or function in same or similar manners as features and components of the divider system 5.

The first, second, third and fourth depth configuration of the adjustable crossbars 2100, 2101, 2102, 2103, respectively, may be from about ten inches to about twenty-four inches. For example, the first depth configuration may be twelve inches, the second depth configuration may be fourteen inches, and/or the third depth configuration may be sixteen inches. Moreover, the fourth depth configuration of the fourth adjustable crossbar 2103 may be fully opened and/or extended away from the closed position which may facilitate loading and/or unloading of the divider system 2500 with retail products, such as, for example, the first and second products 300, 301, other retail products 2501 and/or combinations thereof. In embodiments, the other retail products 2501 may be the same as, similar to or different than the first and second products 300, 301. The present disclosure should not be deemed as limited to specific embodiments of the depth configurations for the adjustable crossbars 2100, 2101, 2102, 2103.

FIGS. 55, 56A-56C, 57A and 57B shows a fifth adjustable depth merchandising crossbars 2200 (hereinafter "fifth adjustable crossbar 2200), a sixth adjustable depth merchandising crossbar 2202 (hereinafter "sixth adjustable crossbar 2202") and a seventh adjustable depth merchandising crossbar 2203 (hereinafter "seventh adjustable crossbar 2203") may be configured to be connected, attached, joined, fastened and/or secured to the divider system 2500 or other hanging rail retail merchandising system and/or may have one of the first, second, third or fourth depth configurations. The adjustable crossbars 2100, 2101, 2102, 2103, 2200, 2202, 2203 may connected, attached, joined, fastened, mounted and/or secured to aisle uprights 2399 of a retail gondola section 2600 to secure, display and/or dispense retail products, such as, for example, the first and second products 300, 301, the other retail products 2501 or combinations thereof. In embodiments, the retail gondola section may be, for example, a four foot retail gondola section having the uprights 2399 found in retail environments and used for mounting merchandising fixtures and retail shelving.

In embodiments, one or more of the adjustable crossbars 2100, 2101, 2102, 2103, 2200, 2202, 2203 may be connected, attached, joined, fastened, mounted and/or secured to retail shelving of retail gondola section 2600, such as, for example, a first retail shelf 2400, a second retail shelf 2401 or a third retail shelf 2402. The retail shelves 2400, 2401, 2402 may have depths between about 10 inches and about twenty-four inches. For example, the first retail shelf 2400 may have a depth of about twelve inches, the second retail shelf 2401 may have a depth of about fourteen inches, and/or the third retail shelf may have a depth of about sixteen inches. The present disclosure should not be deemed as limited to a specific embodiment of the depths of the retail shelves 2400, 2401, 2402.

The adjustable crossbars 2100, 2101, 2102, 2103, 2200, 2202, 2203 may comprise one or more of the following structural features and/or components, which may be connected, attached, fastened, secured, joined and/or mounted to each other and/or combinations thereof: a first outer mounting assembly 2011; a second outer mounting assembly 2012; a first inner sliding assembly 2013; a second inner sliding assembly 2014; an upper mounting plate 2015; a lower mounting plate 2016; an attachment bar 2017; a positioning tab 2018; width adjustment hardware 2019; a first depth guide 2020; a second depth guide 2021; a third depth guide 2022; a forward support width adjustment bar 2023; an upper width adjustment bar 2024; a front support bar 2025; a depth adjustment handle 2026; a mounting width adjustment bar 2027; a mounting stationary support bar 2028; upright mounting hooks 2029; a support rod 2030; a depth adjustment screw 2031; outer fixed mounting gables 2032; inner sliding gables 2033; a width adjustment slot 2034; a hanging mount bracket 2035; a depth adjustment spring pin 2036; a loading depth guide 2037; a standard attachment bar 2038; a side mounted extension slide assemblies 2300 (hereinafter "first sliding assemblies 2300"); and/or a flat mounted extension slide assembly 2301 (hereinafter "second sliding assembly 2301"). One or more of the above-identified structural features and/or components may be connected, attached, secured, joined and/or mounted to each other or combinations thereof to assembly, produce and/or provide one or more of the adjustable crossbars 2100, 2101, 2102, 2103, 2200, 2202, 2203 as shown in and illustrated by FIGS. 51A, 51B and 52.

Further, the adjustable crossbar 2100 may have a main fixed assembly 2080 which may comprise the first inner sliding assembly 2013, the second outer mounting assembly 2012, the first sliding assembly 2300 and/or the second sliding assembly 2301 (hereinafter "sliding assemblies 2300, 2301"). Still further, the adjustable sliding assembly a width adjustment assembly 2081 which may comprise the second inner sliding assembly 2014, the first outer mounting assembly 2011 and/or the first slide assembly 2300

The upper mounting plate 2015 may be connected, attached, joined and/or fastened to the second sliding assembly 2301 and/or a component of the first inner assembly 2013, and the lower mounting plate 2016 may be connected, attached, joined and/or fastened to the second sliding assembly 2301 and/or a component of the second inner right assembly 2012. The attachment bar 2017 may provide a mounting support structure for the hanging mount bracket 2035 for attachment of the divider system 2500 and/or may facilitate, provide and/or enable mounting various other display and merchandising components (not shown in the drawings). The positioning tab 2018 may be located on outer fixed mounting gable 2032 in the first and second mounting assemblies 2011, 2012 and/or may engage the depth adjustment screw 2031 to set a position of the first and second inner sliding assemblies 2013, 2014. The width adjustment hardware 2019 may be used to set, lock and/or align the width between upright mounting hooks 2029 to fit into or to conform to different sized gondola uprights (not shown in the drawings).

The first depth guide 2020 is a component of the inner sliding gable 2033 and may be used to set and/or lock a unit depth at a first minimum value through use of the depth adjustment screw 2031. The first minimum value of the unit depth may be less than about twenty-four inches, such, for example, about sixteen inches, about fourteen inches or about twelve inches. The second depth guide 2021 is a component of inner sliding gable 2033 and may be used to set and/or lock the unit depth at a second minimum valve through use of depth adjustment screw 2031. The second minimum value of the unit depth may be less than about twenty-four inches, such, for example, about sixteen inches or about fourteen inches. The third depth guide 2022 is a component of the inner sliding gable 2033 may be used to set and/or lock the unit depth at a third minimum through use of the depth adjustment screw 2031. The third minimum value of the unit depth may be less than about twenty-four inches, such, for example, about sixteen inches. In embodiments, the depth adjustment screw 2031 may be positioned, inserted, pushed and/or provided in the first depth guide 2020, the second depth guide 2021 or the third depth guide 2022 to lock the depth of the crossbar 2100 at the first, second or third minimum value. As a result, the crossbar 2100 may be set or locked at the first, second or third minimum value via the depth adjustment screw 2031.

The forward support width adjustment bar 2023 provided on the second inner sliding assembly 2014 may slide into the front support bar 2025 which may be provided on the first inner sliding assembly 2013. The upper width adjustment bar 2024 provided on the second inner left sliding assembly 2014 may slide into the attachment bar 2017. The front support bar 2025 may have multiple functionality and may provide (i) structural stability (i.e., reduces torsion), (ii) a mounting surface for the handle 2026, and (iii) a level surface for the divider system 5 or the divider system 2500 to rest if under substantial load from first and second products 300, 301 or retail products 2501. The depth adjustment handle 2026 may facilitate and/or may be used to adjust a depth of first and second inner sliding assemblies 2013, 2014. The depth adjustment handle 2026 may be located, positioned and/or positioned on the first inner sliding assembly 2013. In an embodiment, the depth adjustment handle 2026 may be located at a center position between the first and second inner sliding assemblies 2013, 2014 for convenience and accessibility by a user.

The mounting width adjustment bar 2027 provided on the first outer mounting assembly 2011 may slide into the mounting stationary support bar 2028 which may be provided on the second outer right mounting assembly 2012. The mounting stationary support bar 2028 may connect, attach, join, fasten and/or secure the first and second outer mounting assemblies 2011, 2012 together and/or may facilitate width adjustment for mounting and/or a structural connection point for the lower mounting plate 2016 and the second sliding assembly 2301. The upright mounting hooks 2029 may facilitate mounting and/or may be used to mount the adjustable crossbars 2100, 2101, 2102, 2103, 2200, 2202, 2203 into the uprights 2399 of the retail gondola section 2600 as shown in FIG. 55.

The support rod 2030 may provide structural support between the front support bar 2025 and the attachment bar 2017. The depth adjustment screw 2031 is used to set and/or lock the depth of the first and second inner sliding assemblies 2013, 2014 by way of the first, second and/or third depth guides 2020, 2021, 2022 on the adjustable crossbars 2100, 2101, 2102, 2103. The outer fixed mounting gables 2032 mounts the adjustable crossbar 2100, 2101, 2102, 2103, 2200, 2202, 2203 to the uprights 2399 and provides a mounting platform for the first sliding assemblies 2300. The inner sliding gables 2033 provides the mounting structure for the first and second sliding assemblies 2013, 2014 and facilitates attachment the first and second sliding assemblies 2013, 2014 to the slide assemblies 2300. As a result, the first sliding assembly 2013 may be connected, attached, mounted, joined and/or secured to a first sliding assembly 2300 via first inner sliding gables 2033, and the second sliding assembly 2014 may be connected, attached, mounted, joined and/or secured to a second sliding assembly 2300 via second inner sliding gables 2033. In other words, there are a set of the inner sliding gables 2033 provided on the right side and the left side to facilitate attachment of each of the first and second sliding assemblies 2013, 2014 to their own first sliding assembly 2300. The width adjustment slot 2034 is configured to be used to adjust and/or lock the width between the upright mounting hooks 2029 to fit a multitude of different retail environments (not shown in the drawings). The width adjustment slot 2034 may adjusts spacing between the width adjustment assembly 2081 and the main fixed assembly 2080 by using of the width adjustment hardware 2019. In an embodiment, the width adjustment hardware 2019 may be a pin, a bolt, a screw or a rod. The present disclosure should not be deemed as limited to a specific embodiment of the width adjustment hardware 2019.

The hanging mount bracket 2035 may facilitate and/or may be used for attaching divider system 5 or the divider system 2500 to the attachment bar 2017. The depth adjustment spring pin 2036 may be utilized in the adjustable crossbars 2200, 2201, 2203 as an alternative to the depth adjustment screw 2031 utilized in the adjustable crossbars 2100, 2101, 2102, 2103. As a result, the depth adjustment spring pin 36 may be used to set and/or lock the depth of the first and second inner sliding assemblies 2013, 2014 by way of the first, second and/or third depth guides 2020, 2021, 2022. The loading depth guide 2037 may engage the depth adjustment spring pin 2036 to lock the first and second inner sliding assembly 2014 in the opened or extended positions to facilitate the loading of the first and second products 300, 301 or the retail products 2501. The standard attachment bar 2038 may provides a mounting support structure for the attachment of various other display and merchandising components such as hooks or pushers (not shown in the drawings).

Figure 51A:
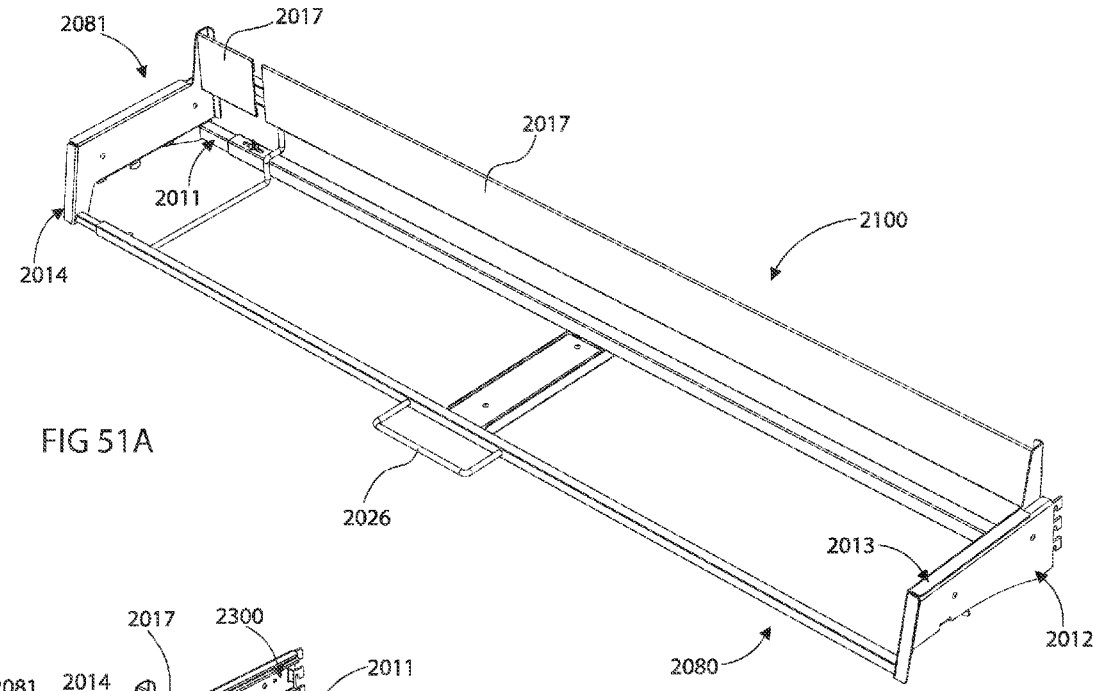
FIG. 51A illustrates a perspective view of an adjustable depth merchandising crossbar in a closed position in an embodiment.
Figure 52:
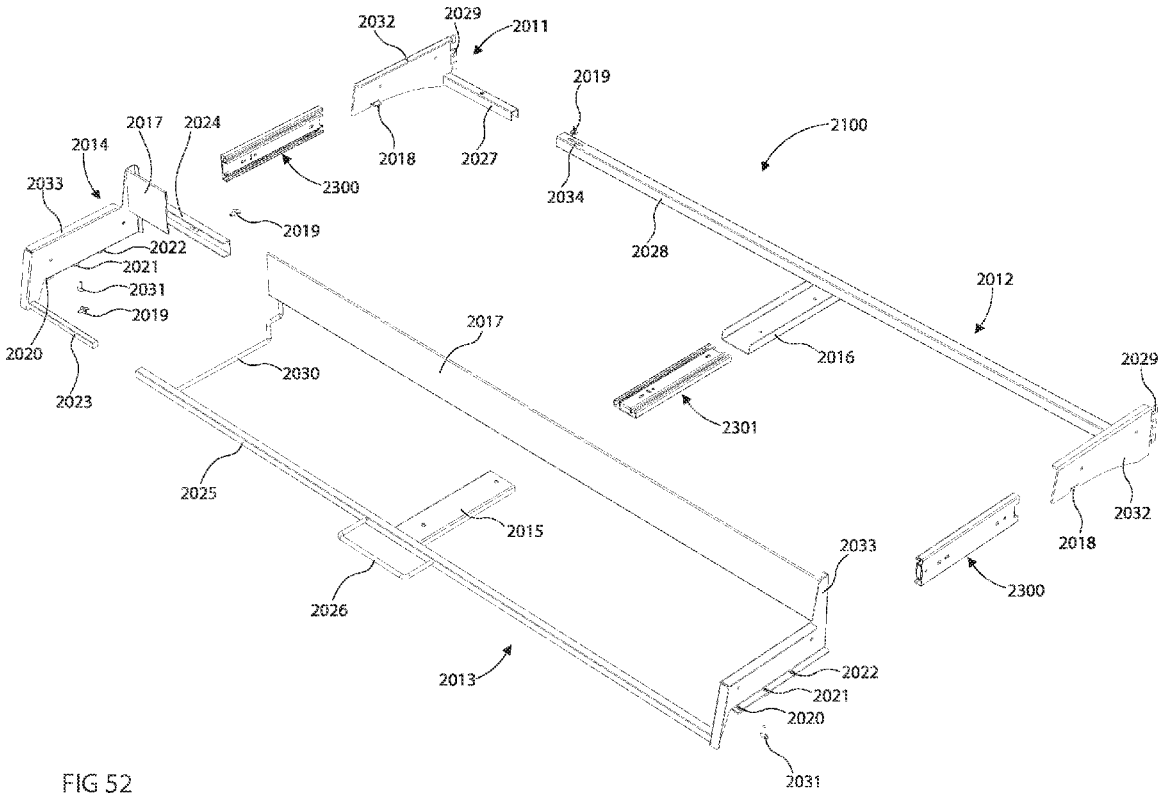
FIG. 52 illustrates an exploded perspective view of an adjustable depth merchandising crossbar in an embodiment.

As shown in FIGS. 51A and 52, the first outer mounting assembly 2011, the second outer mounting assembly 2012, the first inner sliding assembly 2013, a second inner sliding assembly 2014, an attachment bar 2017, a depth adjustment handle 2026, the main fixed assembly 2080, the width adjustment assembly 281, the first sliding assemblies 2300 and the second sliding assembly 2301 are connected, attached, joined, fastened and/or secured to each other to assembly, produce or provide the adjustable crossbar 2100. One or more of the upper mounting plate 2015, the lower mounting plate 2016, the positioning tab 2018, the width adjustment hardware 2019, the first depth guide 2020; the second depth guide 2021, the third depth guide 2022, the forward support width adjustment bar 2023, the upper width adjustment bar 2024, the front support bar 2025, the mounting width adjustment bar 2027, the mounting stationary support bar 2028, the upright mounting hooks 2029, the support rod 2030, the depth adjustment screw 2031, the outer fixed mounting gables 2032, the inner sliding gables 2033, the a width adjustment slot 2034, the hanging mount bracket 2035, the depth adjustment spring pin 2036, the loading depth guide 2037 and the a standard attachment bar 2038 are utilized for assembling or producing the adjustable crossbar 2100.

Figure 51B:
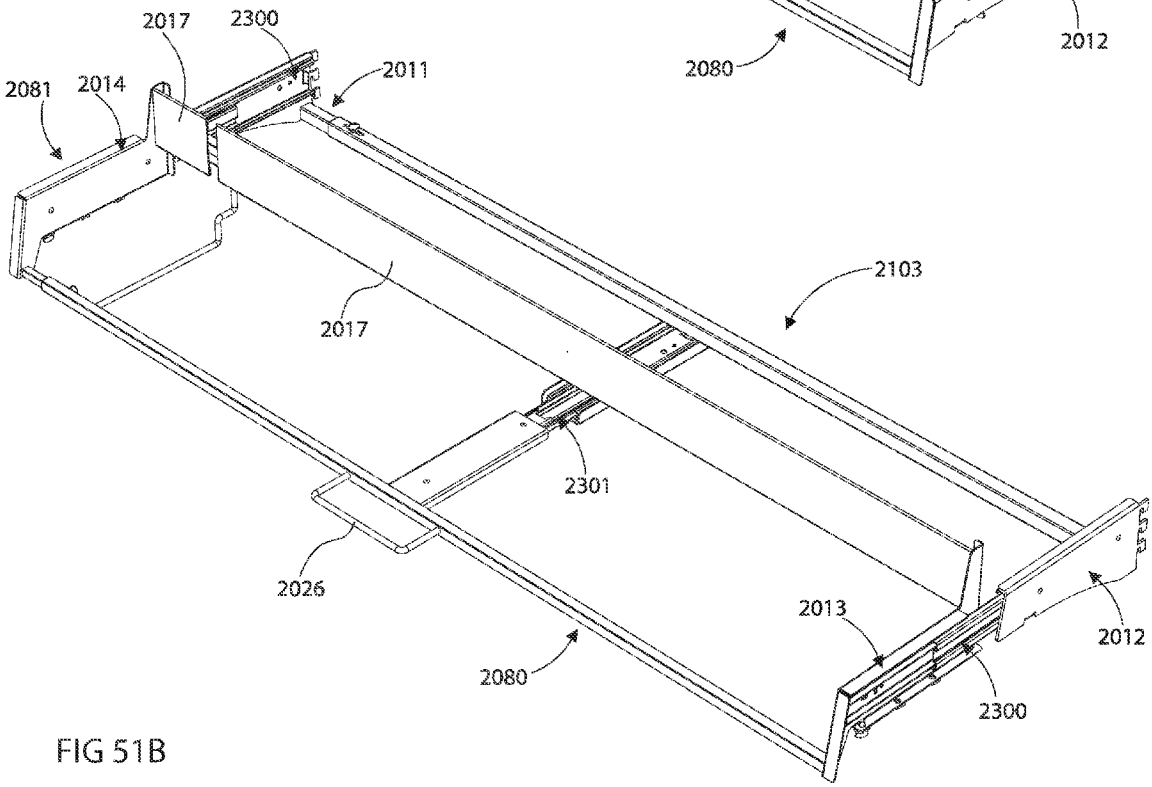
FIG. 51B illustrates a perspective view of an adjustable depth merchandising crossbar in an opened or extended position in an embodiment

FIG. 51A shows the adjustable crossbar 2100 located in the closed position, FIG. 51B shows the adjustable crossbar 2103 in the opened position, which may be a partially or fully opened or extended state to facilitate loading the retail products 2501 into the divider system 2500 that may be connected, attached, joined, mounted, fastened and/or secured to the adjustable crossbar 2300. FIG. 52 shows an exploded perspective view of the adjustable crossbar 2100 to illustrate assembly of the adjustable crossbar 2100.

Figure 53A:
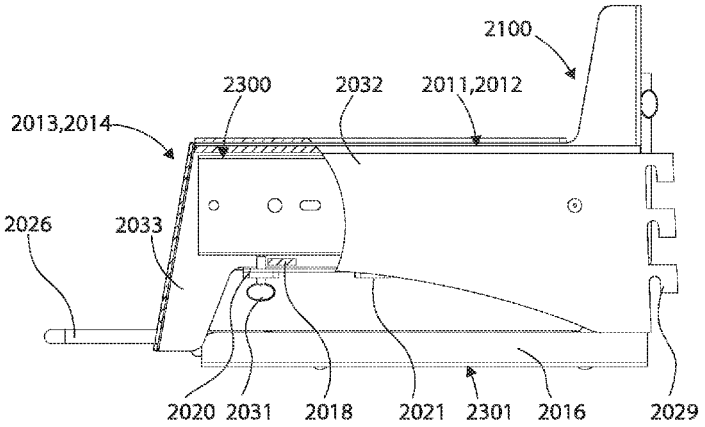
FIGS. 53A-53F illustrate a side plan view of an adjustable depth merchandising crossbar moving or sliding between closed and opened or extended positions during a process of adjusting and setting a depth of the adjustable depth merchandising crossbar in an embodiment.
Figure 53B:
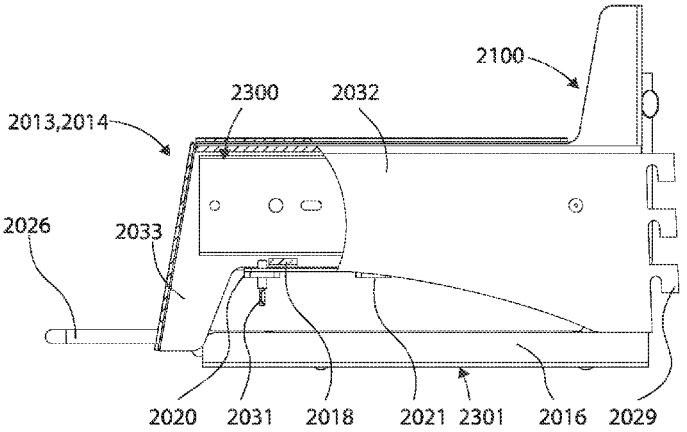
Figure 53C:
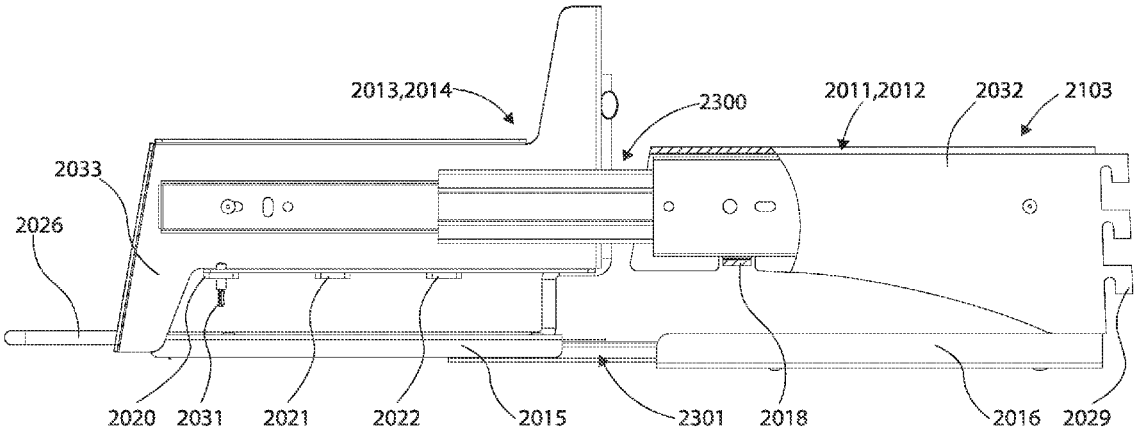
Figure 53D:
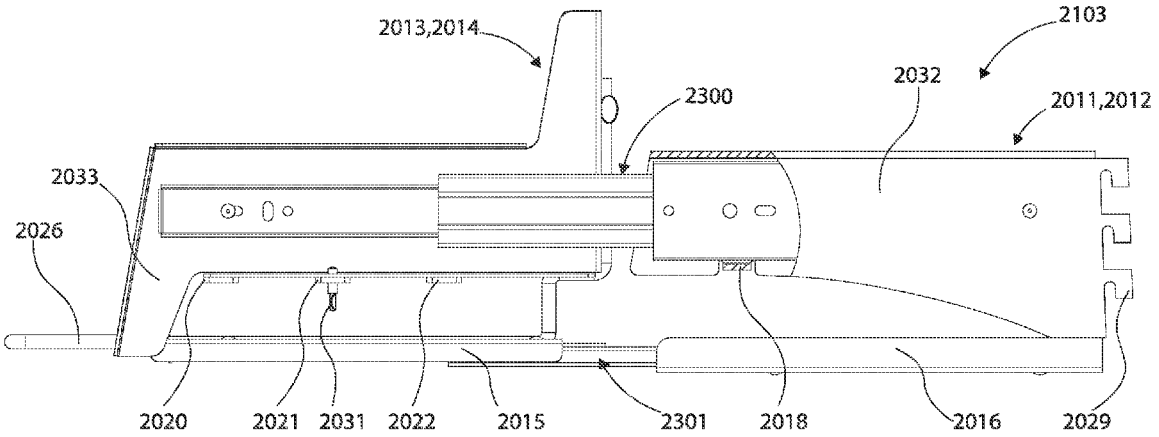
Figure 53E:
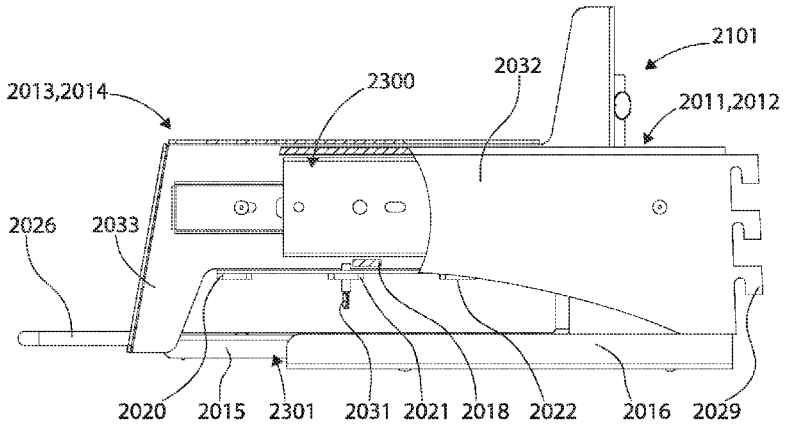
Figure 53F:
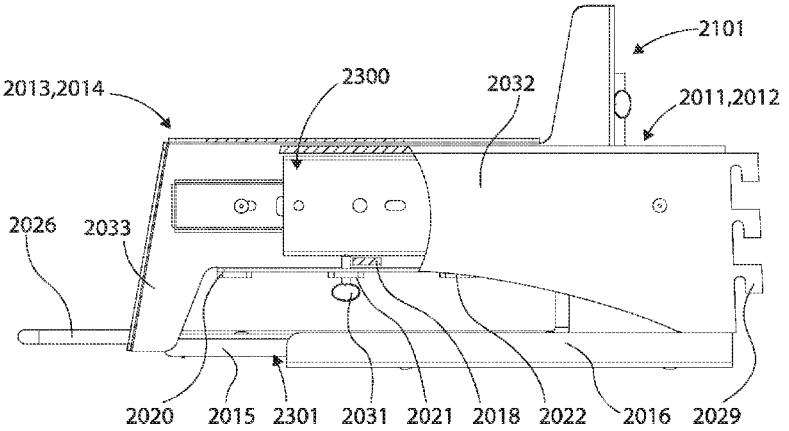

FIGS. 53A-53F illustrate a process and/or a function of adjusting and setting the depth of the adjustable crossbar 2100. For example, FIG. 53A shows a side plan view of the adjustable crossbar 2100 located in the closed position which may be facilitated by the first sliding assemblies 2300. The depth adjustment screw 2031 may be positioned in the first depth guide 2020 and/or may be resting against positioning the tab 2018 of the outer mounting gable 2032. The depth adjustment screw 2031 may be tightened against the slider assembly 2300 securing the inner right sliding assembly 2013 in place and/or in a fixed position. FIG. 53B shows the adjustable crossbar 2100 located in the closed position and the depth adjustment screw 2031, positioned in the first depth guide 2020, may be turned and/or loosened which may result in relieving pressure against the first sliding assemblies 2300.

FIG. 3C shows of the adjustable crossbar 2103 located in an open or extended position. The first and second inner sliding assemblies 2013, 2014 may be pulled forward through use of the depth adjustment handle 2026 and/or the first and second sliding assemblies 2300, 2301 may be opened from their retracted states. In FIG. 3D, the adjustable crossbar 2103 may be opened in its fully extended state, and the depth adjustment screw 2031 may be removed from first depth guide 2020 and partially inserted into second depth guide 2021. In FIG. 3E, through push force may be applied to depth adjustment handle 2026, the first and second inner sliding assemblies 2013, 2014 may be moved back towards the outer fixed gables 2011, 2012. The first and second slide assemblies 2300, 2301 may retract until the depth adjustment screw 2031 in second depth guide 2021 makes contact with the positioning guide 2018 on the first and second outer mounting assemblies 2011, 2012 which prevent further travel. As a result, the adjustable crossbar is now set to a depth associated with the second depth guide 2020. FIG. 3F shows depth adjustment screw 2031 located in the second depth guide 2021, which may be tightened against the first slide assemblies 2300 for preventing further movement of the first and second inner sliding assemblies 2013, 2014. The adjustable crossbar 2100 has not been changed to the adjustable crossbar 2101 which is set to a different depth than the depth of the adjustable crossbar 2100.

FIGS. 54A and 54B illustrate removal of the width adjustment assembly 2081, attachment of hanging mount bracket 2035, and setting and/or locking the width between the width adjustment assembly 2081 and the main fixed assembly 2080. FIG. 4A shows the three width adjustment screws 2019 which may be removed from width adjustment bars 2023, 2024, 2027 via width adjustment slots 2034. The width adjustment assembly 2081 may slid free from the main fixed assembly 2080. The hanging mount bracket 2035 may slid onto an end of thin attachment bar 2017 on the adjustable crossbar 2100, 2101, 2102, 2103 to adapt the crossbar for mounting of the divider system 5 or the divider system 2500. The adjustable crossbar 2100, 2101, 2102, 2103 with the attachment bar 2017 is not limited to use of the hanging mount bracket 2035. Extruded mounting tracks may be customized to fit other merchandising systems (not shown in the drawings). FIG. 4B shows the hanging mount bracket 2035 slid all the way onto the attachment bar 2017. The width adjustment assembly 2081 may be positioned to be attached to the main fixed assembly 2080. The upper width adjustment bar 2024 mates with the back of the attachment bar 2017, the forward support width adjustment bar 2023 mates with the front support bar 2025 and the mounting width adjustment bar 2027 mates with the mounting stationary support bar 2028. The width adjustment hardware 2019 may be loosely attached though the width adjustment slots 2034. The width adjustment assembly 2081 may then be positioned to a desired width to fit into the retail gondola 2600. Once the desired width is achieved, the width adjustment hardware 2019 may be tightened or fastened to affix or to lock the width adjustment assembly 2081 in place or in a fixed position.

FIG. 55 shows the adjustable crossbar 2100, 2200 may be mounted to the retail gondola section 2600 via insertion of the upright mounting hooks 2029 into the aisle uprights 2399. The width between the main fixed assembly 2080 and the width adjustment assembly 2081 is set to match the width between centres of aisle uprights 2399. The width between centres of the aisle uprights 2399 may be less than about sixty-four inches, such as, for example, about sixty inches, about fifty-four inches or about forty-eight inches. Mounted to the adjustable crossbar 2100, by way of hanging mount bracket 2035, may be the divider system 2500. Also shown, attached is aisle uprights 2399, is the first retail shelf 2400.

Figure 56A:
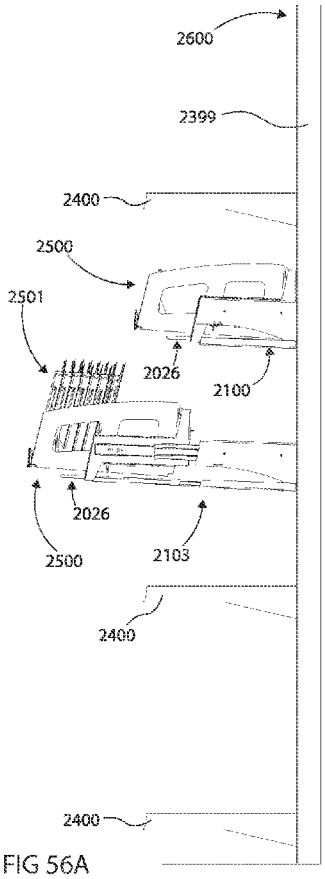
FIGS. 56A-56C illustrate a side plan view of an adjustable depth merchandising crossbar moving or sliding in a process for aligning the adjustable depth merchandising crossbar with adjacent shelf in an embodiment.
Figure 56B:
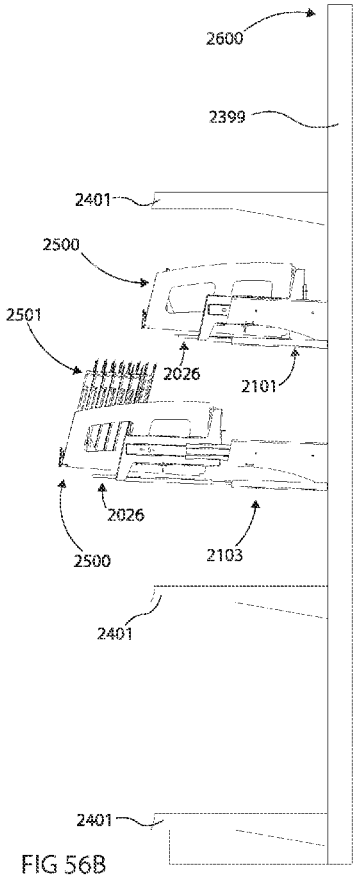
Figure 56C:
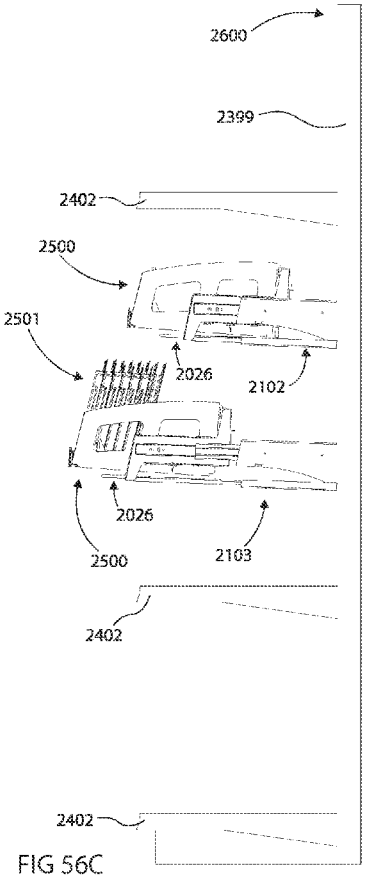
Figure 57A:
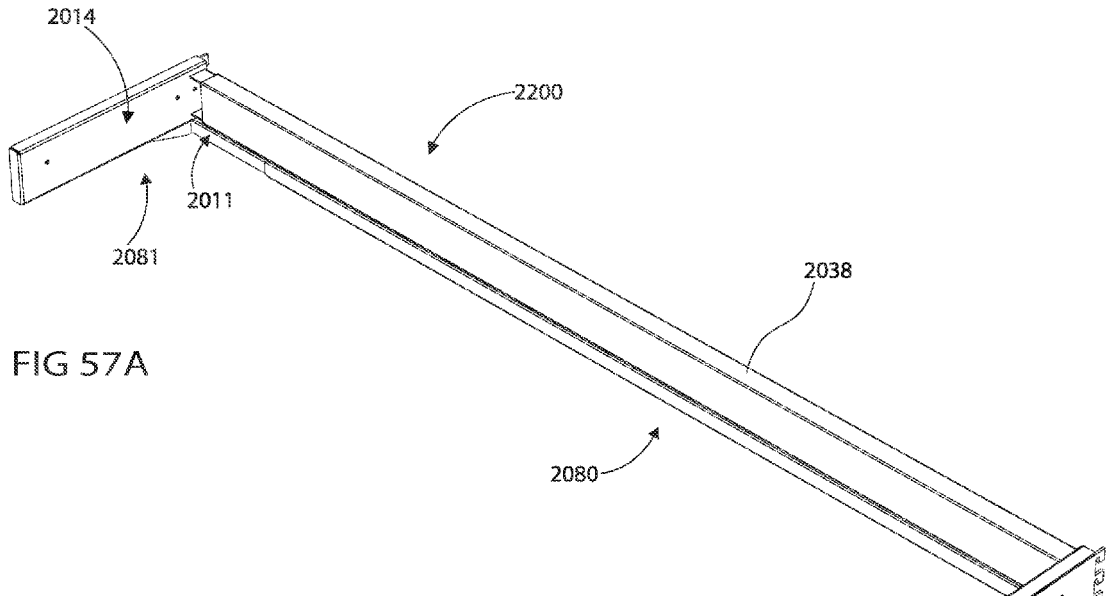
FIGS. 57A and 57B illustrate a perspective view of an adjustable depth merchandising crossbar in closed and opened positions, respectively, in an embodiment.
Figure 57B:
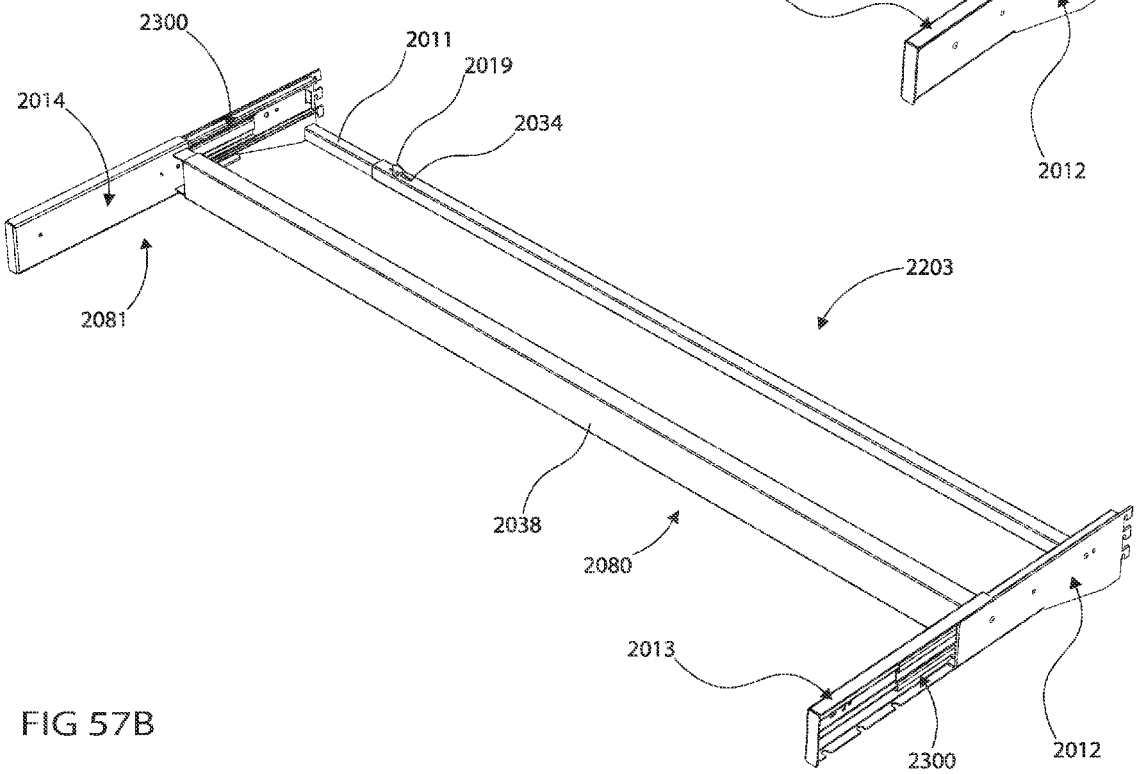

FIGS. 56A-56C illustrates features, functionalities and/or versatilities of the adjustable crossbar 2100, 2101, 2102, 2103. Specifically, FIGS. 56A-56C illustrates adjustable crossbar 2100, 2101, 2102, 2103 a process or method for adapting the adjustable crossbar to match various shelf depths within a retail environment. FIG. 56A shows the retail gondola section 2600 with the first retail shelf 2400. For example, the first retail shelf 2600 may be a traditional twelve inch deep retail gondola shelf. The adjustable crossbar 2100 may be set to a depth of twelve inches which may correspond to the first depth guide 2020. With divider system 2500 attached to the adjustable crossbar 2100, an outer face of the divider system 2500 may be vertically or substantially vertically collinear with the first retail shelf 2400. This ensures easy access to retail products 2501 positioned within the divider system 2500 (or similar merchandising systems) and other retail product which may be positioned on the first retail shelf 2400 as no one or single merchandising fixture is greatly protruding beyond another. The adjustable crossbar 2103, may be located in a fully extended configuration or position for loading, pulled forward by way of the depth adjustment handle 2026 as shown in FIGS. 51B, 53C, 53D. In FIGS. 56A, 56B and 56C, the divider system 2500 may be mounted to the adjustable crossbars 2100, 2101, 2102 and may be holding the retail products 2501 in order to demonstrate ease of access to product (especially the back most product) for purposes of product rotation, ease of restocking and visual product maintenance (facing). The divider system 2500 and retail products 2501 may extended out from underneath the above fixtures, the first, second and third shelves 2400, 2401, 2402 and/or the adjustable crossbars 2100, 2101, 2102, which may enable fixtures to be mounted with less vertical separation as there is no need to leave extra arm space to reach rearmost products. Minimizing wasted vertical spaces may created or provide opportunities to add additional fixtures such as additional shelves 2400, 2401, 2402 or additional adjustable crossbars 2100, 2101, 2102, which may increase product holding power within the gondola section 2600.

FIG. 56B shows the gondola section 2600 with second retail shelves 2401 which may be, for example, typical 14" deep retail gondola shelves. The adjustable Crossbar 2101 may be set to the second depth guide which may, for example, correspond to a depth of fourteen inches. With divider system 2500 attached to the adjustable crossbar 2101, the outer face of the divider system may be vertically or substantially vertically collinear with the second shelves 2401, which may ensure easy access to product both mounted in the divider system 2500 (or similar merchandising systems) and on the second shelves 2401 as no one or single fixture is greatly protruding beyond another. The adjustable crossbar 2103 may be located in its fully extended configuration or position for loading and/or may be pulled forward by way of the depth adjustment handle 2026.

FIG. 56C shows the retail gondola section 2600 with the third retail shelves which may be, for example, sixteen inch deep retail gondola shelves. The adjustable crossbar 2102 may be set to the third depth guide 2022 which may correspond to a depth of sixteen inches. With the divider system 2500 attached to the adjustable crossbar 2102, the outer face of the divider system 2500 may be vertically or substantially vertically collinear with the third shelves 2402. This may ensure easy access to product both mounted in handing divider system 2500 (or similar merchandising systems) and on the third shelves 2402 as no one fixture is greatly protruding beyond another. The adjustable crossbar 2103 may be located in its fully extended configuration or position for loading and/or may be pulled forward by way of depth adjustment handle 2026. It should be understood that the present disclosure is not limited to specific embodiments for the depths of the adjustable crossbars 2100, 2101, 2102.

FIG. 57 FIG. 7*a* shows Adjustable Depth Merchandising Crossbar 2200, an embodiment of Adjustable Depth Merchandising Crossbar 2100, in its closed or 12" position. FIG. 7*b* shows Adjustable Depth Merchandising Crossbar 2203 in is open or fully extended state.

Figure 58:
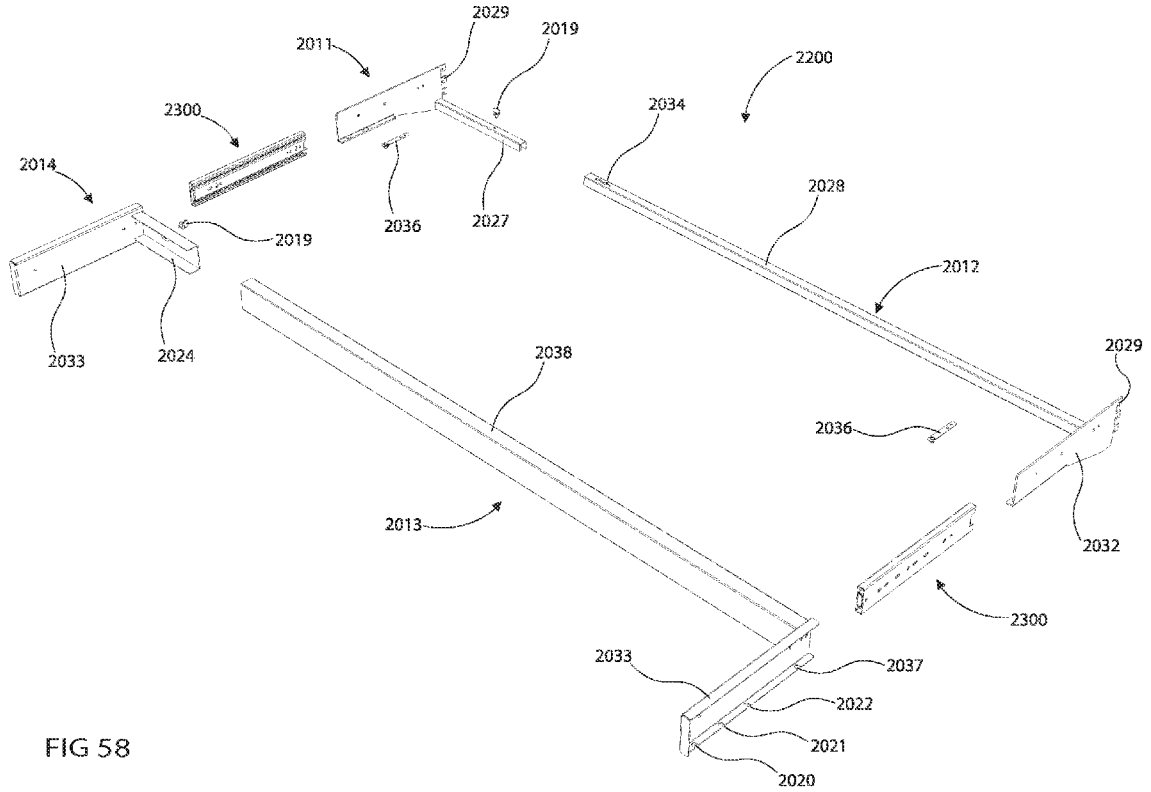
FIG. 58 illustrates an exploded perspective view of an adjustable depth merchandising crossbar in an embodiment.

FIG. 58 shows an exploded view of the crossbar 2200 which may have one or more variations in view of the crossbar 2100 shown in FIG. 52. There may be one or more structural differences the crossbars 2100, 2200. For example, inclusion of a known attachment bar 2038 may replace the attachment bar 2017 which may allow for a the mounting of pre-existing or known merchandising components previously mounted to a fixed crossbar style system. Exclusion of the front support bar 2025, the lower mounting plate 2015, the upper mounting plate 2016, the extension slide 2301, the support rod 30, the depth adjustment handle 2026 and/or the forward support width adjustment bar 2023 may allow for mounting of a greater variety of merchandising components and systems beyond those previously identified, such as, for example, mounting of known merchandising components and/or shelves. Replacement of the depth adjustment spring pin 2036 over the depth adjustment hardware 2031 may allow for simplified depth adjustment without the depth adjustment hardware 2031 to be removed.

Figure 59:
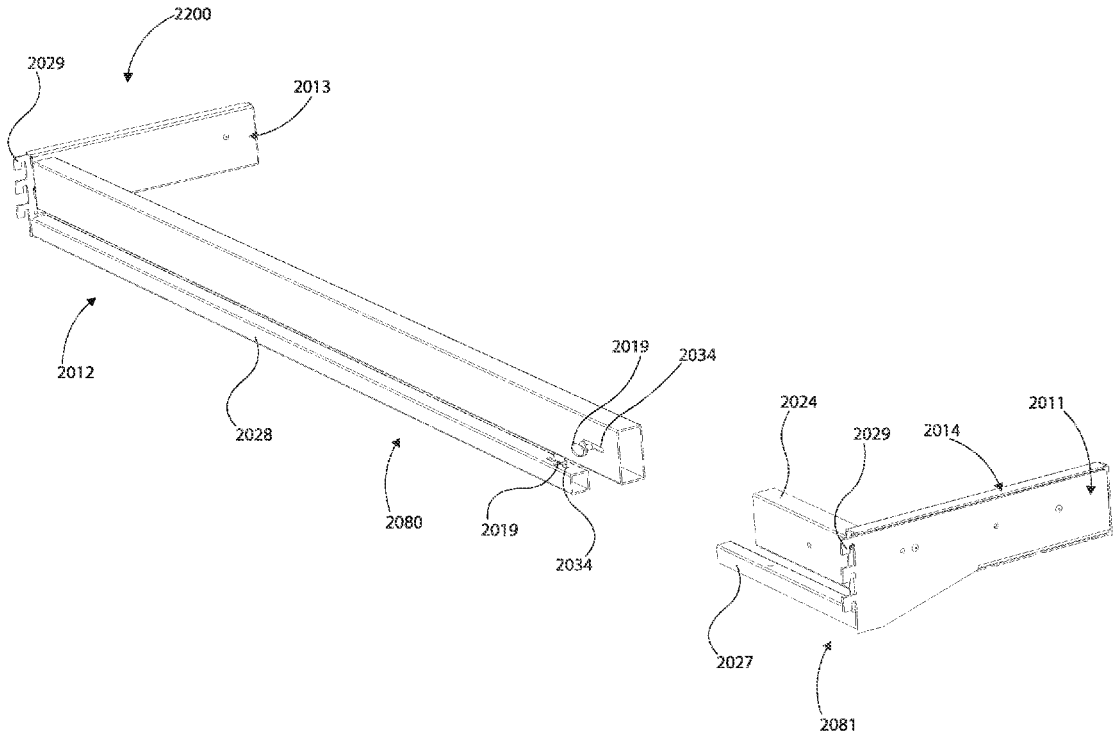
FIG. 59 illustrates a perspective view of a movable adjustment assembly separated from a fixed main assembly in an embodiment.

FIG. 59 shows complete separation of the width adjustment assembly 2081 from the main fixed assembly 2080 for both assembly and adjustment of the width between the upright mounting hooks 2029 provided on the width adjustment assembly 2081 and the main fixed assembly 2080. The width adjustment assembly 2081 may be positioned to be attached to the main fixed assembly 2080. The upper width adjustment bar 2024 may mate and/or join with the back standard attachment bar 2038, and the mounting width adjustment bar 2027 may mate and/or join with the mounting stationary support bar 2028. The width adjustment hardware 2019 may loosely connect, attach and/or join though the width adjustment slots 2034. The width adjustment assembly 2081 may then be positioned to a desired width to fit into and/or be positioned and/or located within the retail gondola section 2600, and the width adjustment hardware 2019 may be tightened to lock the width adjustment assembly 2081 in place or into a fixed position.

Figure 60A:
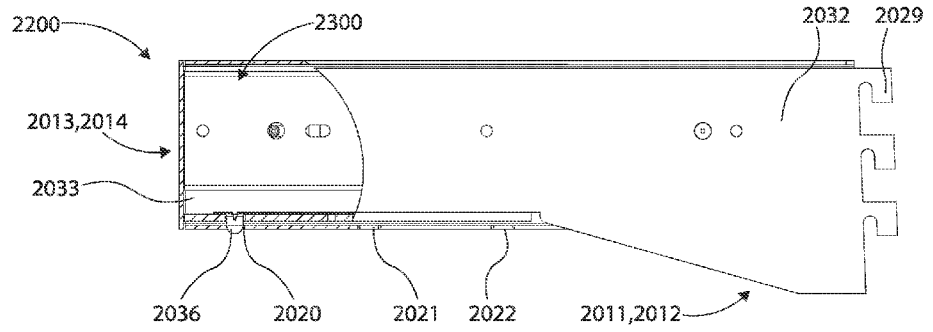
FIGS. 60A-60D illustrate a side plan view of an adjustable depth merchandising crossbar moving or sliding a process from a closed position to an open position in an embodiment.

FIG. 60A shows a side plan view of the adjustable crossbar 2200 located in the closed position via the first sliding assemblies 2300 and/or the second sliding assembly 2301, and the depth adjustment spring pin 2036 may be positioned or located in the first depth guide 2020 of the inner sliding gable 2033. As a result, the first and second securing inner sliding assemblies 2013, 2014 and the adjustable crossbar 220 may be secured in place and/or located or positioned in a fixed position.

Figure 60B:
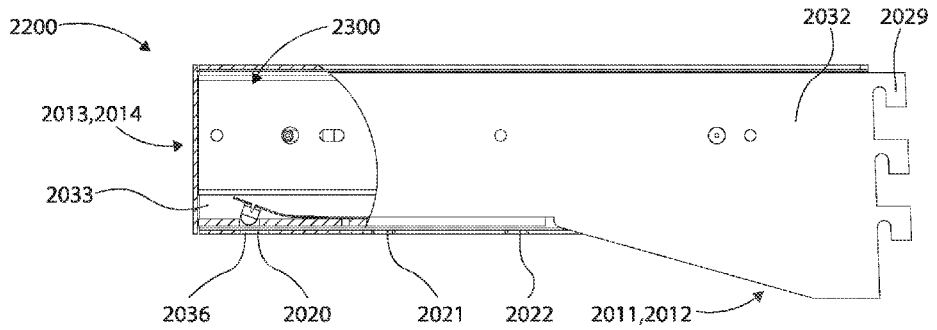

FIG. 60B shows a side plan view of the adjustable crossbar 2200 located in the closed position via the first sliding assemblies 2300 and/or the second sliding assembly 2301. The depth adjustment spring pin 2036 may be pressed, moved or pushed upwards and out of the first depth guide 2020. As a result, the first and second inner sliding assemblies 2013, 2014 may be released or freed from a locked state within or with respect to the outer mounting assemblies 2011, 2012 via the first slider assemblies 2300 and/or the second sliding assembly 2301.

Figure 60C:
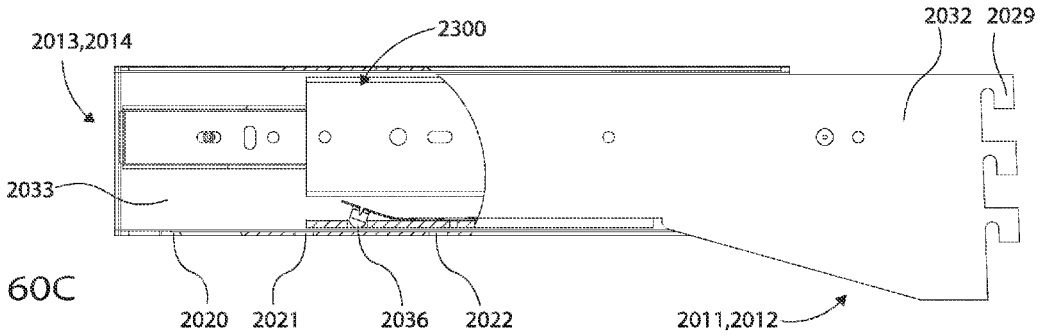

After the first and second inner sliding assemblies are released from the locked state with respect to the first and second outer mounting assemblies 2011, 2012, the depth adjustment spring pin 2036 may remain pressed, moved or pushed upward as shown in FIG. 60C. As a result, the inner sliding assemblies 2013, 2014 may be released or separated or may be movable from the outer mounting assemblies 2011, 2012, and the inner sliding assemblies 2013, 2014 may be pulled, slide or moved forwardly or away from or outward with respect to the first and second outer mounting assemblies 2011, 2012. As a result, the first and second inner sliding assemblies 2013, 2014 move outwardly with respect to the first and second outer mounting assemblies 2011, 2012 which increases the depth of the adjustable crossbar 2200. The depth adjustment spring pin 2036 may remain in its released or upward position until the second depth guide 2021, the third depth guide 2022 or the loading depth guide 2037 may move into or may be positioned or located in alignment with the depth adjustment spring pin 2036.

Figure 60D:
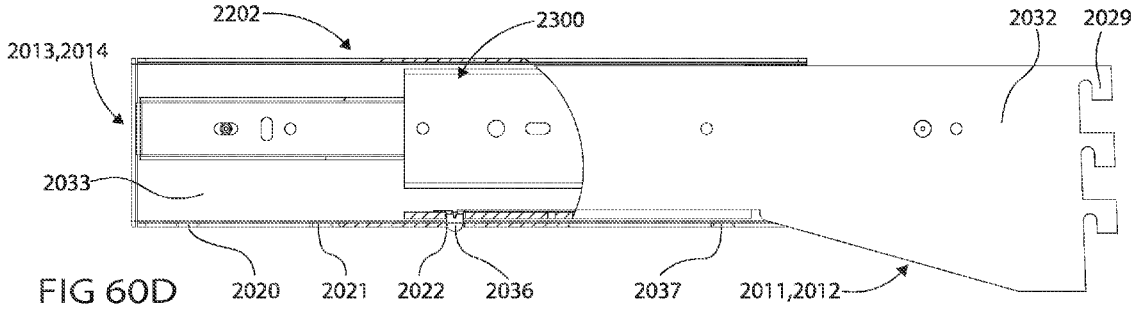

When the second depth guide 2021, the third depth guide 2022 or the loading depth guide 2037 are moved into or positioned or located in alignment with the depth adjustment spring pin 2036, the depth adjustment spring pin 2036 may engage or may move into or may be positioned and/or located within the second depth guide 2021, the third depth guide 2022 or the loading depth guide 2037, respectively. As a result, the width of the adjustable crossbar 2200 is changed, adjusted, moved or configured to the width associated with the second depth guide 2021, the third depth guide 2022 or the loading depth guide 2037. For example, FIG. 60D shows the depth adjustment spring pin 2036 may be engaged in or may be positioned and/or located within the third depth guide 2022 which may change, adjust, move or configure the depth of the adjustable crossbar 2202 to be a depth corresponding to the third depth guide 2022. For loading or unloading retail products, the depth adjustment spring pin 2036 may be moved to or aligned with the loading depth guide 2037. As a result, the depth adjustment spring pin 2036 may engage in or may be positioned and/or located within the loading depth guide 2037, and the depth of the adjustable crossbar 2202 may be changed, adjusted, moved and/or configured to the depth corresponding to the loading depth guide 2037 which is the deepest depth when compared to the depths corresponding to the first, second and/or third depth guides 2020, 2021, 2022.

It will be appreciated that various of the above-disclosed and other features and functions, or alternatives thereof, may be desirably combined into many other different systems and/or methods. Also, various presently unforeseen or unanticipated alternatives, modifications, variations or improvements therein may be subsequently made by those skilled in the art, and are also intended to be encompassed by the present disclosure.

We claim:

1. A hanging merchandising product divider and pusher system for dispensing retail products, the hanging system comprising:

a first divider having a length defined between a front end and a rear end, a first height defined between a top end and a bottom end of the first divider located adjacent to the rear end of the first divider, and a second height defined between the top end and the bottom end of the first divider located adjacent to the front end of the first divider;

at least one second divider having a length defined between a front end and a rear end, a first height defined between a top end and a bottom end of the second divider located adjacent to the rear end of the second divider, and a second height defined between the top end and the bottom end of the second divider located adjacent to the front end of the second divider;

at least one connection plate having an overall height, an overall width and an overall length that is greater than the overall height and overall width, wherein the connection plate connects the entire bottom end of the first divider to the entire bottom end of the second divider, wherein the overall height is defined between a top-side surface of the connection plate and a bottom-side surface of the connection plate located opposite with respect to the top-side surface of the connection plate, wherein the bottom-side surface of the connection plate is continuous and uninterrupted across the entire overall width and along the entire overall length of the connection plate and the top-side surface has pusher rails extending upwardly therefrom;

at least one rear support connector connecting at least a portion of the rear end of the first divider to at least a portion of the rear end of the second divider;

a first pocket defined by the first and second dividers, the connection plate, the rear support connector and the front ends of the first and second dividers, wherein the first pocket is sized or configured to receive one or more first retail products; and a pusher paddle movably connected to the connection plate between the first and second dividers, wherein the pusher paddle is directly mounted in the pusher rails that are provided on the top-side surface of the connection plate and is urged towards a front-side of the hanging system such that the pusher paddle moves the one or more first retail products towards the front-side of the hanging system, when the one or more first retail products are positioned within the first pocket of the hanging system, wherein the first heights of the first and second dividers located adjacent to the rear ends of the first and second dividers are greater than the second heights of the first and second dividers located adjacent to the front ends of the first and second dividers, and further wherein intermediate heights between the first and second heights of the first and second dividers continuously decrease along at least a majority of the entire lengths of the first and second dividers.

2. The hanging system according to claim 1, further comprising:

curved edges along the top ends of the first and second dividers extending from the rear ends of the first and second dividers to the front ends of the first and second dividers.

3. The hanging system according to claim 2, further comprising:

a graphic mount positioned adjacent to the front end and the bottom end of one of the first and second dividers and configured to display at least one graphic.

4. The hanging system according to claim 1, further comprising:

a fence insert located between the front ends of the first and second dividers, wherein the fence insert extends upward from the bottom ends of the first and second dividers and is configured to retain the one or more first retail products within the first pocket of the hanging system.

5. The hanging system according to claim 1, further comprising:

at least one second pocket sized or configured to receive one or more second retail products, wherein the first and second retail products have different shapes, sizes or configurations.

6. The hanging system according to claim 5, further comprising:

a third divider connected to the first divider, wherein the second pocket is located between the first divider and the third divider.

7. The hanging system according to claim 6, further comprising:

at least one third pocket sized or configured to receive one or more third retail products, wherein the at least one third pocket is located between the third divider and a fourth divider, wherein the first, second and third retail products have different shapes, sizes or configurations.

8. The hanging system according to claim 4, wherein the fence insert has a total height that is less than the first heights of the first and second dividers located adjacent to the rear ends of the first and second dividers.

9. The hanging system according to claim 1, further comprising:

a product retaining fence formed along the front side of at least one of the first and second dividers, wherein the product retaining fence is sized or configured to prevent the one or more first retail products from being pushed outwardly from the front-side of the hanging system by the pusher paddle when the one or more first retail products are positioned within the first pocket of the hanging system.

10. The hanging system according to claim 9, wherein the product retaining fence is positioned at an angle with respect to the lengths of the first and second dividers.

11. The hanging system according to claim 10, further comprising:

a product alignment rib provided within the first pocket sized or configured to align a first product of the one or more first retail products, located adjacent to the front-side of the hanging system, such that the first product is substantially parallel to the product retaining fence when the one or more first retail products are positioned within the first pocket of the hanging system.

12. A system for dispensing retail products, the system comprising:

a hanging system comprising a first divider having a length defined between a front end and a rear end and a height defined between a top end and a bottom end;

at least one second divider having a length defined between a front end and a rear end and a height defined between a top end and a bottom end;

at least one rear support connector connecting at least a portion of the rear end of the first divider to at least a portion of the rear end of the second divider;

at least one connection plate having an overall height, an overall width and an overall length that is greater than the overall height and overall width, wherein the connection plate connects the entire bottom end of the first divider to the entire bottom end of the second divider, wherein the overall height is defined between a top-side surface of the connection plate and a bottom-side surface of the connection plate located opposite with respect to the top-side surface of the connection plate, wherein the bottom-side surface of the connection plate is continuous and uninterrupted across the entire overall width and along the entire overall length of the connection plate and the top-side surface has pusher rails extending upwardly therefrom;

a first pocket located between the first and second dividers and above the at least one connection plate, wherein the first pocket is sized or configured to receive one or more first retail products; and a movable pusher paddle located between the first and second dividers and directly mounted in the pusher rails that are provided on the top-side surface of the connection plate, wherein the pusher paddle is configured to move the one or more retail products towards a front-side of the hanging system, when the one or more retail products are positioned in the first pocket of the hanging system, wherein the top ends of the first and second dividers have curved edges that curve along at least a majority of the entire lengths of the first and second dividers extending from the rear ends of the first and second dividers to the front ends of the first and second dividers, and wherein the pusher paddle has a front-side adjacent to the front-side of the hanging system, a bottom end adjacent to the bottom ends of the first and second dividers, a top end located opposite with respect to the bottom end of the pusher paddle and a product angler provided on the front-side of the pusher paddle and adjacent to the bottom end of the pusher paddle, wherein the product angler supports the one or more first retail products at a supported angle within the first pocket, when the one or more first retail products are positioned within the first pocket of the hanging system.

13. The system according to claim 12, further comprising:

(i) a hanging mount bracket attached to the hanging system via lower and upper rear mounting hangers extending outwardly with respect to the back-side of the hanging system and at least one peg clip connected to the hanging mount bracket;

(ii) an upright mount crossbar attached to the hanging system via the lower and upper rear mounting hangers;

(iii) a moveable adjustable depth crossbar attached to the hanging system via the lower and upper rear mounting hangers; or (iv) front and rear shelf mount tracks attached to the hanging system via a toe clip and the lower rear mounting hanger.

14. The system according to claim 12, further comprising:

a third divider connected to the second divider such that a second pocket is formed between the second and third dividers, wherein the second pocket is sized or configured to receive at least one second retail product, wherein the one or more first retail products and the at least one second retail product have different shapes, sizes or configurations.

15. The hanging system according to claim 1, wherein the pusher paddle has a front-side adjacent to the front-side of the hanging system, a bottom end adjacent to the connection plate, a top end located opposite with respect to the bottom end of the pusher paddle and a product angler provided on the front-side of the pusher paddle, wherein the product angler supports the one or more first retail products at a supported angle within the first pocket, when the one or more first retail products are positioned within the first pocket of the hanging system.

16. The hanging system according to claim 15, wherein the supported angle is one or more degrees.

17. The hanging system according to claim 16, wherein the supported angle is about five degrees, about ten degrees, about twenty degrees or about thirty degrees.

18. The hanging system according to claim 15, wherein the product angler has a front surface located adjacent to the front-side of the hanging system and opposite with respect to the front-side of the pusher paddle, and further wherein the front surface of the product angler forms an extendible plane that intersects the top end of the pusher paddle.

19. The hanging system according to claim 15, wherein the product angler is provided at the bottom end of the pusher paddle.

* * * * *